US009434493B2

(12) United States Patent
Takahashi et al.

(10) Patent No.: US 9,434,493 B2
(45) Date of Patent: Sep. 6, 2016

(54) PACKAGING DEVICE

(71) Applicants: Toshihiro Takahashi, Nagoya (JP); Teruo Imamaki, Nissin (JP)

(72) Inventors: Toshihiro Takahashi, Nagoya (JP); Teruo Imamaki, Nissin (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 530 days.

(21) Appl. No.: 14/080,834

(22) Filed: Nov. 15, 2013

(65) Prior Publication Data

US 2014/0130464 A1 May 15, 2014

(30) Foreign Application Priority Data

Nov. 15, 2012 (JP) ..... 2012-251710

(51) Int. Cl.

| | |
|---|---|
| ***B65D 75/30*** | (2006.01) |
| ***B65B 51/22*** | (2006.01) |
| ***B65B 57/08*** | (2006.01) |
| ***B65B 61/06*** | (2006.01) |
| ***B65B 11/10*** | (2006.01) |
| ***B65D 75/28*** | (2006.01) |

(52) U.S. Cl.

CPC ..... *B65B 51/22* (2013.01); *B65B 11/10* (2013.01); *B65B 57/08* (2013.01); *B65B 61/06* (2013.01); *B65D 75/28* (2013.01); *B65B 2220/16* (2013.01)

(58) Field of Classification Search

CPC ..... B65B 51/22; B65D 75/28; B65D 75/30; B29C 65/02; B29C 65/0618; B29C 65/2053

USPC ..... 53/218, 228, 441; 156/583.1, 583.3, 156/583.4

See application file for complete search history.

(56) References Cited

U.S. PATENT DOCUMENTS

| | | | | |
|---|---|---|---|---|
| 1,454,279 | A * | 5/1923 | Hayes | B65B 11/10 53/228 |
| 1,857,722 | A | 5/1932 | Howell | |
| 2,147,135 | A | 2/1939 | Addis | |

(Continued)

FOREIGN PATENT DOCUMENTS

| | | | |
|---|---|---|---|
| CN | 2871468 | Y | 2/2007 |
| CN | 102211720 | A | 10/2011 |

(Continued)

OTHER PUBLICATIONS

Co Pending U.S. Appl. No. 14/080,829, filed Nov. 15, 2013.

(Continued)

*Primary Examiner* — Gloria R Weeks

(74) *Attorney, Agent, or Firm* — Banner & Witcoff, Ltd.

(57) ABSTRACT

A packaging device includes a conveyance mechanism, a guide portion, a heating portion, and a processor. The conveyance mechanism is configured to convey, in a conveyance direction along a conveyance path, a base on which an object is placed. The guide portion is configured to guide a film for packaging and to move along a movement path. The heating portion is provided below the conveyance path, is configured to heat the film, and includes a plurality of heating units that are arranged parallel to the conveyance path and that are arranged side by side in a direction intersecting the conveyance direction. Each of the plurality of heating units includes a heater and an urging portion. The urging portion is configured to urge the heater upward toward the conveyance path. The processor is configured to cause the heating portion to heat the film guided to a lower side of the base.

4 Claims, 44 Drawing Sheets

(56) References Cited

U.S. PATENT DOCUMENTS 2,406,254 A 8/1946 Ringler
2,890,555 A * 6/1959 Hayssen ..... B65B 11/22 53/228
2,980,231 A 4/1961 Reid et al.
3,118,537 A 1/1964 Copping
3,222,844 A * 12/1965 Smith ..... B65B 11/08 53/209
3,585,777 A 6/1971 Pesch
3,599,394 A * 8/1971 Vilen ..... B65B 51/10 219/388
3,775,225 A * 11/1973 Schott, Jr. ..... B29C 65/18 156/510
3,779,838 A * 12/1973 Wech ..... B29C 65/18 100/320
3,874,976 A * 4/1975 MacFarland, Jr. .. B29C 65/7451 156/251
3,912,575 A * 10/1975 Zelnick ..... B29C 65/223 156/515
3,942,298 A * 3/1976 Matzinger ..... B65B 51/14 53/204
3,967,433 A * 7/1976 Bonfiglioli ..... B65B 11/54 493/113
3,998,120 A 12/1976 Granger et al.
4,061,223 A 12/1977 McGinnis
4,134,246 A * 1/1979 Michels ..... B65B 11/12 53/210
4,313,288 A * 2/1982 Tassi ..... B65B 41/16 53/229
4,509,314 A * 4/1985 Bozza ..... B65B 11/10 53/228
4,541,225 A * 9/1985 Byland ..... B65B 11/12 53/206
4,583,348 A * 4/1986 Treiber ..... B65B 11/54 53/389.3
4,609,101 A 9/1986 Ullman
4,662,148 A * 5/1987 Nilsson ..... B65B 11/10 53/228
4,738,078 A 4/1988 Benz et al.
4,770,289 A 9/1988 Ganz
4,991,376 A * 2/1991 Backman ..... B65B 25/14 53/389.2
5,089,897 A 2/1992 Curley
5,103,617 A 4/1992 Sjogren et al.
5,187,922 A * 2/1993 Mast ..... B65B 9/026 53/229
5,189,864 A 3/1993 Cinotti et al.
5,284,002 A * 2/1994 Fowler ..... B29C 65/38 493/194
5,331,788 A * 7/1994 Cinotti ..... B65B 25/146 53/228
5,406,774 A * 4/1995 Dodge ..... B65B 63/02 53/228
5,473,861 A * 12/1995 Fukunaga ..... B65B 11/54 53/228
5,595,042 A * 1/1997 Cappi ..... B65B 11/54 53/228
5,600,395 A 2/1997 Balling et al.
5,603,198 A 2/1997 Rimondi et al.
5,758,840 A 6/1998 Murakami
5,794,418 A 8/1998 Lai
5,979,822 A 11/1999 Morand et al.
6,223,500 B1 5/2001 Kramps
6,318,053 B1 11/2001 Frank et al.
6,502,375 B2 1/2003 Resta
6,579,409 B2 * 6/2003 Cullins ..... B29C 66/81461 156/583.1
6,658,819 B2 12/2003 Gamberini
6,735,923 B1 5/2004 Resta
6,761,014 B2 7/2004 Cerf
6,796,103 B2 9/2004 Gamberini
6,892,515 B2 5/2005 Cere'
6,895,728 B2 * 5/2005 Kondo ..... B65B 11/54 53/441
7,034,252 B2 * 4/2006 Chang ..... B29C 66/0044 156/579
7,591,373 B2 9/2009 Horiuchi
7,614,498 B2 11/2009 O'Keefe
8,029,428 B2 * 10/2011 Selle ..... B29C 59/007 156/251
8,950,164 B2 2/2015 Resta et al.
2002/0062628 A1 * 5/2002 Whitby ..... B65B 57/14 53/493
2003/0164079 A1 9/2003 Budz et al.
2004/0083682 A1 * 5/2004 Orsini ..... B29C 65/38 53/374.8
2004/0093836 A1 5/2004 Ouellette et al.
2004/0163364 A1 8/2004 Cousins et al.
2005/0284974 A1 12/2005 Shimamura
2006/0096244 A1 5/2006 Cere' et al.
2006/0096248 A1 5/2006 Duterte et al.
2006/0233582 A1 10/2006 Horiuchi
2008/0229715 A1 9/2008 Schmidt et al.
2010/0083620 A1 4/2010 Resta et al.
2010/0313525 A1 12/2010 Martin et al.
2011/0315595 A1 12/2011 Gassick et al.
2013/0298498 A1 11/2013 Imamaki et al.
2013/0298503 A1 11/2013 Takahashi et al.

FOREIGN PATENT DOCUMENTS

GB 369651 A 6/1961
GB 2501959 A 11/2013
JP S50-143691 A 11/1975
JP S57-68324 A 4/1982
JP S58-6864 A 1/1983
JP S59-38284 U 3/1984
JP H01-111604 A 4/1989
JP H03-027930 U 3/1991
JP H05-330517 A 12/1993
JP H06-255635 A 9/1994
JP H07-149310 A 6/1995
JP H09-323842 A 12/1997
JP 2000-177708 A 6/2000
JP 2003160110 A 6/2003
JP 2003341889 A 12/2003
JP 2006-096380 A 4/2006
JP 2007-030898 A 2/2007
JP 2008-110772 A 5/2008
JP 2012-096842 A 5/2012

OTHER PUBLICATIONS

Co Pending U.S. Appl. No. 14/080,833, filed Nov. 15, 2013.
Co Pending U.S. Appl. No. 14/080,872, filed Nov. 15, 2013.
Co Pending U.S. Appl. No. 14/080,882, filed Nov. 15, 2013.
Co Pending U.S. Appl. No. 14/080,902, filed Nov. 15, 2013.
Sep. 9, 2015—(US) Non-Final Office Action—U.S. Appl. No. 13/799,028.
Jun. 17, 2015—(CN) Notification of the Second Office Action—App 201310078682.3, Eng Tran.
Oct. 5, 2015—(US) Non-Final Office Action—U.S. Appl. No. 13/799,119.
Apr. 7, 2016—(US) Non-Final Office Action—U.S. Appl. No. 14/080,833.
Mar. 24, 2016—(US) Final Office Action—U.S. Appl. No. 13/799,119.
Feb. 11, 2016—(US) Non-Final Office Action—U.S. Appl. No. 14/080,882.
Feb. 22, 2016—(US) Non-Final Office Action—U.S. Appl. No. 14/080,872.
Feb. 9, 2016—(JP) Notification of Reasons for Rejection—App 2012-251711, Eng Tran.
Sep. 26, 2014—(US) Non-Final Office Action—U.S. Appl. No. 14/080,829.
Jul. 18, 2014—(EP) Extended EP Search Report—App 13159467.3.
Aug. 29, 2014—(CN) Notification of First Office Action—App 201310078682.3—Eng Tran.
Apr. 12, 2016—(JP) Notification of Reasons for Rejection—App 2012-107114, Eng Tran.

* cited by examiner

PACKAGING DEVICE

CROSS-REFERENCE TO RELATED APPLICATION

This application claims priority to Japanese Patent Application No. 2012-251710 filed Nov. 15, 2012, the content of which is hereby incorporated herein by reference.

BACKGROUND

The present disclosure relates to a packaging device that packages an object that has been placed on a piece of cardboard by covering both the object and the piece of cardboard with a film.

A packaging device is known that packages an object that has been placed on a piece of cardboard, such as corrugated cardboard or the like, by covering both the object and the cardboard with a film. The packaging device can places the film over the upper side of the object, and can cause the end of the film to reach around to a surface (hereinafter referred to as a "lower surface"), of the piece of cardboard, opposite to the side on which the object is placed. The end of the film can be fixed to the lower surface of the piece of cardboard. A tension can be applied to the film and the object can be fixed onto the piece of cardboard by the film. The film can be in close contact with the object and an operator cannot directly touch the object from the outside. The object can be protected by the film.

For example, a known packaging device includes a planar heater that heats a film. The section of the film that is positioned on the lower surface of a piece of cardboard can be sandwiched between the heater and the piece of cardboard. The heater can come into contact with the film. The heater can heat the film in this state, and thus the film can be bonded to the lower surface of the piece of cardboard. In this way, the packaging device can fix the object onto the piece of cardboard by the film.

SUMMARY

There are cases in which an uneven piece of cardboard is used. The heater of the known packaging device has a planar shape. Therefore, the heater cannot track the unevenness of the piece of cardboard. For that reason, the heater cannot be in contact with the whole area of the film that is sandwiched between the piece of cardboard and the heater. The section of the film that is not in contact with the heater may not heated by the heater, and may not bonded to the piece of cardboard. Therefore, the object may not be appropriately fixed onto the piece of cardboard by the film.

Embodiments of the broad principles derived herein provide a packaging device that can appropriately bond a film to an uneven piece of cardboard.

Embodiments provide a packaging device that includes a conveyance mechanism, a guide portion, a heating portion, and a processor. The conveyance mechanism is configured to convey, in a conveyance direction along a conveyance path, a base on which an object is placed. The guide portion is configured to guide a film for packaging. The guide portion is configured to move along a movement path. The movement path intersects the conveyance path and extends in an up-down direction. The heating portion is provided below the conveyance path and is configured to heat the film. The heating portion includes a plurality of heating units that are arranged parallel to the conveyance path and that are arranged side by side in a direction intersecting the conveyance direction. Each of the plurality of heating units includes a heater and an urging portion. The urging portion is configured to urge the heater upward toward the conveyance path. The processor is configured to cause the heating portion to heat the film that has been guided to a lower side of the base by the guide portion.

BRIEF DESCRIPTION OF THE DRAWINGS

Embodiments will be described below in detail with reference to the accompanying drawings in which.

DETAILED DESCRIPTION

Figure 1:
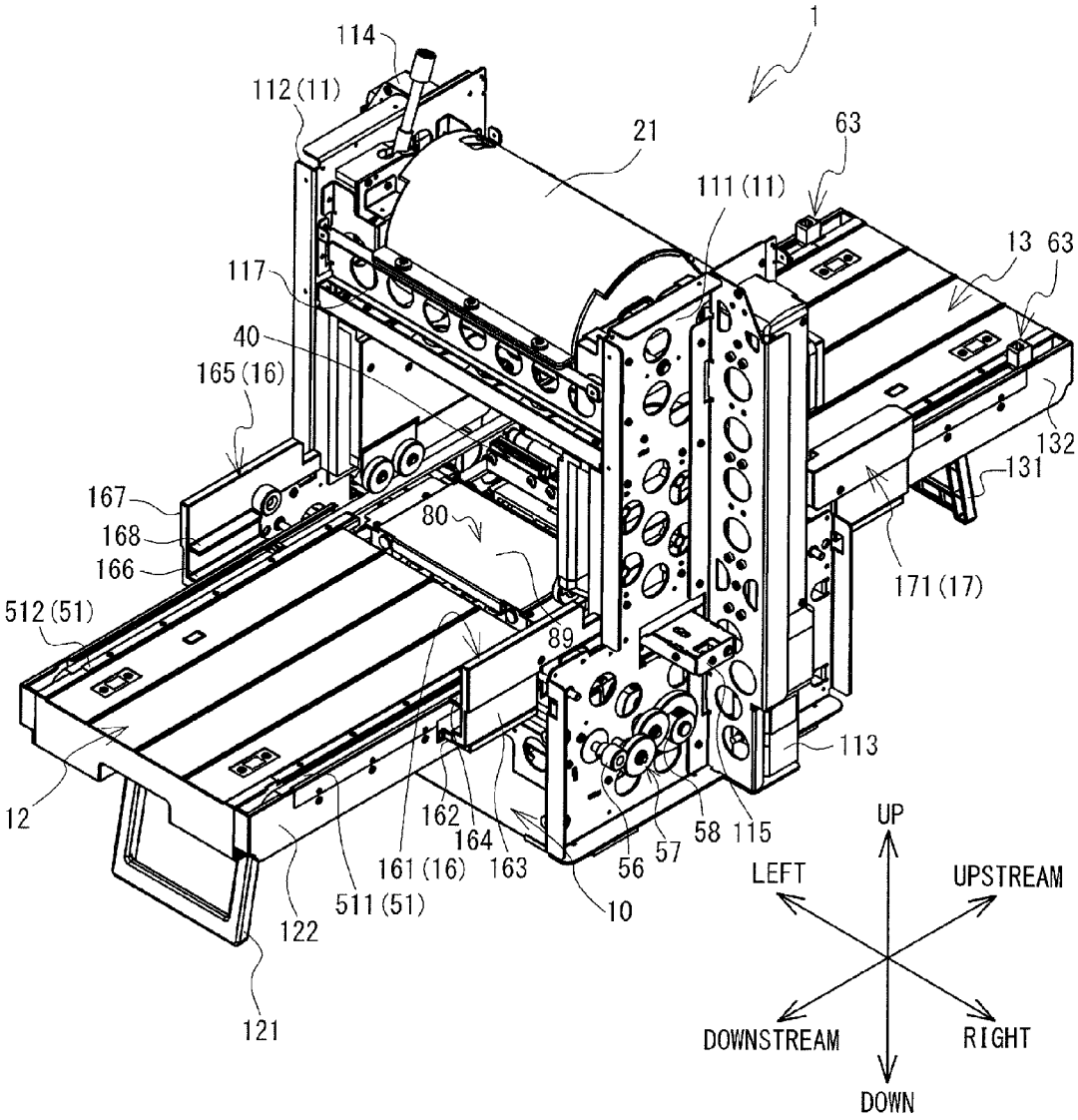
FIG. 1 is an oblique view of a packaging device (in a state in which a first receiving tray and a second receiving tray are opened)

Hereinafter, an embodiment will be explained with reference to the drawings. An overview of a packaging device 1 will be explained with reference to FIGS. 1 to 3. The packaging device 1 can cover the upper side of an object 3 (refer to FIG. 33 etc.) that is placed on a base 2 (refer to FIG. 23 etc.), such as a piece of cardboard, with a film 24 (refer to FIG. 3 etc.), and can fix the object 3 onto the base 2, thus packaging the object 3. Hereinafter, packaging the object 3 in this manner is referred to as "packaging the base 2 and the object 3". The upper side, the lower side, the lower right side, and the upper left side of FIG. 1 are respectively the upper side, the lower side, the right side, and the left side of the packaging device 1. The upper right side and the lower left side of FIG. 1 are respectively the upstream side and the downstream side in the conveyance direction. The packaging device 1 can package the base 2 and the object 3 while conveying the base 2 from the upstream side toward the downstream side in the conveyance direction.

Figure 2:
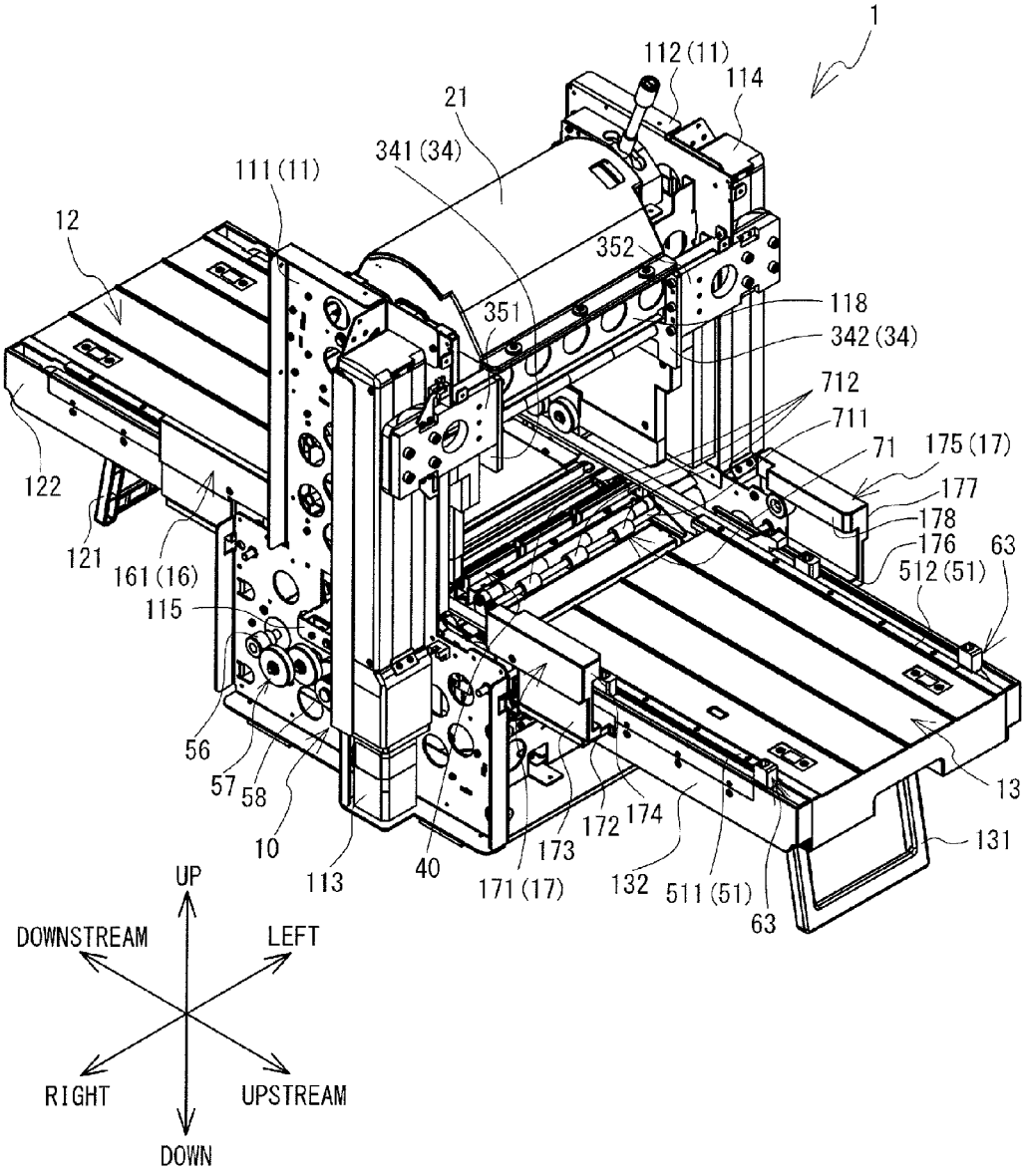
FIG. 2 is another oblique view of the packaging device (in the state in which the first receiving tray and the second receiving tray are opened)

The packaging device 1 includes side plate portions 111 and 112. The side plate portions 111 and 112 respectively extend upward from the right and left edges of a bottom portion 10, which is rectangular in a plan view. The side plate portion 111 is provided on the right side of the packaging device 1. The side plate portion 112 is provided on the left side of the packaging device 1. Hereinafter, the side plate portions 111 and 112 are also collectively referred to as "side plate portions 11". The side plate portions 11 are shaped as substantially rectangular plates whose long sides extend in the up-down direction. The inner surfaces of the side plate portions 111 and 112 face each other. As shown in FIG. 1, a plate-shaped bridge portion 117 is mounted between the downstream side end of the side plate portion 111 and the downstream side end of the side plate portion 112. As shown in FIG. 2, a plate-shaped bridge portion 118 is mounted between the upstream side edge of the side plate portion 111 and the upstream side edge of the side plate portion 112. A film cassette 21 is disposed between the bridge portions 117 and 118. The film cassette 21 is supported between the side plate portions 111 and 112.

A protruding portion 113 that protrudes to the right is provided on the right side surface of the side plate portion 111. A protruding portion 114 that protrudes to the left is provided on the left side surface of the side plate portion 112. Each of the protruding portions 113 and 114 is a housing that extends in the up-down direction. A carriage (not shown in the drawings) that can be driven by rotation of a first motor 221 (refer to FIG. 31) is provided inside each of the protruding portions 113 and 114. As shown in FIG. 2, the carriage provided inside the protruding portion 113 connects to a support plate portion 351 on the upstream side of the protruding portion 113. The support plate portion 351 is a plate-shaped member and extends to the right from a support portion 341 (which will be described below). The carriage provided inside the protruding portion 114 connects to a support plate portion 352 on the upstream side of the protruding portion 114. The support plate portion 352 is a plate-shaped member and extends to the left from a support portion 342 (which will be described below). The first motor 221 can cause the support portions 341 and 342, which respectively connect to the support plates 351 and 352 via the carriages, to move up and down.

A protruding portion 115 that protrudes to the right is provided on the right side surface of the side plate portion 111, on the downstream side of the protruding portion 113. A protruding portion 116 (refer to FIGS. 4 and 5) that protrudes to the left is provided on the left side surface of the side plate portion 112, on the downstream side of the protruding portion 114. A fifth motor 225 (refer to FIG. 31) is provided inside the protruding portion 115. The fifth motor 225 can drive a carriage (not shown in the drawings) that is provided between the protruding portions 115 and 116. The carriage can move a cutting portion 77 (refer to FIG. 5) in the left-right direction.

The film cassette 21 may internally contain a film roll 22 (refer to FIG. 5) around which the film 24 is wound. A discharge opening (not shown in the drawings) is provided on the lower side of the film cassette 21. The discharge opening extends across the width of the film 24 that is wound around the film roll 22. The film 24 that is fed out from the film roll 22 may be discharged downward from the discharge opening. The base 2 on which the object 3 has been placed may be conveyed from the upstream side toward the downstream side, passing below the film cassette 21 and between the side plate portions 111 and 112, and the base 2 and the object 3 may be packaged with the film 24 that is fed out from the film roll 22.

The side plate portions 111 and 112 are each provided with a clutch spring on a portion that supports the film cassette 21. The clutch spring may apply a torque in the opposite direction from the direction in which the film roll 22 rotates when the film 24 is discharged from the film cassette 21.

The downstream side edges of the side plate portions 11 support a first receiving tray 12 such that the first receiving tray 12 can be swung up and down. In a plan view, the first receiving tray 12 has a substantially rectangular box shape whose short sides extend in the left-right direction. The first receiving tray 12 can be swung up and down, with the upstream end of the first receiving tray 12 serving as a pivot point. The top surface of the first receiving tray 12 may receive the base 2 and the object 3 for which the packaging has been completed. Hereinafter, the top surface of the first receiving tray 12 is referred to as the "receiving surface".

A guide portion 161 is provided on the right edge and on the upstream side of the first receiving tray 12. The guide portion 161 includes a first extending portion 162, a second extending portion 163, and a protruding portion 164. The first extending portion 162 is a plate-shaped member that extends to the right from the right edge of the first receiving tray 12. The second extending portion 163 is a substantially rectangular plate-shaped member in a side view, and extends upward from the right edge of the first extending portion 162. The protruding portion 164 is a plate-shaped member that protrudes to the left from the left side surface of the second extending portion 163. A guide portion 165 is provided on the left edge and on the upstream side of the first receiving tray 12. The guide portion 165 includes a first extending portion 166, a second extending portion 167, and a protruding portion 168. The first extending portion 166 is a plate-shaped member that extends to the left from the left edge of the first receiving tray 12. The second extending portion 167 is a substantially rectangular plate-shaped member in a side view, and extends upward from the left edge of the first extending portion 166. The protruding portion 168 is a plate-shaped member that protrudes to the right from the right side surface of the second extending portion 167. Hereinafter, the guide portions 161 and 165 are also collectively referred to as "guide portions 16".

As shown in FIG. 2, the upstream side edges of the side plate portions 11 support a second receiving tray 13 such that the second receiving tray 13 can be swung up and down. In a plan view, the second receiving tray 13 has a substantially rectangular box shape whose short sides extend in the left-right direction. The second receiving tray 13 can be swung up and down, with the upstream end of the second receiving tray 13 serving as a pivot point. The top surface of the second receiving tray 13 may receive the base 2 that is conveyed from the upstream side between the side plate portions 111 and 112. Hereinafter, the top surface of the second receiving tray 13 is referred to as the "receiving surface", in the same manner as in the case of the first receiving tray 12.

A guide portion 171 is provided on the right edge and on the downstream side of the second receiving tray 13. The guide portion 171 includes a first extending portion 172, a second extending portion 173, and a protruding portion 174. The first extending portion 172 is a plate-shaped member that extends to the right from the right edge of the second receiving tray 13. The second extending portion 173 is a substantially rectangular plate-shaped member in a side view, and extends upward from the right edge of the first extending portion 172. The protruding portion 174 protrudes to the left from the left side surface of the second extending portion 173. A guide portion 175 is provided on the left edge and on the downstream side of the second receiving tray 13. The guide portion 175 includes a first extending portion 176, a second extending portion 177, and a protruding portion 178. The first extending portion 176 is a plate-shaped member that extends to the left from the left edge of the second receiving tray 13. The second extending portion 177 is a substantially rectangular plate-shaped member in a side view, and extends upward from the left edge of the first extending portion 176. The protruding portion 178 is a plate-shaped member that protrudes to the right from the right side surface of the second extending portion 177. Hereinafter, the guide portions 171 and 175 are also collectively referred to as "guide portions 17".

As shown in FIGS. 1 and 2, when the first receiving tray 12 and the second receiving tray 13 have been swung down and the receiving surface of the first receiving tray 12 and the receiving surface of the second receiving tray 13 have become substantially horizontal, the receiving surface of the first receiving tray 12 and the receiving surface of the second receiving tray 13 form the same plane. A leg portion 121 supports, from below, the first receiving tray 12 whose receiving surface has become horizontal. A leg portion 131 supports, from below, the second receiving tray 13 whose receiving surface has become horizontal. The base 2 on which the object 3 has been placed may be conveyed from the upstream side toward the downstream side on the plane that is formed by the receiving surfaces of the first receiving tray 12 and the second receiving tray 13. Hereinafter, a path section along which the base 2 is conveyed on the plane that is formed by the receiving surfaces of the first receiving tray 12 and the second receiving tray 13 is referred to as a "conveyance path 103" (refer to FIGS. 6 and 7).

Figure 3:
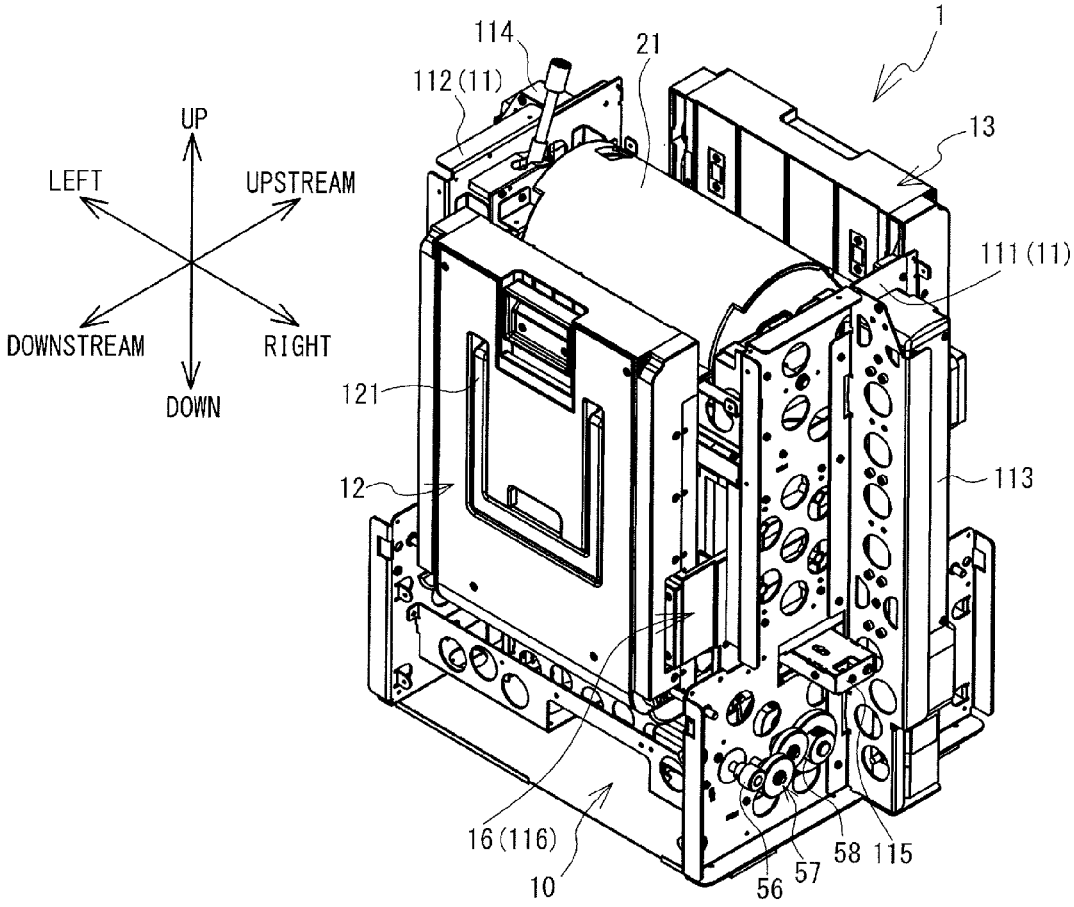
FIG. 3 is an oblique view of the packaging device (in a state in which the first receiving tray and the second receiving tray are closed)

A user may switch the receiving surfaces to a substantially horizontal orientation, by manually swinging the first receiving tray 12 and the second receiving tray 13 downward. In this state, it is possible to package the base 2 and the object 3 with the film 24. The receiving surfaces of the first receiving tray 12 and the second receiving tray 13 form a single plane. Therefore, it is possible to smoothly convey the base 2. On the other hand, as shown in FIG. 3, the user may also switch the receiving surfaces to a vertical orientation by manually swinging the first receiving tray 12 and the second receiving tray 13 upward. In this state, the first receiving tray 12 and the second receiving tray 13 block the conveyance path between the side plate portions 111 and 112. Thus, it is possible to reduce the space necessary to install the packaging device 1. Further, in this state, the packaging device 1 can easily be carried around.

Endless belts 511 and 512 are respectively provided on the right edges and the left edges of the first receiving tray 12 and the second receiving tray 13. The belt 511 is routed around pulleys 521, 523 to 525 and 527 (refer to FIG. 17). The belt 512 is provided around pulleys 533 to 535 and pulleys (not shown in the drawings). Hereinafter, the belts 511 and 512 are also collectively referred to as "belts 51". Sections of the belts 51 that are positioned on side surfaces of the first receiving tray 12 are covered by a pair of covers 122 from both the left and right sides. Sections of the belts 51 that are positioned on side surfaces of the second receiving tray 13 are covered by a pair of covers 132 from both the left and right sides.

Figure 31:
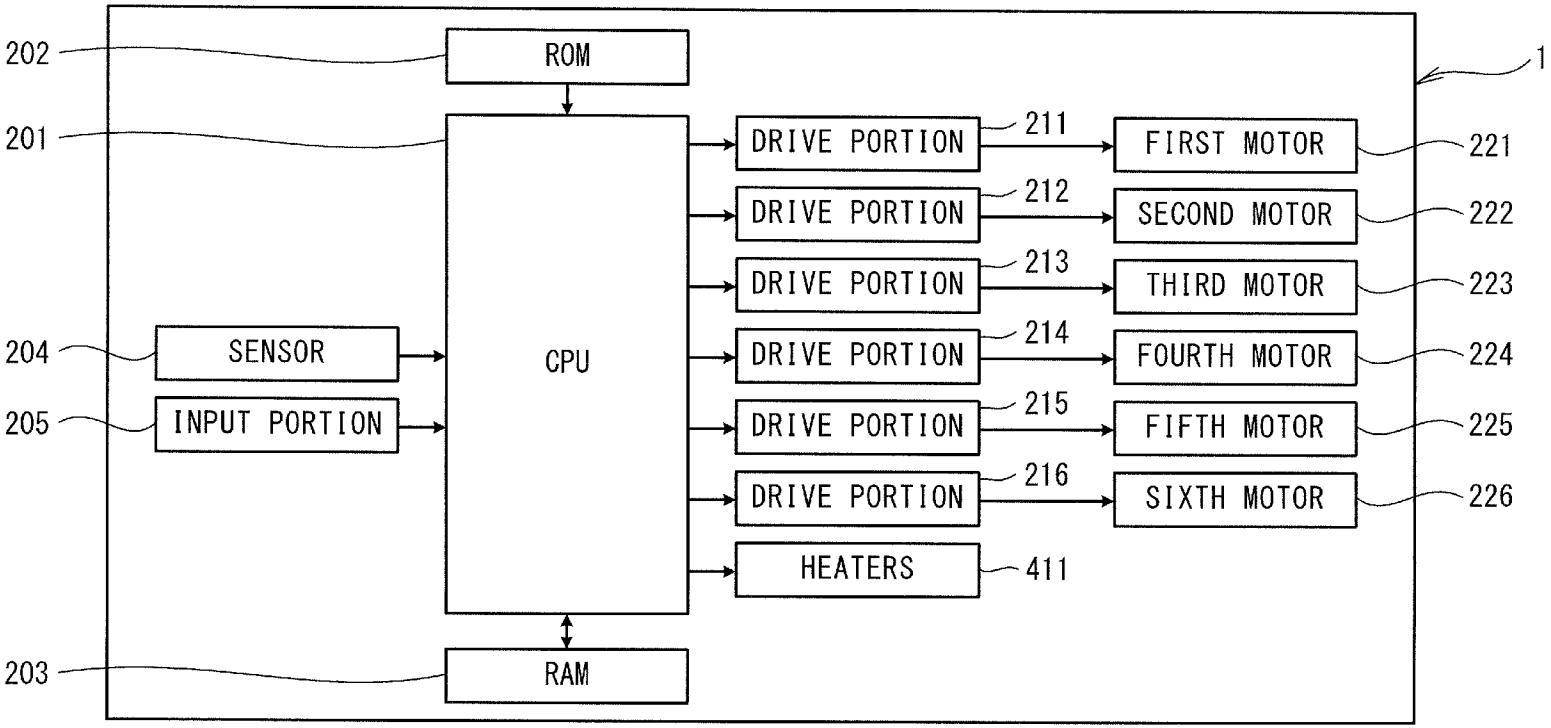
FIG. 31 is a block diagram showing an electrical configuration of the packaging device.

The belts 51 may be rotated by a second motor 222 (refer to FIG. 31). Conveyance portions 60 (refer to FIG. 17) of the belts 51 convey the base 2 from the upstream side to the downstream side. The conveyance portions 60 are provided on the outer side surfaces on the belts 51. Hereinafter, the belts 51, the conveyance portions 60, and the second motor 222 are also collectively referred to as a "conveyance mechanism 50" (refer to FIG. 17). The conveyance mechanism 50 will be described in detail below.

Figure 4:
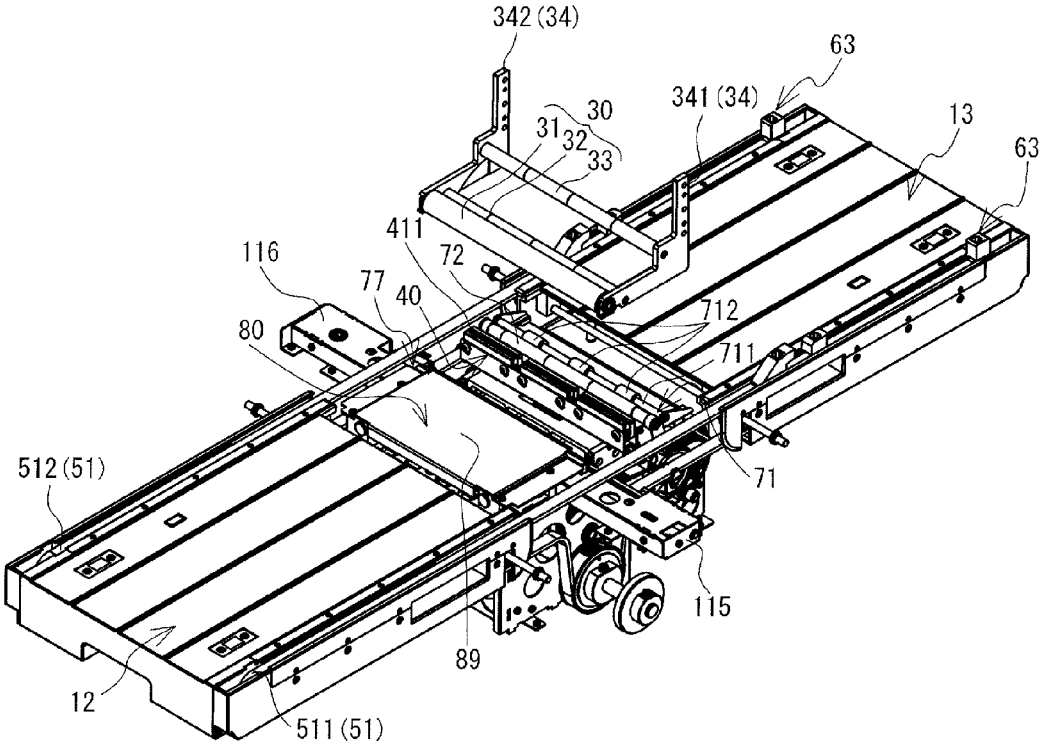
FIG. 4 is an oblique view of a support portion, a heating portion, and a rotation inhibiting portion.
Figure 5:
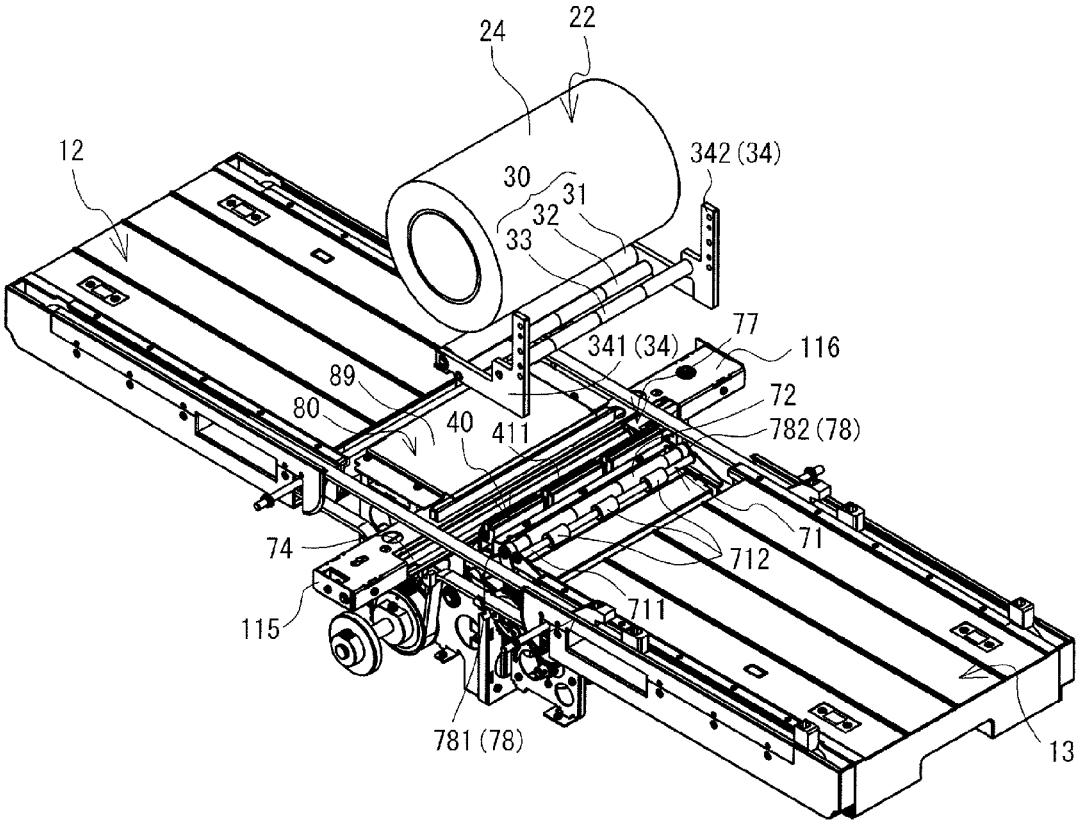
FIG. 5 is another oblique view of the support portion, the heating portion, and the rotation inhibiting portion.

The internal structure of the packaging device 1 will be explained with reference to FIGS. 4 to 7. In FIG. 4, the film roll 22 is omitted in order to facilitate understanding. As shown in FIGS. 4 and 5, the packaging device 1 also includes a base guide roller 71. The base guide roller 71 is provided on the upstream side of the section between the side plate portions 111 and 112 (refer to FIG. 1) and below the conveyance path 103. The base guide roller 71 includes a shaft portion 711 and a plurality of roller portions 712. The shaft portion 711 extends in the left-right direction. The plurality of roller portions 712 are provided at equal intervals in the axial direction of the shaft portion 711. The plurality of roller portions 712 are in contact with the conveyance path 103 from below. As the base 2 is conveyed from the upstream side to the downstream side along the conveyance path 103, the base guide roller 71 may support the base 2 from below between the first receiving tray 12 and the second receiving tray 13, and may guide the base 2 from the second receiving tray 13 to the first receiving tray 12.

Figure 6:
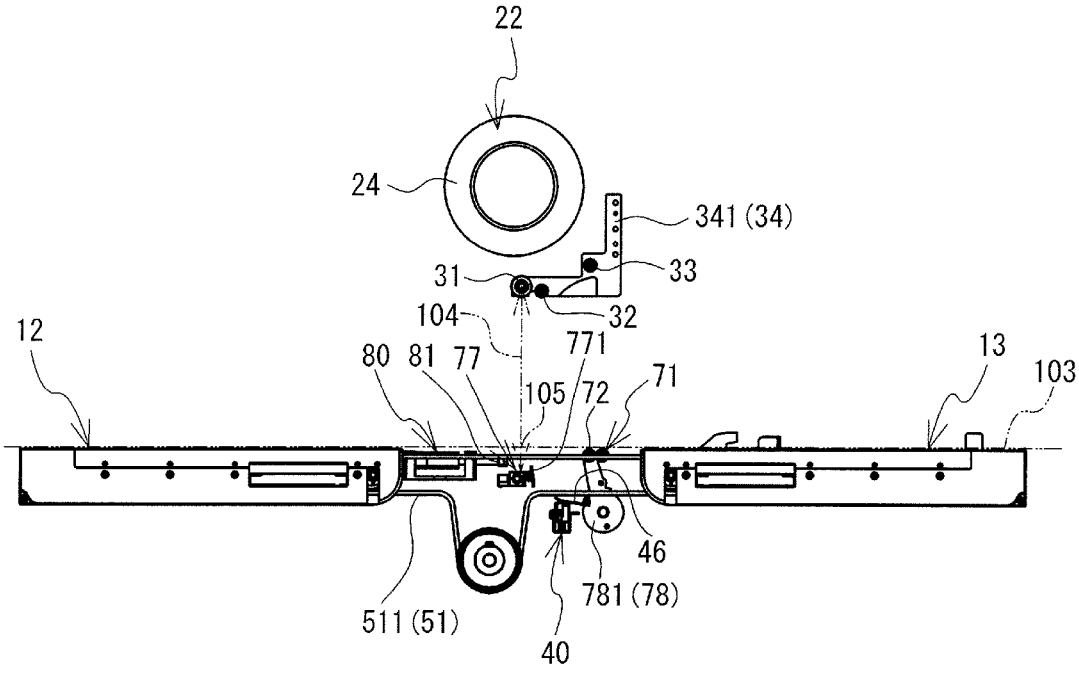
FIG. 6 is a right side view showing a state in which the support portion is located at its highest position.
Figure 7:
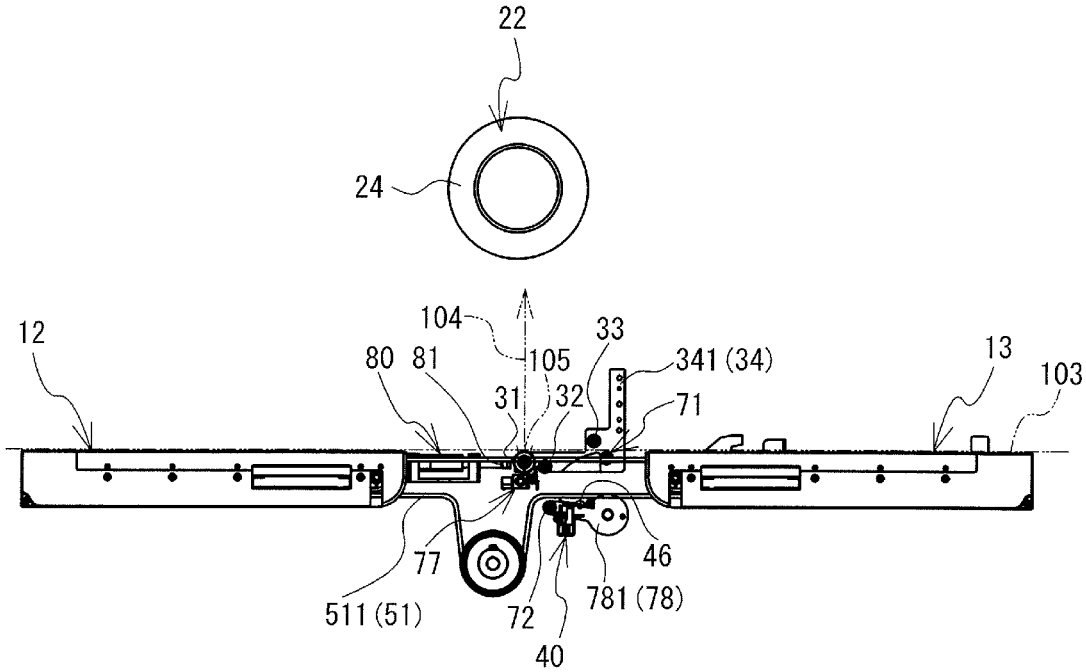
FIG. 7 is a right side view showing a state in which the support portion is located at its lowest position.

The packaging device 1 also includes a cylinder-shaped holding roller 72. The holding roller 72 extends in the left-right direction. The right end of the holding roller 72 is rotatably supported by a holding portion 781. The left end of the holding roller 72 is rotatably supported by a holding portion 782. Hereinafter, the holding portions 781 and 782 are also collectively referred to as "holding portions 78". The holding portions 78 may be pivoted by a sixth motor 226 (refer to FIG. 31). As shown in FIGS. 6 and 7, the pivoting of the holding portions 78 may switch the holding roller 72 between a state in which the holding roller 72 is positioned close to the downstream side of the base guide roller 71 (refer to FIG. 6) and a state in which the holding roller 72 has been moved downward, away from the base guide roller 71 (refer to FIG. 7). As shown in FIG. 6, when the holding roller 72 is positioned close to the downstream side of the base guide roller 71, the holding roller 72 is in contact with the conveyance path 103 from below. In this state, the holding roller 72 can hold the film 24 that has been fed out from the film cassette 21 such that the film 24 is clamped between the holding roller 72 and the base guide roller 71.

As shown in FIGS. 4 and 5, the packaging device 1 also includes a heating portion 40. The top surface of the heating portion 40 is provided with heaters 411. The heating portion 40 may be moved up and down by a third motor 223 (refer to FIG. 31). FIGS. 4 and 5 show a state in which the heating portion 40 has been moved upward. In a state in which the heating portion 40 has been moved upward and the holding roller 72 is positioned on the downstream side of the base guide roller 71, the heating portion 40 is positioned on the downstream side of the holding roller 72. In the state in which the heating portion 40 has been moved upward, the heaters 411 come close to the conveyance path 103 from below. In this state, the heaters 411 may heat and melt the film 24 that has been fed out from the film cassette 21, thus bonding the film 24 to the base 2. FIGS. 6 and 7 show a state in which the heating portion 40 has been moved downward. In a state in which the heating portion 40 has been moved downward and the holding roller 72 has been moved downward, away from the base guide roller 71, the heating portion 40 is positioned on the upstream side of the holding roller 72. In this state, a lid portion 46, which may be pivoted, covers the heaters 411 from above. The heating portion 40 will be described in more detail below.

The packaging device 1 also includes the cutting portion 77. The cutting portion 77 is provided with a blade portion 771 (refer to FIG. 39) that protrudes upward from the top surface of the cutting portion 77. The blade portion 771 extends in the left-right direction. As shown in FIG. 5, a guide rail 74 passes through the cutting portion 77. The guide rail 74 extends in the left-right direction on the downstream side of the heating portion 40 that has been moved upward. The right end and the left end of the guide rail 74 are respectively positioned inside the protruding portions 115 and 116. The carriage (not shown in the drawings) is positioned on the downstream side of the guide rail 74. The carriage may be driven by the fifth motor 225 (refer to FIG. 31) that is provided inside the protruding portion 115. The carriage is connected to the cutting portion 77. When the fifth motor 225 drives the carriage, the cutting portion 77 is moved in the left-right direction along the guide rail 74. In this way, the blade portion 771 can cut across the width of the film 24.

The packaging device 1 also includes a sensor 204 (refer to FIG. 31) on the inner side of the side plate portion 111. A reflecting plate is provided on the outer side surface of the belt 51. The sensor 204 is a non-contact type position sensor that can detect the reflecting plate. The sensor 204 is positioned below the belt 51 and can emit light upward. The sensor 204 can detect the reflecting plate by detecting the light reflected by the reflecting plate. In a case where the sensor 204 has detected the reflecting plate, the conveyance portions 60 (refer to FIG. 17, to be described below) that are provided on the belts 51 are in a state in which the conveyance portions 60 protrude upward higher than the receiving surface of the second receiving tray 13 (refer to FIG. 17).

The packaging device 1 also includes a guide roller 31, a first auxiliary roller 32, and a second auxiliary roller 33. Hereinafter, the guide roller 31, the first auxiliary roller 32, and the second auxiliary roller 33 are also collectively referred to as "movable rollers 30". The movable rollers 30 have a cylindrical shape. The movable rollers 30 extend in the left-right direction. The length of each of the movable rollers 30 in the left-right direction is substantially the same as the length of each of the first receiving tray 12 and the second receiving tray 13 in the left-right direction. The movable rollers 30 each have a cylindrical portion and a shaft portion. The shaft portion extends in the left-right direction. The cylindrical portion is provided around a peripheral wall of the shaft portion. The cylindrical portion of the guide roller 31 is made of rubber. The cylindrical portion of the guide roller 31 is fixed to the shaft portion. The cylindrical portions of the first auxiliary roller 32 and the second auxiliary roller 33 can be rotated with respect to the shaft portions. The diameters of the cylindrical portions of the first auxiliary roller 32 and the second auxiliary roller 33 are substantially the same. The diameter of the cylindrical portion of the guide roller 31 is larger than the diameter of the cylindrical portion of each of the first auxiliary roller 32 and the second auxiliary roller 33.

The packaging device 1 also includes the support portions 341 and 342. Hereinafter, the support portions 341 and 342 are also collectively referred to as "support portions 34". The support portions 341 and 342 respectively support the right end and the left end of each of the movable rollers 30. The shaft portion of the guide roller 31 can be rotated with respect to the support portions 34. The shaft portions of the first auxiliary roller 32 and the second auxiliary roller 33 are fixed to the support portions 34. The support portions 34 are plate-shaped members having a reverse L shape in a right side view. The guide roller 31 is supported by each of the support portions 341 and 342 at the downstream side end of the section of each of the support portions 341 and 342 that extends in the conveyance direction. The first auxiliary roller 32 is supported by each of the support portions 341 and 342 in the vicinity of and on the upstream side of the position where the guide roller 31 is supported. The second auxiliary roller 33 is supported by each of the support portions 341 and 342 at a position where the section of each of the support portions 341 and 342 that extends in the conveyance direction intersects the section that extends in the up-down direction. Therefore, as shown in FIGS. 6 and 7, the guide roller 31, the first auxiliary roller 32, and the second auxiliary roller 33 are disposed in that order from the downstream side to the upstream side. The position of the lower edge of the cylindrical portion of the guide roller 31 is substantially the same in the up-down direction as the position of the lower edge of the cylindrical portion of the first auxiliary roller 32. The position of the lower edge of the cylindrical portion of the second auxiliary roller 33 is higher in the up-down direction than the positions of the upper edges of the cylindrical portions of the guide roller 31 and the first auxiliary roller 32.

A plurality of holes that are aligned in the up-down direction are provided in the section of each of the support portions 341 and 342 that extends in the up-down direction. As shown in FIG. 2, the support plate portion 351 is affixed by screws to the holes that are provided in the section of the support portion 341 that extends in the up-down direction. The support plate portion 351 extends to the right from the right side surface of the support portion 341. The support plate portion 352 is affixed by screws to the holes that are provided in the section of the support portion 342 that extends in the up-down direction. The support plate portion 352 extends to the left from the left side surface of the support portion 342. As described above, the support plate portions 351 and 352 are respectively connected to the carriages provided inside the protruding portions 113 and 114. The carriages may be moved up and down by being driven by the first motor 221 (refer to FIG. 31), thereby moving the support plate portions 351 and 352 up and down. The support portions 34 may thus be moved up and down.

FIG. 6 shows a state in which the support portions 34 are located at the highest position. In this state, the section of each of the support portions 341 and 342 that extends in the up-down direction is positioned close to and on the upstream side of the film cassette 21 (refer to FIG. 1) that contains the film roll 22. The section of each of the support portions 341 and 342 that extends in the conveyance direction is positioned below the film cassette 21. The movable rollers 30 are positioned below the film cassette 21.

FIG. 7 shows a state in which the support portions 341 and 342 are located at the lowest position. In this state, the section of each of the support portions 341 and 342 that extends in the conveyance direction is positioned below the conveyance path 103. The guide roller 31 is positioned above the guide rail 74 that passes through the cutting portion 77. The blade portion 771 that extends upward from the cutting portion 77 is positioned between the guide roller 31 and the first auxiliary roller 32. The cylindrical portion of the guide roller 31 is in contact with the conveyance path 103 from below. The second auxiliary roller 33 is positioned close to and above the base guide roller 71. The first auxiliary roller 32 and the second auxiliary roller 33 are positioned close to and on the upstream side of a position at which the conveyance path 103 intersects a movement path 104. The movement path 104 is a path of the guide roller 31 that is moved up and down by the movement of the support portions 34. When the guide roller 31 has moved to its lowest position along the movement path 104, the guide roller 31 is positioned below the conveyance path 103. In this case, the conveyance path 103 and the movement path 104 intersect. The position at which the conveyance path 103 intersects the movement path 104 is referred to as an "intersection position 105".

The orientation of the movement path 104 may be changed. For example, the support portions 34 may be moved in a direction that is inclined with respect to a line that is perpendicular to the conveyance path 103. In this case, the movement path 104 may extend at an angle that is inclined with respect to the line that is perpendicular to the conveyance path 103. The position of the guide roller 31 may be changed to a position other than the position below the film roll 22. For example, the guide roller 31 may be provided below and on the upstream side of the film roll 22, or may be provided below and on the downstream side of the film roll 22.

The material of the cylindrical portions of the first auxiliary roller 32 and the second auxiliary roller 33 may be rubber. The cylindrical portions of the first auxiliary roller 32 and the second auxiliary roller 33 may be fixed to the shaft portions. The support portions 34 may rotatably support the first auxiliary roller 32 and the second auxiliary roller 33. The shaft portions of the guide roller 31, the first auxiliary roller 32, and the second auxiliary roller 33 may be arranged such that the shaft portions occupy the same substantially horizontal plane.

The packaging device 1 also includes a rotation inhibiting portion 80. In a state in which the support portions 34 are located at the lowest position, the rotation inhibiting portion 80 is located on the downstream side of the guide roller 31 supported by the support portions 34 and on the upstream side of the first receiving tray 12. The rotation inhibiting portion 80 includes a stopper 81. The stopper 81 may be moved in the conveyance direction by being driven by a fourth motor 224 (refer to FIG. 31). When the stopper 81 has been moved to the upstream side in a state in which the support portions 34 are located at the lowest position, the stopper 81 may be located at a position where the stopper 81 is in contact with the guide roller 31 supported by the support portions 34. The stopper 81 can thus inhibit the guide roller 31 from rotating. The rotation inhibiting portion 80 will be described in more detail below.

The heating portion 40 will be explained in detail with reference to FIGS. 8 and 9. The heating portion 40 includes three heating units 41, a holding portion 42, and a base portion 43. The heating units 41 may come into contact with the film 24 and may heat the film 24. The holding portion 42 holds the three heating units 41. The base portion 43 supports the holding portion 42 from below. The base portion 43 may transmit the driving force of the third motor 223 to the holding portion 42, and may move the entire heating portion 40 in the up-down direction.

Figure 8:
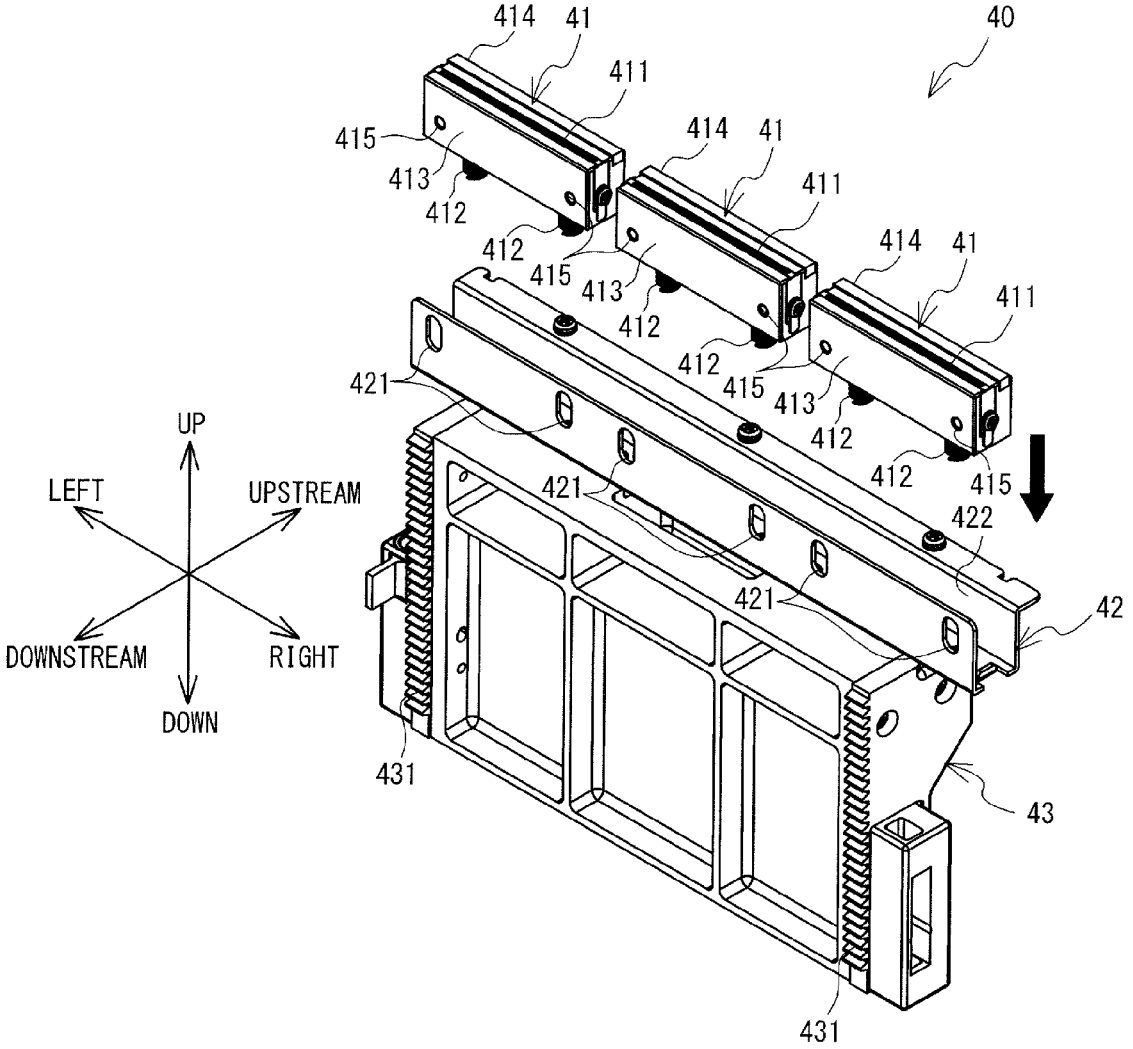
FIG. 8 is an exploded oblique view of the heating portion.

As shown in FIG. 8, the heating unit 41 includes a main body 413 whose three-dimensional shape is substantially rectangular. The heater 411 is provided on the top surface of the main body 413. The heater 411 is made from a metal plate. The heater 411 is a resistance heating type heater that is heated by supply of an electric current. The heater 411 extends in a straight line in the left-right direction through a section that is substantially in the middle of the top surface of the main body 413 in the conveyance direction. A support portion 414 is provided on the top surface of the main body 413, on the upstream side of the heater 411. The support portion 414 extends in a straight line in the left-right direction along the upstream edge of the top surface of the main body 413. The support portion 414 protrudes upward slightly higher than the top surface of the main body 413. Two springs 412 are provided on the bottom surface of the main body 413. The springs 412 are compression coil springs. The two springs 412 are respectively connected to the right end and the left end of the bottom surface of the main body 413. The two springs 412 are lined up in the left-right direction. Two holes 415 are provided in the downstream side surface of the main body 413.

The holding portion 42 is a plate-shaped member that is bent in a substantially U shape in a side view. A groove 422 that extends in the left-right direction is formed in the holding portion 42. The distance between a plate-shaped portion on the upstream side of the holding portion 42 and a plate-shaped portion on the downstream side of the holding portion 42 is slightly longer than the length in the conveyance direction of the main body 413 of the heating unit 41. The length in the up-down direction of each of the plate-shaped portions on the upstream side and the downstream side of the holding portion 42 is shorter than the length in the up-down direction of the main body 413 of the heating unit 41. Six slotted holes 421 that extend in the up-down direction are provided in the plate-shaped portion on the downstream side of the holding portion 42.

Figure 9:
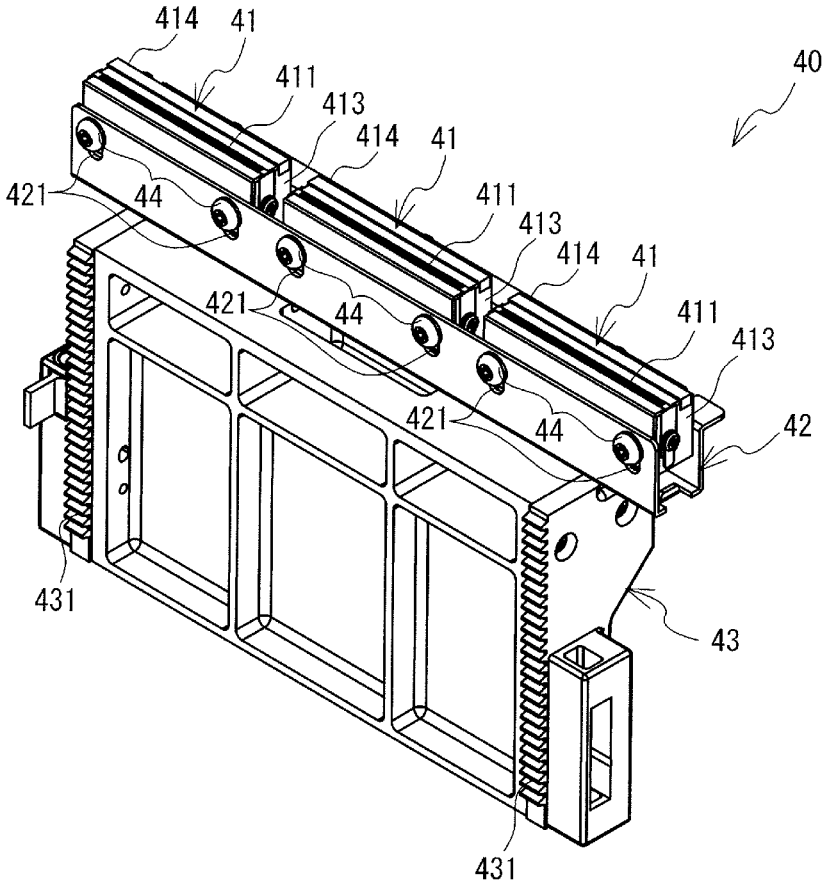
FIG. 9 is an oblique view of the heating portion.

As shown in FIG. 9, the three heating units 41 are arranged in the groove 422 of the holding portion 42. The three heating units 41 are arranged in a straight line in the left-right direction. Screws 44 are screwed into the holes 415 of the main body 413 of each of the heating units 41 from the downstream side through the slotted holes 421 of the holding portion 42. The heating units 41 may be moved up and down over the length, in the up-down direction, of the slotted holes 421. The springs 412 is in contact with the plate-shaped portion on the lower side of the holding portion 42, and urge the main body 413 upward. The top surface of the main body 413 of each of the three heating units 41 protrudes further upward than the upper edges of the plate-shaped portions on the upstream side and the downstream side of the holding portion 42. The top surface of the main body 413 of each of the three heating units 41 may be parallel to the conveyance path 103. The plurality of springs 412 that are provided on the main bodies 413 are arrayed in a straight line in the left-right direction. More specifically, the springs 412 are arrayed in a direction that is orthogonal to the conveyance direction and in a direction that is parallel to the conveyance path 103.

The base portion 43 is provided below the holding portion 42. The base portion 43 supports the holding portion 42 from below. A rack gear 431 is provided on the downstream edge of each of the left and right side surfaces of the base portion 43. Each of the rack gears 431 extends in the up-down direction such that teeth of the rack gears 431 face downstream. The third motor 223 (refer to FIG. 31) is provided above the bottom portion 10 (refer to FIG. 1), in the section between the side plate portions 111 and 112. Each of pinion gears (not shown in the drawings) engages with one of the rack gears 431 and transmits the rotational driving force of the third motor 223 to the rack gear 431. The base portion 43 may be moved in the up-down direction by the rotation of the third motor 223. The holding portion 42 that is provided above the base portion 43, as well as the three heating units 41 (that is, the heating portion 40) that are held by the holding portion 42, may thus also be moved in the up-down direction.

In a state in which the heating portion 40 is located at its highest position by the third motor 223, the top surface of the main body 413 of each of the three heating units 41 is close to the conveyance path 103. Specifically, in a state in which the heating portion 40 has been moved by the third motor 223 and is located at its highest position, the top surface of the main body 413 of each of the three heating units 41 is positioned slightly above the conveyance path 103. The top surface of the support portion 414 is positioned farther above the top surface of the main body 413. On the other hand, in a state in which the heating portion 40 has been moved by the third motor 223 and is located at its lowest position, the top surface of the main body 413 of each of the three heating units 41 is set apart from the conveyance path 103.

Figure 10:
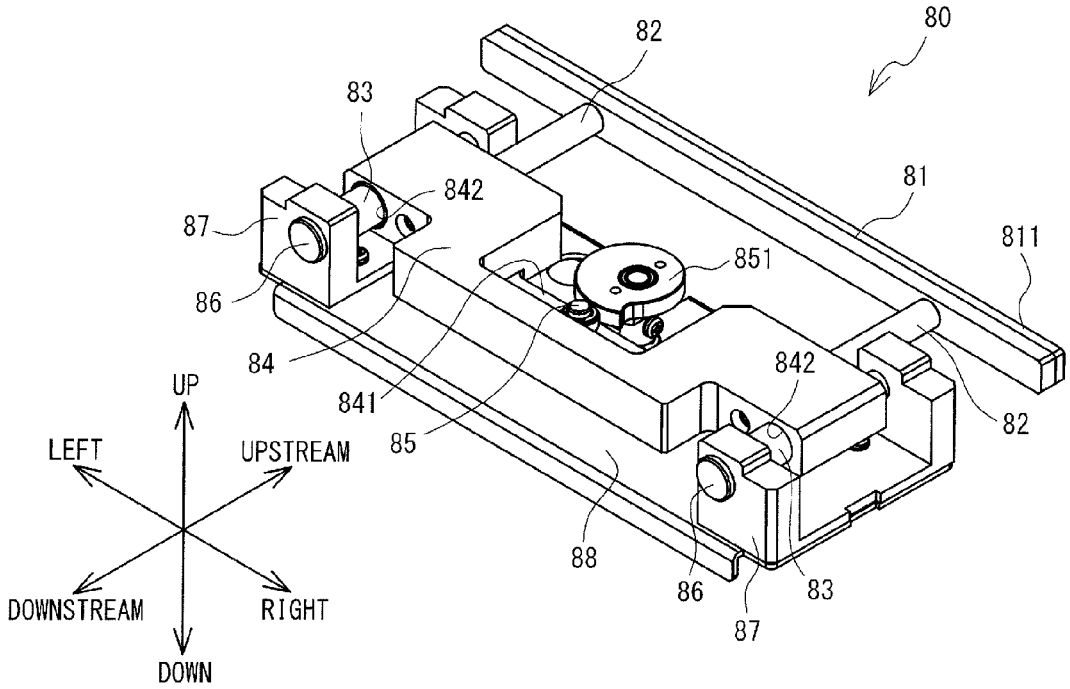
FIG. 10 is an oblique view of the rotation inhibiting portion.

The rotation inhibiting portion 80 will be explained in detail with reference to FIGS. 10 to 12. The rotation inhibiting portion 80 includes a base portion 88. The base portion 88 is a plate-shaped member that is rectangular in a plan view, and whose long sides extend in the left-right direction. The base portion 88 is provided above the bottom portion 10 (refer to FIG. 1) and is fixed in place in the section between the side plate portions 111 and 112 (refer to FIG. 1). A support portion 84 and two shaft support portions 87 are provided on the top surface of the base portion 88. The top surface of the support portion 84 and the top surfaces of the two shaft support portions 87 are covered by a top plate 89 (refer to FIGS. 1, 4, and 5).

The support portion 84 is box-shaped and extends in the left-right direction. The central section of the support portion 84 in the left-right direction is recessed toward the downstream side. A plate 841 that extends in parallel to the bottom surface of the support portion 84 is provided such that the plate 841 extends across the downstream side of the recessed section. A cylindrical protruding portion 85 protrudes upward from the central section of the plate 841 in the left-right direction. Holes 842 that extend through the plate 841 in the conveyance direction are respectively provided in the left end and the right end of the support portion 84. Two support rods 82 extend toward the upstream side from the inner side (in the left-right direction) of sections of the upstream side surfaces of the support portion 84 where the right side hole 842 and the left side hole 842 are respectively provided. The stopper 81 is provided on the upstream side ends of the two support rods 82. The stopper 81 has a rod shape whose cross-sectional shape is square. The stopper 81 extends in the left-right direction. The length of the stopper 81 in the left-right direction is substantially the same as the length of the support portion 84 in the left-right direction. A rubber strip 811 is provided on the upstream side surface of the stopper 81.

The two shaft support portions 87 are respectively provided on the left and right ends of the base portion 88. Plate-shaped portions that extend upward are respectively provided on the upstream side and the downstream side of each of the two shaft support portions 87. Each of the plate-shaped portions supports one of an upstream end and a downstream end of one of two shafts 86 that extend in the conveyance direction. Each of the two shafts 86 passes through one of the holes 842 that are provided in the support portion 84. The support portion 84 may be moved in the conveyance direction along the two left and right shafts 86. Springs 83 are respectively interposed between the support portion 84 and the plate-shaped portions provided on the downstream side of the shaft support portions 87. The springs 83 are compression coil springs. The springs 83 urge the support portion 84 to the upstream side.

A cam 851 is provided on the base portion 88. The fourth motor 224 (refer to FIG. 31) is provided below the base portion 88. The cam 851 is connected to a rotating shaft that extends upward from the fourth motor 224. The cam 851 is arranged on the upstream side of the plate 841, in the section of the support portion 84 that is recessed toward the downstream side. The outer circumferential surface of the cam 851 comes into contact with the protruding portion 85 that protrudes upward from the plate 841.

Figure 11:
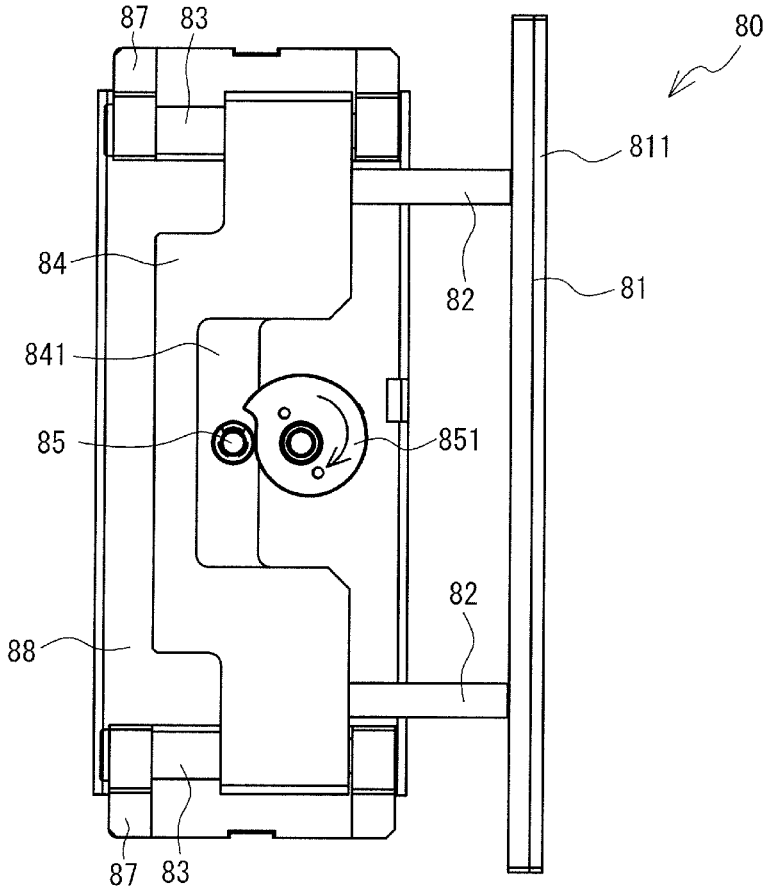
FIG. 11 is a plan view of the rotation inhibiting portion (in a state in which a stopper has moved to the upstream side)
Figure 12:
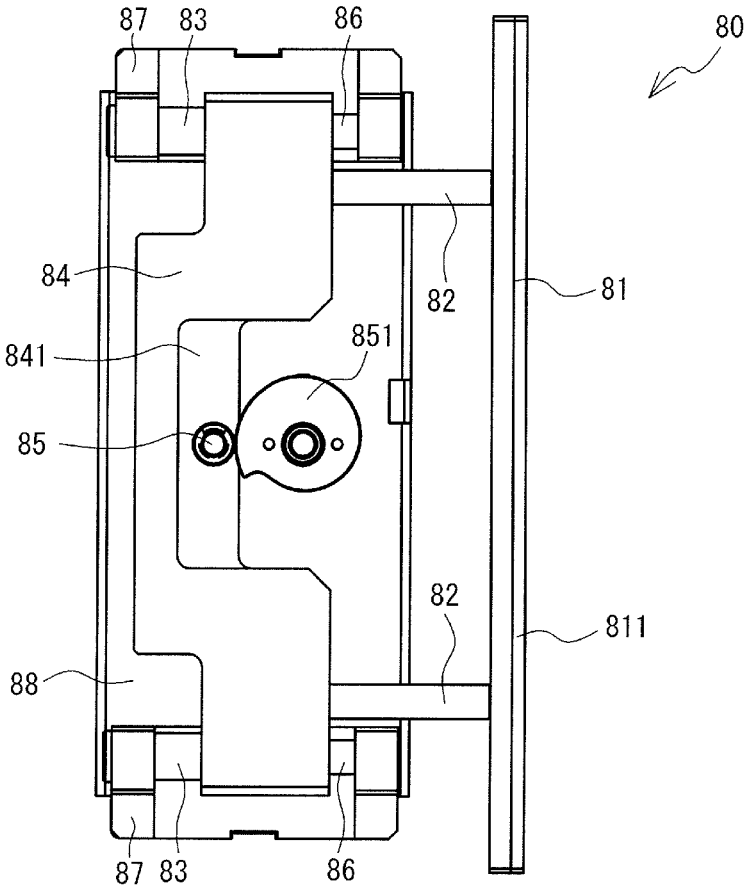
FIG. 12 is a plan view of the rotation inhibiting portion (in a state in which the stopper has moved to the downstream side)

When the cam 851 is rotated as a result of being driven by the fourth motor 224, the position of the support portion 84 switches between the upstream side (refer to FIG. 11) and the downstream side (refer to FIG. 12). Specifically, the switching is performed in the following manner.

As shown in FIG. 11, in a state in which a section of the outer circumferential surface of the cam 851 where the distance from the center to the circumference is short is in close proximity to the protruding portion 85, the support portion 84 is positioned on the upstream side by the urging force of the springs 83. The stopper 81 connected to the support portion 84 is positioned toward the upstream side. From this state, the fourth motor 224 may rotate in the clockwise direction in a plan view. As shown in FIG. 12, a section of the outer circumferential surface of the cam 851 where the distance from the center to the circumference is long may come into contact with the protruding portion 85. The support portion 84 may be moved toward the downstream side against the urging force of the springs 83. The stopper 81 connected to the support portion 84 may be moved toward the downstream side. The stopper 81 may be moved in such a way that the stopper 81 remains parallel to the left-right direction.

When the fourth motor 224 rotates farther in the clockwise direction, the section of outer circumferential surface of the cam 851 where the distance from the center to the circumference is short may come close to the protruding portion 85. The support portion 84 may be moved toward the upstream side by the urging force of the springs 83 (refer to FIG. 11).

Figure 13:
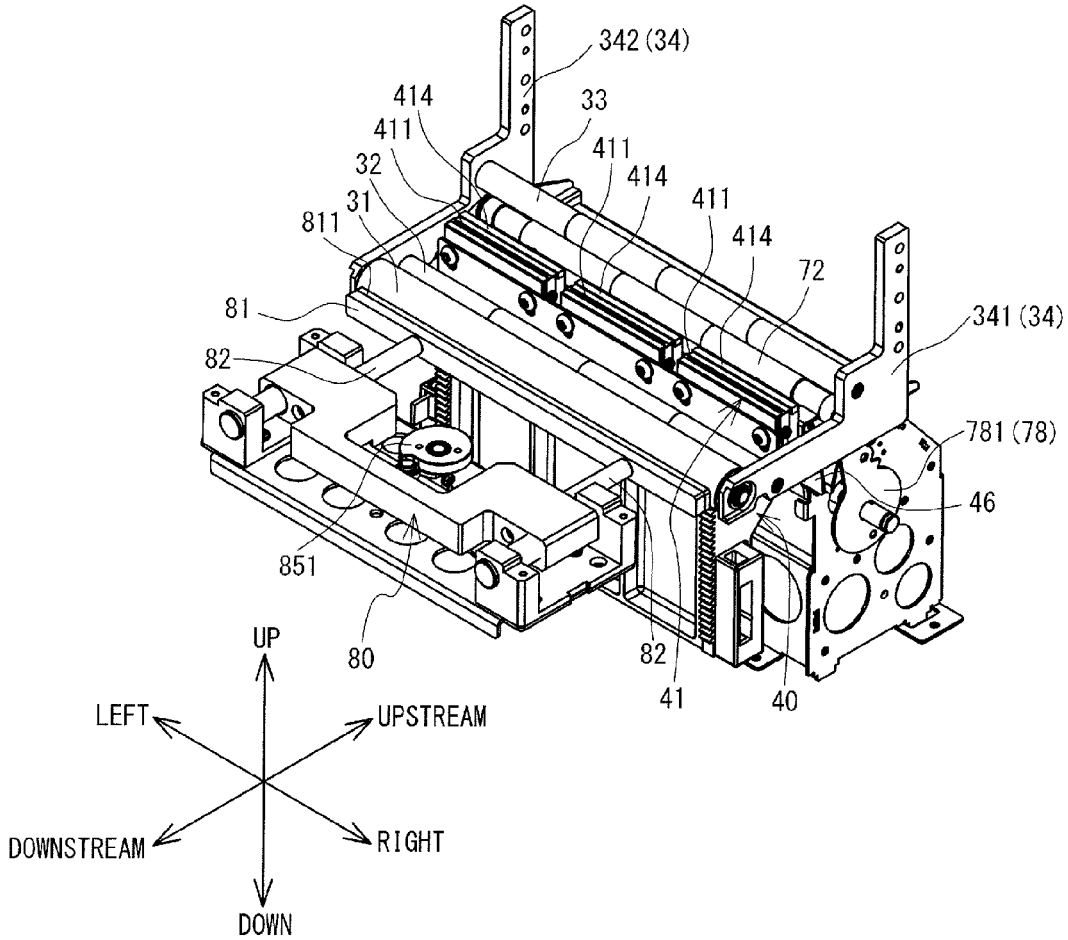
FIG. 13 is an enlarged oblique view of the heating portion, a lid portion, and the rotation inhibiting portion.

As shown in FIG. 13, in a state in which the support portions 34 are located at their lowest position and the stopper 81 is arranged on the upstream side (refer to FIG. 11), the rubber strip 811 of the stopper 81 is located in a position where the rubber strip 811 may be in contact with the cylindrical portion of the guide roller 31. The rubber strip 811 of the stopper 81 may be pressed strongly against the guide roller 31 by the urging of the support portion 84 toward the upstream side by the springs 83. The direction in which the stopper 81 extends is the same as the direction in which the shaft portion of the guide roller 31 extends. Therefore, the rubber strip 811 of the stopper 81 may be pressed evenly against the guide roller 31. The rubber strip 811 has a large coefficient of friction. Therefore, the rotation of the guide roller 31 may be inhibited by the frictional force between the rubber 81 and the guide roller 31. The rotation of the guide roller 31 may be inhibited also by the pressing of the shaft portion of the guide roller 31 against the support portions 34.

On the other hand, in a state in which the stopper 81 is positioned toward the downstream side (refer to FIG. 12), the rubber strip 811 of the stopper 81 separates from the cylindrical portion of the guide roller 31. In this state, the guide roller 31 may be rotated freely.

Figure 14:
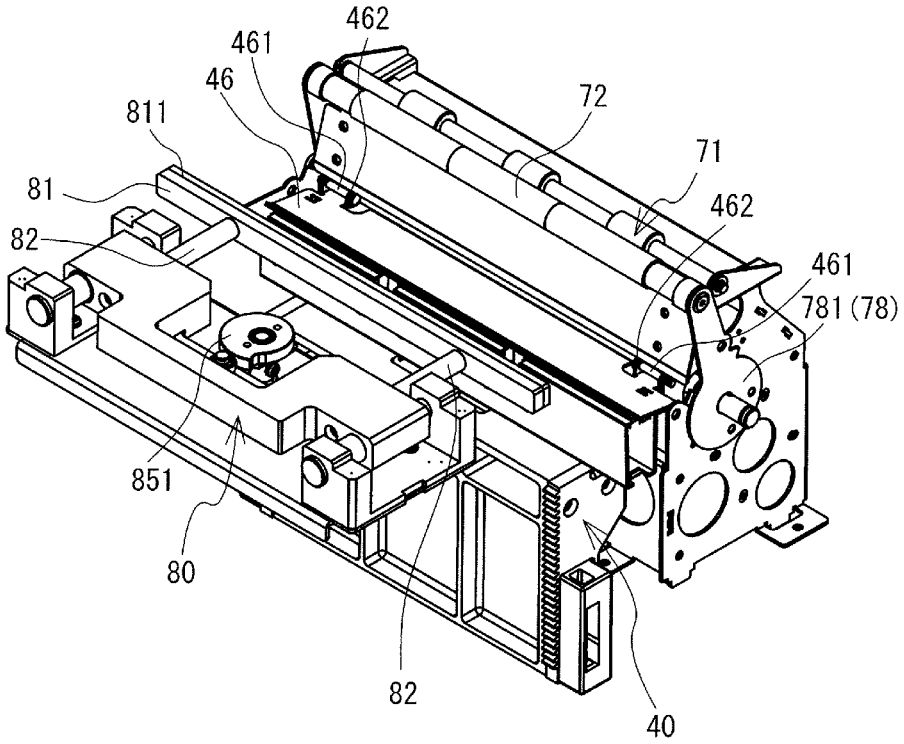
FIG. 14 is another enlarged oblique view of the heating portion, the lid portion, and the rotation inhibiting portion.

The lid portion 46 that covers the top surface of the heating portion 40 will be explained. FIG. 14 shows the arrangement of the heating portion 40, the lid portion 46, and the rotation inhibiting portion 80. In FIG. 14, the heating portion 40 is located at its lowest position and the stopper 81 of the rotation inhibiting portion 80 is positioned toward the downstream side. The holding portions 78 may pivot and the holding roller 72 may come close to the base guide roller 71. The lid portion 46 covers the top surfaces of the three heating units 41 (refer to FIG. 9) when the heating portion 40 is located at its lowest position. The lid portion 46 is a plate-shaped member having a substantially rectangular shape whose long sides extend in the left-right direction. In a state in which the lid portion 46 covers the top surfaces of the heating units 41, a flat surface of the lid portion 46 becomes substantially horizontal.

A pivot shaft 461 is provided on each of the left and right ends of the lid portion 46, on the upstream side of the lid portion 46 when the lid portion 46 is in a substantially horizontal state. The pivot shafts 461 axially support the lid portion 46 such that the lid portion 46 may pivot with respect to a plate-shaped member that extends in the up-down direction on the upstream side of the heating portion 40. The pivot shafts 461 extend in the left-right direction. The pivot shafts 461 support the lid portion 46 such that the opposite side of the lid portion 46 from the side that is axially supported by the pivot shafts 461 may be moved up and down. Hereinafter, the edge of the lid portion 46 on the opposite side of the lid portion 46 from the side that is axially supported by the pivot shafts 461, namely, the downstream side edge of the lid portion 46 when the lid portion 46 is in the substantially horizontal state, is referred to as the "opposite side edge".

A spring 462 is provided on each of the pivot shafts 461. The springs 462 downwardly urge the opposite side edge of the lid portion 46. The lid portion 46 is pressed against the top surfaces of the three heating units 41 when the heating portion 40 is located at its lowest position. The position of the pivot shafts 461 of the lid portion 46 is substantially the same in the up-down direction as the position of the top surfaces of the three heating units 41 of the heating portion 40 that is located at its lowest position. Therefore, in the state in which the top surfaces of the heating units 41 are covered by the lid portion 46, the flat surface of the lid portion 46 becomes substantially horizontal. When the lid portion 46 is in the substantially horizontal state, the opposite side edge of the lid portion 46 is slightly bent obliquely upward.

As shown in FIGS. 8 and 9, the support portion 414 is provided on the top surface of the main body 413 of each of the three heating units 41, and slightly protrudes upward with respect to the heater 411. Therefore, when the heating portion 40 is located at its lowest position and the lid portion 46 is pressed against the top surface of each of the three heating units 41, the lid portion 46 is in contact with the support portions 414. The lid portion 46 is not directly in contact with the heaters 411.

Figure 15:
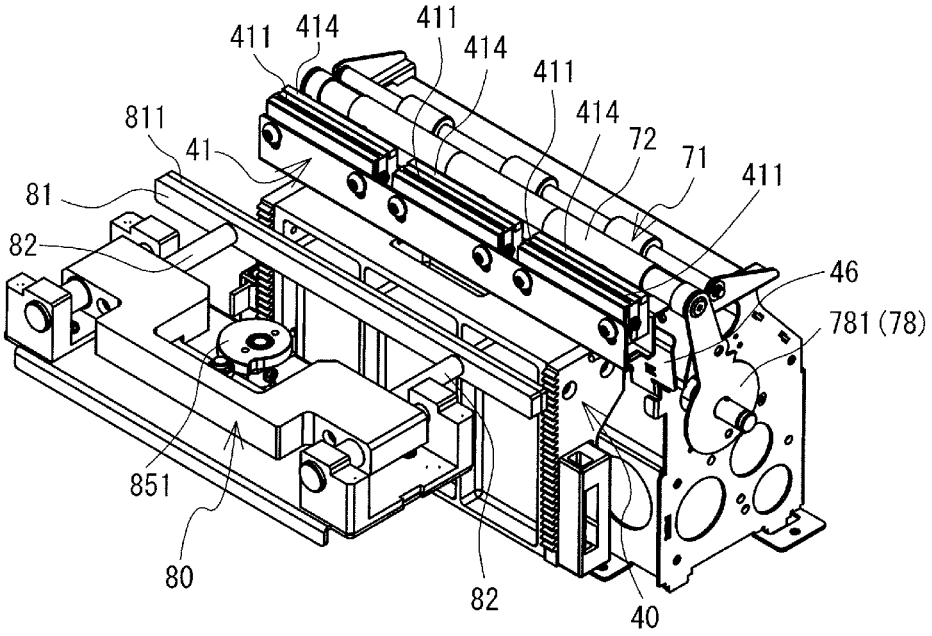
FIG. 15 is yet another enlarged oblique view of the heating portion, the lid portion, and the rotation inhibiting portion.
Figure 16:
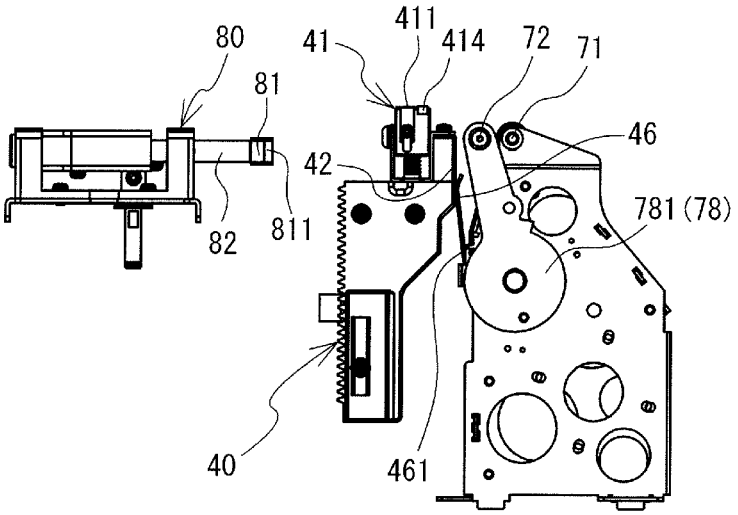
FIG. 16 is a right side view of the heating portion, the lid portion, and the rotation inhibiting portion.

FIGS. 15 and 16 show an arrangement of the heating portion 40 and the rotation inhibiting portion 80 when the heating portion 40 is moved upward and is located at its highest position. As shown in FIG. 14, in the state in which the heating portion 40 is located at its lowest position, the lid portion 46 is substantially horizontal. As shown in FIG. 16, in the process in which the heating portion 40 is moved upward and reaches its highest position, the lid portion 46 (refer to FIG. 14) is pressed upward from below by the support portions 414 of the top surfaces of the heating units 41. The lid portion 46 pivots around the pivot shafts 461 in resistance to the urging force of the springs 462. The opposite side edge of the lid portion 46 is moved upward. The opposite side edge of the lid portion 46 comes into contact, from the side, with the plate-shaped member provided on the upstream side of the holding portion 42 of the heating portion 40. The lid portion 46 becomes substantially vertical. The lid portion 46 separates from the top surfaces of the heating units 41 and does not cover the heaters 411.

In the process in which the heating portion 40 is moved downward from its highest position and is located at its lowest position, the lid portion 46 returns to the substantially horizontal state due to the urging force of the springs 462. In this state, the lid portion 46 covers the top surfaces of the heating units 41. The opposite side edge of the lid portion 46 is bent. Therefore, in the process in which the heating portion 40 is moved downward and is located at its lowest position, there is no interference between the opposite side edge of the lid portion 46 and the surface of the plate-shaped member provided on the upstream side of the holding portion 42, and does not hinder the downward movement of the heating portion 40.

The conveyance mechanism 50 will be explained in detail with reference to FIGS. 17 to 21. The conveyance mechanism 50 includes the belts 51, the conveyance portions 60, and a drive portion 55. The drive portion 55 may drive the belts 51. The conveyance portions 60 are respectively connected to the belts 51. The conveyance portions 60 may convey the base 2 in accordance with the rotation of the belts 51.

Figure 17:
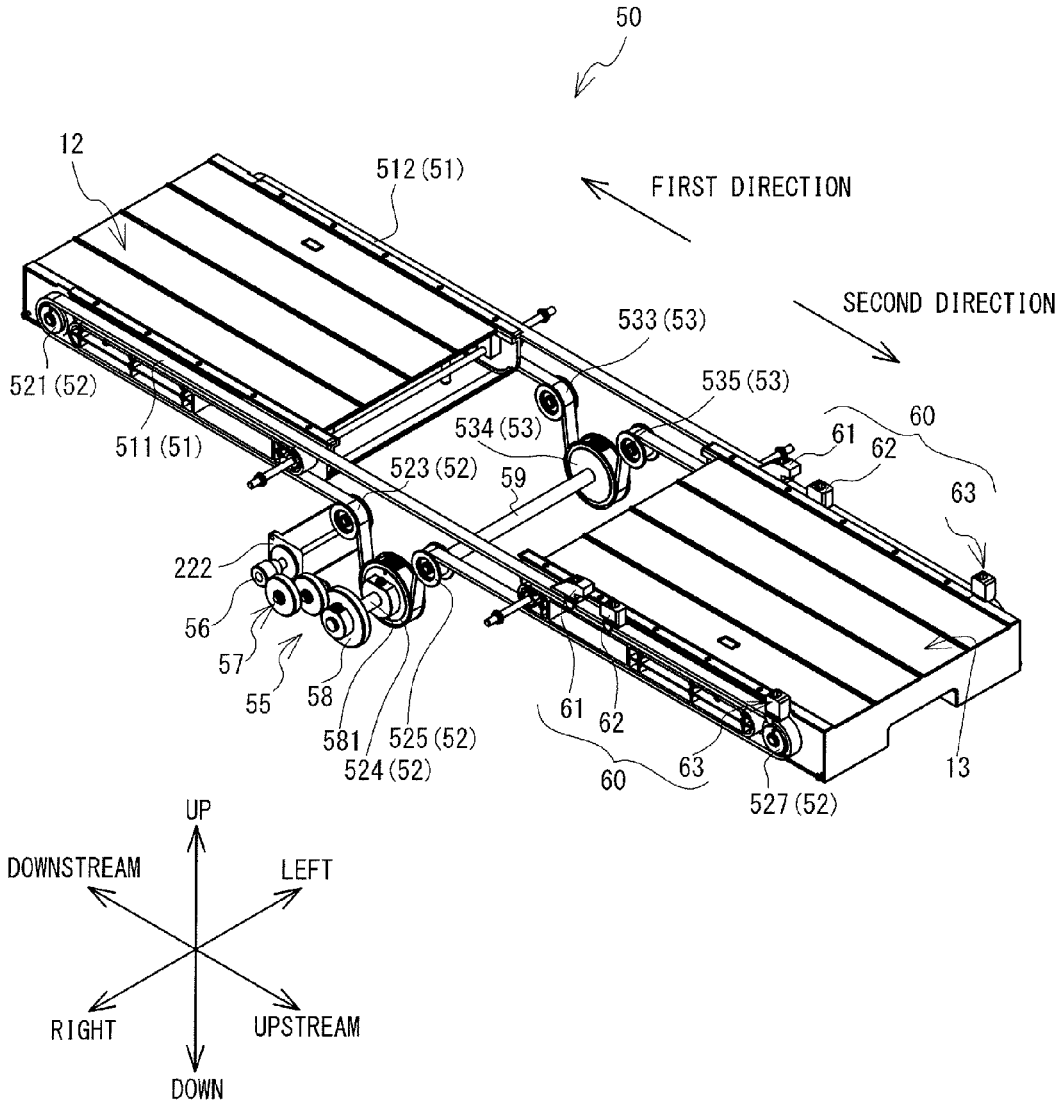
FIG. 17 is an oblique view of a conveyance mechanism.
Figure 18:
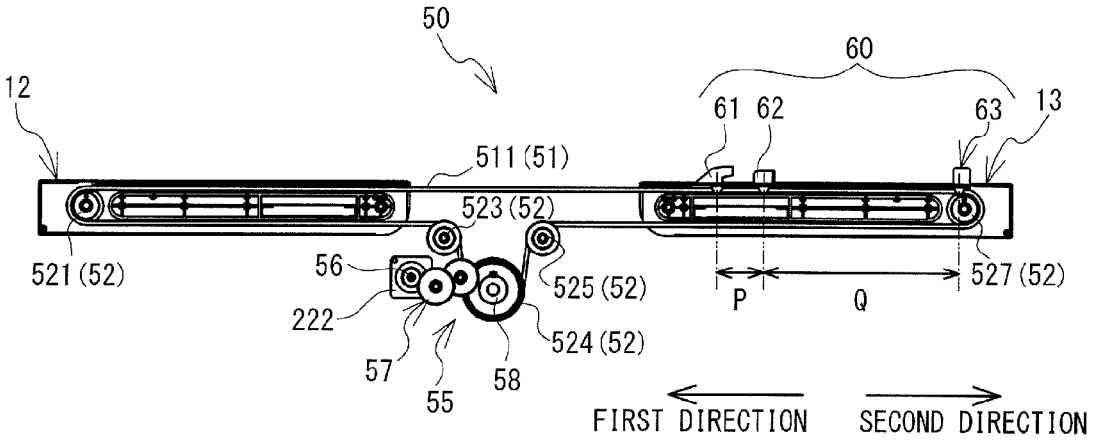
FIG. 18 is a right side view of the conveyance mechanism.

As shown in FIGS. 17 and 18, the belts 51 are endless and have teeth on their inner side surfaces. The belts 51 include the belt 511, which is arranged on the right side surfaces of the first receiving tray 12 and the second receiving tray 13, and the belt 512, which is arranged on the left side surfaces of the first receiving tray 12 and the second receiving tray 13. The belt 511 is routed around pulleys 52 (the pulleys 521, 523 to 525, and 527). The belt 512 is routed around pulleys 53 (the pulleys 533 to 535) and the pulleys not shown in the drawings. In FIG. 17, the covers 122 and 132 (refer to FIG. 1) that cover the belts 51 are omitted. Sections, on the receiving surface side, of the covers 122 and 132 are open. The belts 51 are exposed to the receiving surface side from the openings. Sections of the belts 51 that are exposed to the openings of the covers 122 and 132 are hereinafter referred to as "exposed sections of the belts 51".

The pulley 521 is provided on the downstream side of the right side surface of the first receiving tray 12. The pulley 527 is provided on the upstream side of the right side surface of the second receiving tray 13. The pulleys 523, 524, and 525 are respectively provided on the downstream side, substantially in the center in the conveyance direction and on the upstream side of the left side surface of the side plate portion 111 (refer to FIG. 1). The pulley 524 has teeth on its outer side surface, and the teeth of the pulley 524 are engaged with the teeth on the inner side of the belt 511.

In the state in which the receiving surfaces of the first receiving tray 12 and the second receiving tray 13 are substantially horizontal, positions, in the up-down direction, of shaft centers of the pulleys 521 and 527 are the same. The pulleys 521 and 527 are arranged in parallel with the conveyance path 103. Shaft centers of the pulleys 523 and 525 are located lower than the shaft centers of the pulleys 521 and 527. A shaft center of the pulley 524 is located below the shaft centers of the pulleys 523 and 525. The pulleys 521, 524, and 527 are each in contact with the inner side surface of the belt 511, and the pulleys 523 and 525 are each in contact with the outer side surface of the belt 511.

The pulleys that are not shown in the drawings are respectively provided on the downstream side of the left side surface of the first receiving tray 12 and on the upstream side of the left side surface of the second receiving tray 13. The pulleys 533, 534, and 535 are respectively provided on the downstream side, substantially in the center in the conveyance direction, and on the upstream side of the right side surface of the side plate portion 112 (refer to FIG. 1). The pulley 534 has teeth on its outer side surface, and the teeth of the pulley 534 are engaged with teeth on the inner side of the belt 512.

In the state in which the receiving surfaces of the first receiving tray 12 and the second receiving tray 13 are substantially horizontal, shaft centers of the pulleys 533 and 535 are located lower than shaft centers of the pulleys (not shown in the drawings) provided on the left side surfaces of the first receiving tray 12 and the second receiving tray 13. A shaft center of the pulley 534 is located lower than the shaft centers of the pulleys 533 and 535. The pulleys provided on the left side surfaces of the first receiving tray 12 and the second receiving tray 13 and the pulley 534 are each in contact with the inner side surface of the belt 512, and the pulleys 533 and 535 are each in contact with the outer side surface of the belt 512.

The drive portion 55 is provided with the second motor 222, spur gears 56 and 58 and a transmission portion 57. The shaft center of each of the pulleys 52 and 53 and the pulleys not shown in the drawings extends in the left right direction. The shaft centers of the pulleys 52 and 53 and the pulleys not shown in the drawings are parallel to each other, and are orthogonal to the conveyance direction. The pulleys 524 and 534 are connected by a shaft 59 that extends in the left-right direction. A shaft 581 extends to the right from the right side surface of the pulley 524. The spur gear 58 is provided on the leading end of the shaft 581. The second motor 222 is provided below an upstream side section of the first receiving tray 12. The rotating shaft of the second motor 222 extends to the right. The spur gear 56 is provided on the leading end of the rotating shaft of the second motor 222. The transmission portion 57 that is formed by a plurality of spur gears is provided between the spur gears 56 and 58. The transmission portion 57 transmits the rotational driving force of the spur gear 56 to the spur gear 58.

The drive portion 55 may cause the pulley 524 to rotate by transmitting the rotational driving force of the second motor 222 to the pulley 524 via the spur gears 56 and 58 and the transmission portion 57. The pulleys 524 and 534 are connected by the shaft 59. Therefore, when the pulley 524 is rotated, the pulley 534 is also rotated. The pulleys 524 and 534 respectively rotate the belts 511 and 512. The belts 51 may convey the base 2 from the upstream side to the downstream side by rotating in the counterclockwise direction in a right side view. Hereinafter, the direction in which the exposed sections of the belts 51 are moved from the upstream side to the downstream side, when the base 2 is being conveyed from the upstream side to the downstream side, is referred to as a "first direction". Hereinafter, the opposite direction to the first direction (namely, the direction in which the exposed sections of the belts 51 are moved from the downstream side to the upstream side) is referred to as a "second direction".

The conveyance portion 60 is provided on the outer side surface of each of the belts 511 and 512. The conveyance portions 60 may convey the base 2 from the upstream side to the downstream side by being moved from the side of the second receiving tray 13 to the side of the first receiving tray 12 in accordance with the rotation of the belts 51. Each of the conveyance portions 60 includes a first conveyance portion 61, a second conveyance portion 62, and a third conveyance portion 63. In the following explanation, a state will be described in which the first conveyance portion 61, the second conveyance portion 62, and the third conveyance portion 63 are provided on each of the exposed sections of the belts 51.

Figure 19:
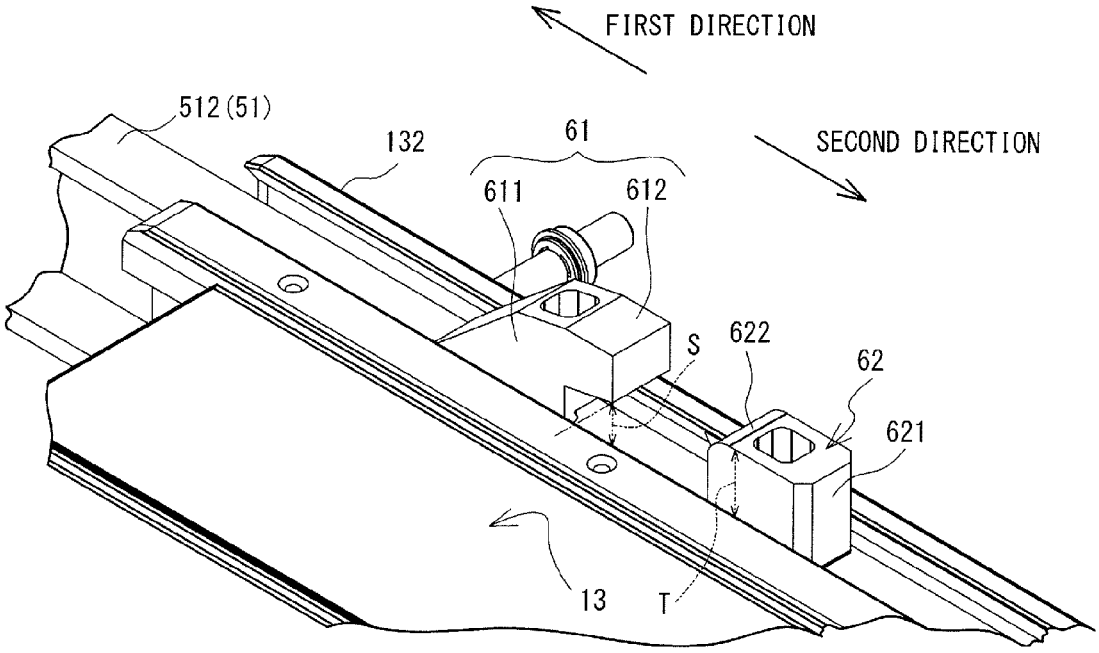
FIG. 19 is an enlarged oblique view of a first conveyance portion and a second conveyance portion.
Figure 21:
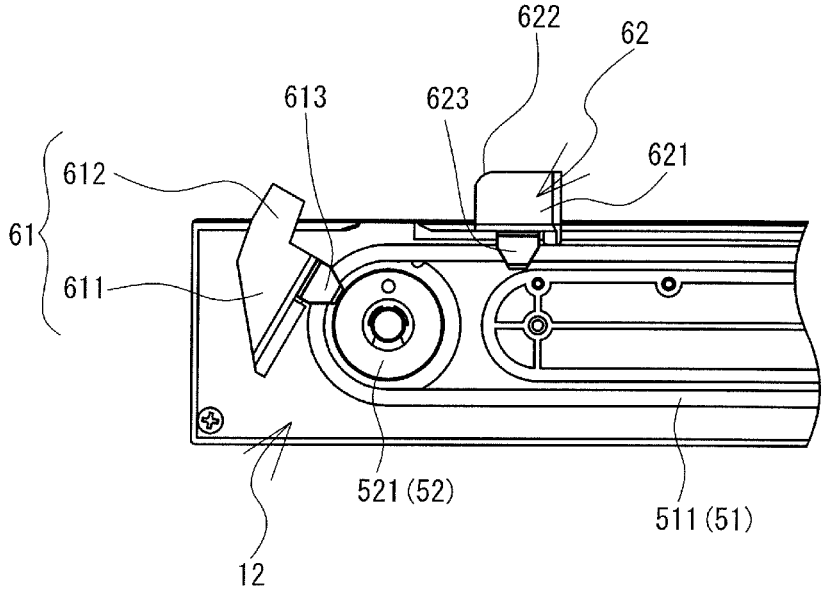
FIG. 21 is an enlarged right side view of the downstream side of the conveyance mechanism.

As shown in FIG. 19, the first conveyance portion 61 includes a first protruding portion 611, an extending portion 612, and a claw portion 613 (refer to FIG. 21). The first protruding portion 611 protrudes perpendicularly and outwardly with respect to the outer side surface of the belt 51. The side surface of the first protruding portion 611 on the first direction side is inclined obliquely downward in the first direction. The extending portion 612 extends in the second direction from the side surface of the first protruding portion 611 on the second direction side, more specifically, from the end on the opposite side to the side on which the first protruding portion 611 is connected to the belt 51. The extending portion 612 extends in parallel with the belt 51. A bottomed hole is provided in the end (of the first protruding portion 611) on the opposite side to the side on which the first protruding portion 611 is connected to the belt 51. A through hole is provided in the bottom surface of the hole. The claw portion 613 (which will be described below) is fixed by a screw that passes through the through hole.

A space is formed between the belt 51 and the extending portion 612. Of the side surface of the first conveyance portion 61 on the second direction side, a section that is close to the belt 51 has a recessed shape that is recessed in the first direction. The length of each of the first protruding portion 611 and the extending portion 612 in the left-right direction is substantially the same as the length of the belt 51 in the left-right direction. A length S between the end of the extending portion 612 on the belt 51 side and the flat surface (the conveyance path 103) that is parallel to the receiving surface is slightly larger than the thickness of a plate-shaped portion 90 (refer to FIG. 23, to be described below) of the base 2.

As shown in FIG. 21, the claw portion 613 is provided on a section of the first protruding portion 611 that is on the side on which the first protruding portion 611 is in contact with the belt 51. The claw portion 613 includes a first claw portion and a second claw portion. The first claw portion extends toward the belt 51 from each of the left and right sides, on the second direction side, of a surface of the first protruding portion 611 that is in contact with the belt 51. Hereinafter, the surface (of the first protruding portion 611) that is in contact with the belt 51 is referred to as the "bottom surface of the first protruding portion 611". The first claw portion is arranged on each of the outer sides, in the width direction, of the belt 51. The second claw portion extends from the leading end of the first claw portion toward the inner side, in the width direction, of the belt 51. The second claw portion engages with the teeth of the belt 51. The claw portion 613 fixes the first conveyance portion 61 to the belt 51 by clamping the belt 51 between the bottom surface of the first protruding portion 611 and the second claw portion.

The first protruding portion 611 is fixed to the belt 51 in a state in which the bottom surface of the first protruding portion 611 extends in the same direction as a tangential direction of the belt 51. Therefore, when the section of the belt 51, to which the first conveyance portion 61 is fixed by the claw portion 613, is wound on the pulley 521 and bent, the first direction side of the bottom surface of the first protruding portion 611 separates from the belt 51.

As shown in FIG. 19, the second conveyance portion 62 includes a second protruding portion 621 and a claw portion 623 (refer to FIG. 21). The second protruding portion 621 protrudes perpendicularly and outwardly with respect to the outer side surface of the belt 51. The second protruding portion 621 is provided on a section that is separated from the first protruding portion 611 of the first conveyance portion 61 by a predetermined first distance P (refer to FIG. 18) in the second direction. The first distance P is substantially the same as a distance between a side 901 of the base 2 and a bottom surface portion 92 (refer to FIG. 22, to be described below) that is close to the side 901. A length T between the end (of the second protruding portion 621) that is on the opposite side to the side on which the second protruding portion 621 is connected to the belt 51 and a flat surface (the conveyance path 103) that is parallel to the receiving surface is slightly larger than the length S.

A corner portion 622 (of the second protruding portion 621), where an end face on the opposite side to the side on which the second protruding portion 621 is connected to the belt 51 intersects with a side surface on the first direction side, curves in an arc shape. A bottomed hole is provided in the end (of the second protruding portion 621) on the opposite side to the side on which the second protruding portion 621 is connected to the belt 51. A through hole is provided in the bottom surface of the hole. The claw portion 623 (which will be described below) is fixed by a screw that passes through the through hole.

As shown in FIG. 21, the claw portion 623 is provided on a section of the second protruding portion 621 that is in contact with the belt 51. The claw portion 623 includes a first claw portion and a second claw portion. The first claw portion extends toward the belt 51 from each of the left and right sides of the bottom surface of the second protruding portion 621. Shapes of the first claw portion and the second claw portion of the claw portion 623 are the same as those of the first claw portion and the second claw portion of the claw portion 613 of the first conveyance portion 61, and an explanation thereof is thus omitted. The claw portion 623 fixes the second conveyance portion 62 to the belt 51 by clamping the belt 51 between the bottom surface of the second protruding portion 621 and the second claw portion.

Figure 20:
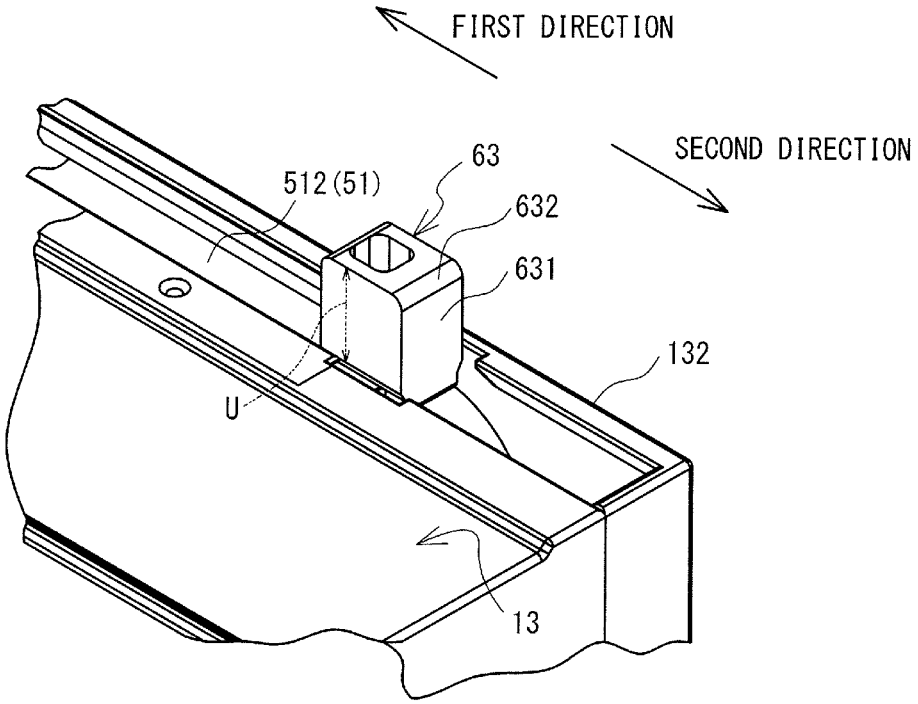
FIG. 20 is an enlarged oblique view of a third conveyance portion.

As shown in FIG. 20, the third conveyance portion 63 includes a third protruding portion 631 and a claw portion (not shown in the drawings). The third protruding portion 631 protrudes perpendicularly and outwardly with respect to the outer side surface of the belt 51. The third protruding portion 631 is provided on a section that is separated from the second protruding portion 621 of the second conveyance portion 62 by a second distance Q (refer to FIG. 18) in the second direction. The second distance Q is substantially the same as the distance between the side 902 of the base 2 and the bottom surface portion 92 that is close to the side 901 of the base 2. A length U between the end (of the third protruding portion 631) that is on the opposite side to the side on which the third protruding portion 631 is connected to the belt 51 and the flat surface (the conveyance path 103) that is parallel to the receiving surface is larger than the length T (refer to FIG. 19).

A corner portion 632 (of the third protruding portion 631), where an end face on the opposite side to the side on which the third protruding portion 631 is connected to the belt 51 intersects with a side surface on the second direction side, curves in an arc shape. A bottomed hole is provided on the end (of the third protruding portion 631) on the opposite side to the side on which the third protruding portion 631 is connected to the belt 51. A through hole is provided in the bottom surface of the hole. The claw portion (not shown in the drawings) is fixed by a screw that passes through the through hole.

The claw portion (not shown in the drawings) is provided on the bottom surface of the third protruding portion 631. The claw portion includes a first claw portion and a second claw portion. The position in which the first claw portion is provided and shapes of the first claw portion and the second claw portion are the same as those of the first claw portion and the second claw portion of the claw portion 623 of the second conveyance portion 62, and an explanation thereof is thus omitted. The claw portion fixes the third conveyance portion 63 to the belt 51.

A distance between the first protruding portion 611 of the first conveyance portion 61 and the third protruding portion 631 of the third conveyance portion 63, namely, a distance obtained by adding the first distance P and the second distance Q, is slightly shorter than the length of the second receiving tray 13 in the conveyance direction. The distance obtained by adding the first distance P and the second distance Q is substantially the same as the length of the base 2 in the shorter side direction, namely, the distance between the side 901 and a side 902 of a first plate-shaped portion 905.

The base 2, on which is placed the object 3 that is packaged by the packaging device 1, will be explained with reference to FIGS. 22 to 27. The base 2 is formed by folding the plate-shaped portion 90, which is a substantially rectangular-shaped plate, at folding portions 911 and 912. The base 2 is, for example, a corrugated cardboard base.

Figure 22:
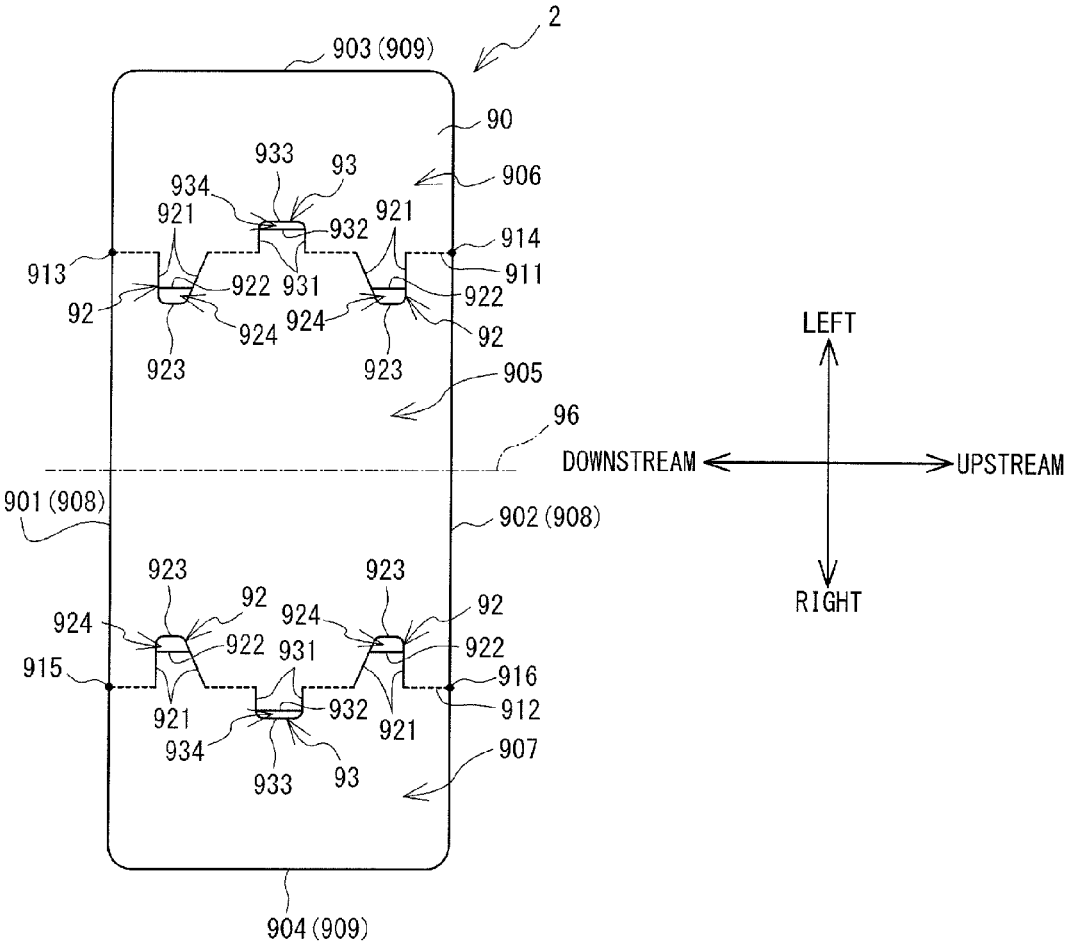
FIG. 22 is a plan view of a base (in an unbent state) as viewed from above.

As shown in FIG. 22, the plate-shaped portion 90 includes the opposing two sides 901 and 902 and opposing two sides 903 and 904. The sides 901 and 902 are sides that extend in the longitudinal direction and the sides 903 and 904 are sides that extend in the shorter side direction. Hereinafter, a set of the sides 901 and 902 is also referred to as a "first set 908". Hereinafter, a set of the sides 903 and 904 is also referred to as a "second set 909". The folding portions 911 and 912 extend linearly between the opposing sides 901 and 902. Among three quadrant lines that divide the plate-shaped portion 90 into almost equal quarters in the longitudinal direction, the folding portion 911 is arranged on a quadrant line that is close to the side 903. The folding portion 911 intersects with each of the sides 901 and 902 at intersection points 913 and 914. The folding portion 912 is arranged on a quadrant line that is close to the side 904, among the three quadrant lines. The folding portion 912 intersects with each of the sides 901 and 902 at intersection points 915 and 916. The folding portions 911 and 912 extend in parallel with each other. The length between the folding portions 911 and 912 is slightly longer than the length of the first receiving tray 12 and the second receiving tray 13 in the left-right direction.

Hereinafter, the shorter side direction of the plate-shaped portion 90 is referred to as the conveyance direction, and the longitudinal direction of the plate-shaped portion 90 is referred to as the left-right direction. The side of the plate-shaped portion 90 on the side 901 is referred to as the downstream side, and the side on the side 902 is referred to as the upstream side, the side on the side 903 is referred to as the left side, and the side on the side 904 is referred to as the right side. A section of the plate-shaped portion 90 between the folding portions 911 and 912 is referred to as the first plate-shaped portion 905. Of the plate-shaped portion 90, a section between the folding portion 911 and the side 903 and a section between the folding portion 912 and the side 904 are respectively referred to as second plate-shaped portions 906 and 907.

The plate-shaped portion 90 is recessed at sections of the folding portions 911 and 912. If the user applies a force inward in the left-right direction while holding each of the sides 903 and 904 of the plate-shaped portion 90, the user can easily fold the plate-shaped portion 90 along the folding portions 911 and 912.

At respective positions at which each of the folding portions 911 and 912 is divided into almost equal quarters in the conveyance direction, the bottom surface portion 92, a side surface portion 93, and the bottom surface portion 92 are provided in this order from the downstream side toward the upstream side. The two bottom surface portions 92 provided at the folding portion 911 are respectively close to the intersection points 913 and 914. The two bottom surface portions 92 provided at the folding portion 912 are respectively close to the intersection points 915 and 916. The side surface portion 93 that is provided at each of the folding portions 911 and 912 is arranged substantially in the center in the conveyance direction of each of the folding portions 911 and 912.

Each of the plurality of bottom surface portions 92 is provided with a plurality of cuts (a pair of first bottom surface cuts 921, a second bottom surface cut 922, and a third bottom surface cut 923), and a hole 924. Each of the pair of first bottom surface cuts 921 extends inward in the left-right direction from each of the folding portions 911 and 912. The distance between each of the pair of first bottom surface cuts 921 gradually decreases inward in the left-right direction. Of the pair of first bottom surface cuts 921, the cut provided on the outside in the conveyance direction, namely, the cut on the side close to the intersection points 913 to 916, extends in a direction orthogonal to each of the folding portions 911 and 912.

Each of the second bottom surface cut 922 and the third bottom surface cut 923 extends in the conveyance direction between the pair of first bottom surface cuts 921. The third bottom surface cut 923 is a cut extending between ends, on the inner side in the left-right direction, of the pair of first bottom surface cuts 921. The second bottom surface cut 922 is a cut extending further on the outer side, in the left-right direction, with respect to the third bottom surface cut 923. The hole 924 is provided in a section that is surrounded by the pair of first bottom surface cuts 921, the second bottom surface cut 922, and the third bottom surface cut 923.

Each of the plurality of side surface portions 93 is provided with a plurality of cuts (a pair of first side surface cuts 931, a second side surface cut 932, and a third side surface cut 933), and a hole 934. Each of the pair of first side surface cuts 931 extends outward in the left-right direction from each of the folding portions 911 and 912. The pair of first side surface cuts 931 extend substantially in parallel with each other. Each of the pair of first side surface cuts 931 extends in the direction orthogonal to each of the folding portions 911 and 912.

Each of the second side surface cut 932 and the third side surface cut 933 extends in the conveyance direction between the pair of first side surface cuts 931. The third side surface cut 933 is a cut extending between ends, on the outer side in the left-right direction, of the pair of first side surface cuts 931. The second side surface cut 932 is a cut extending further on the inner side, in the left-right direction, with respect to the third side surface cut 933. The hole 934 is provided in a section that is surrounded by the pair of first side surface cuts 931, the second side surface cut 932, and the third side surface cut 933.

The bottom surface portions 92 and the side surface portion 93 that are provided at the folding portion 911, and the bottom surface portions 92 and the side surface portion 93 that are provided at the folding portion 912 are line-symmetrical with respect to a line 96. The line 96 is a line which is virtually set in a position where the distance from the folding portion 911 is the same as the distance from the folding portion 912, and which extends in the conveyance direction in the center in the left-right direction of the plate-shaped portion 90.

Figure 23:
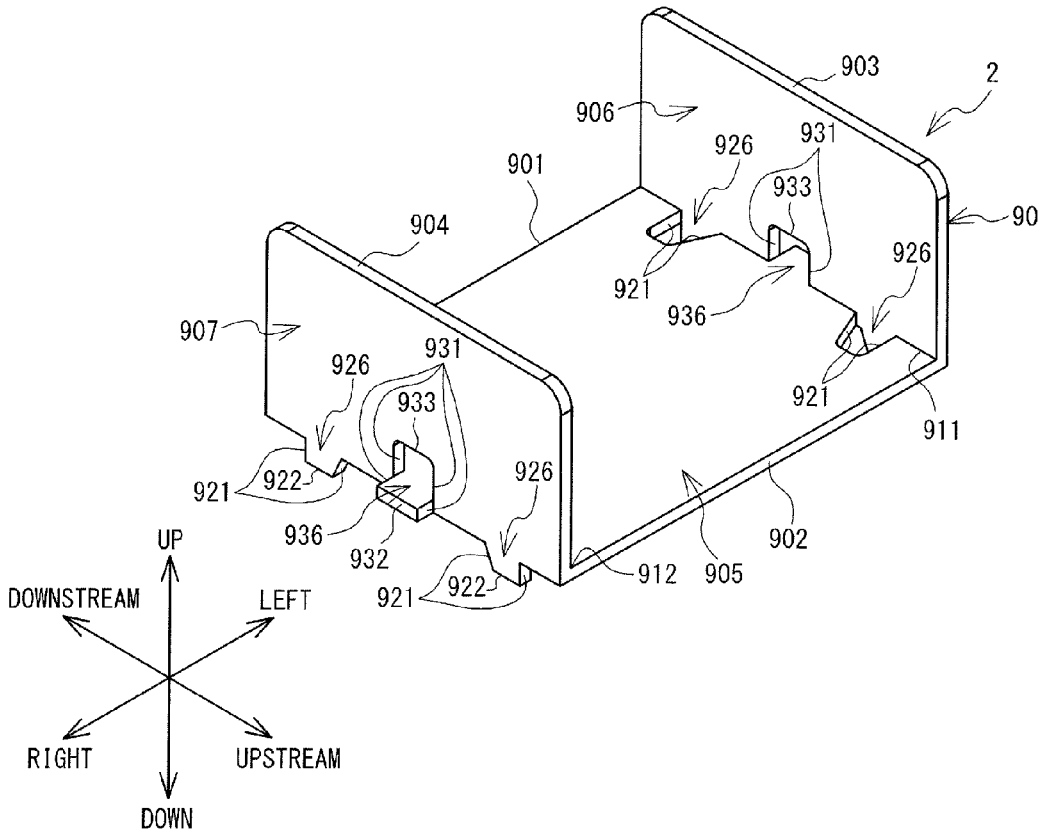
FIG. 23 is an oblique view of the base (in a bent state) as viewed from above.
Figure 24:
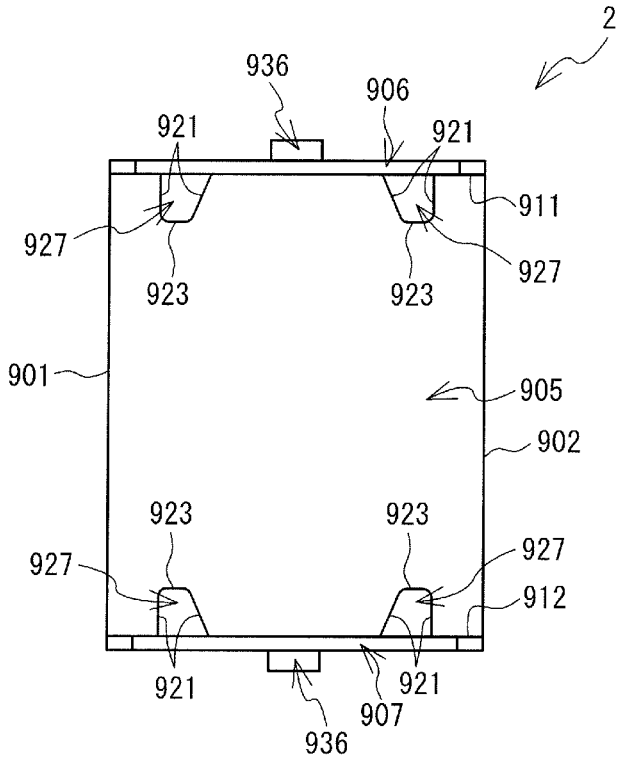
FIG. 24 is a plan view of the base (in the bent state)
Figure 25:
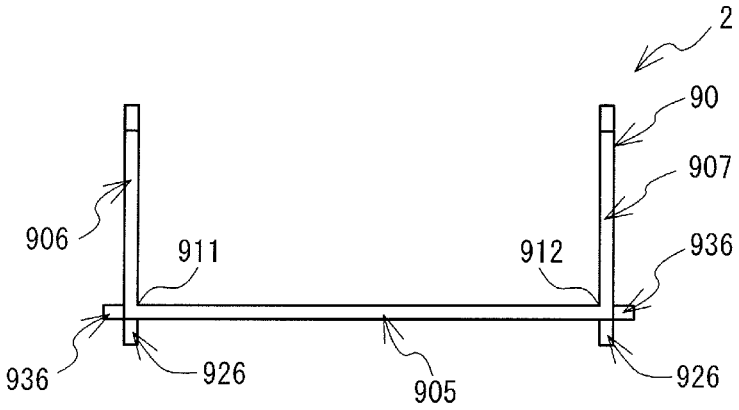
FIG. 25 is a front view of the base (in the bent state)

FIGS. 23 to 25 show the base 2 in a state in which the plate-shaped portion 90 is folded at the folding portions 911 and 912 in the same direction so that an angle between the first plate-shaped portion 905 and each of the second plate-shaped portions 906 and 907 is 90 degrees. As shown in FIG. 25, the first plate-shaped portion 905 and the second plate-shaped portion 906 are orthogonal to each other at the folding portion 911, and the first plate-shaped portion 905 and the second plate-shaped portion 907 are orthogonal to each other at the folding portion 912. Hereinafter, the direction orthogonal to the first plate-shaped portion 905 is referred to as the up-down direction. The side on which the sides 903 and 904 are arranged is referred to as the upper side, and the opposite side is referred to as the lower side.

As shown in FIG. 23, a section of the bottom surface portion 92 that is surrounded by the pair of first bottom surface cuts 921 and the second bottom surface cut 922 is arranged on the same plane as the second plate-shaped portion 906 or 907, and extends in the direction orthogonal to the first plate-shaped portion 905. Hereinafter, the section that is surrounded by the pair of first bottom surface cuts 921 and the second bottom surface cut 922 is referred to as a "bottom surface protruding portion 926". The bottom surface protruding portion 926 protrudes downward with respect to the first plate-shaped portion 905. A section of the side surface portion 93 that is surrounded by the pair of first side surface cuts 931 and the second side surface cut 932 is arranged on the same plane as the first plate-shaped portions 905, and extends in a direction orthogonal to the second plate-shaped portion 906 or 907. Hereinafter, the section that is surrounded by the pair of first side surface cuts 931 and the second side surface cut 932 is referred to as a "side surface protruding portion 936". The side surface protruding portion 936 protrudes in the left-right direction with respect to the second plate-shaped portion 906 or 907.

As shown in FIG. 24, holes 927 are formed in the first plate-shaped portion 905. Each of the holes 927 is surrounded by one of the folding portions 911 and 912, the pair of first bottom surface cuts 921, and the third bottom surface cut 923.

Figure 26:
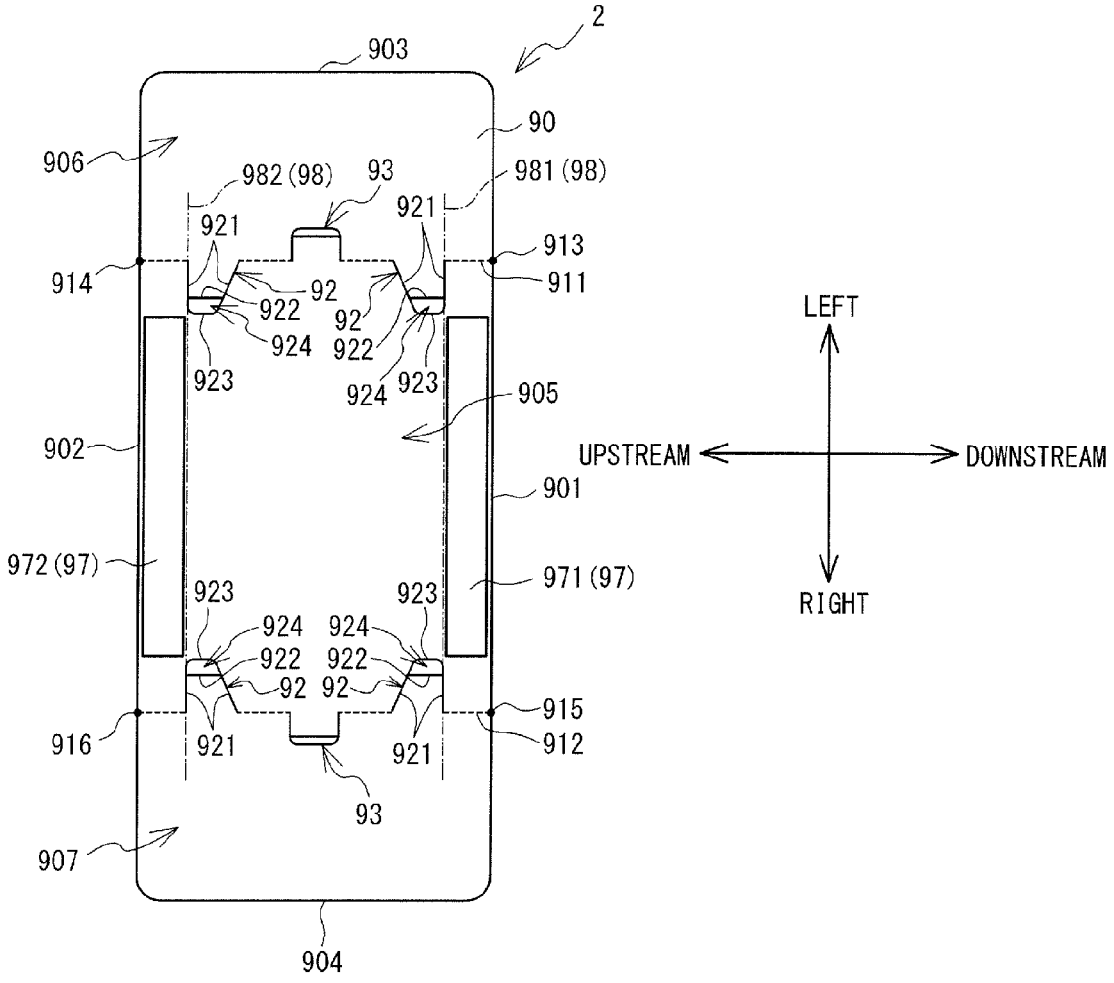
FIG. 26 is a bottom view of the base (in the unbent state)
Figure 27:
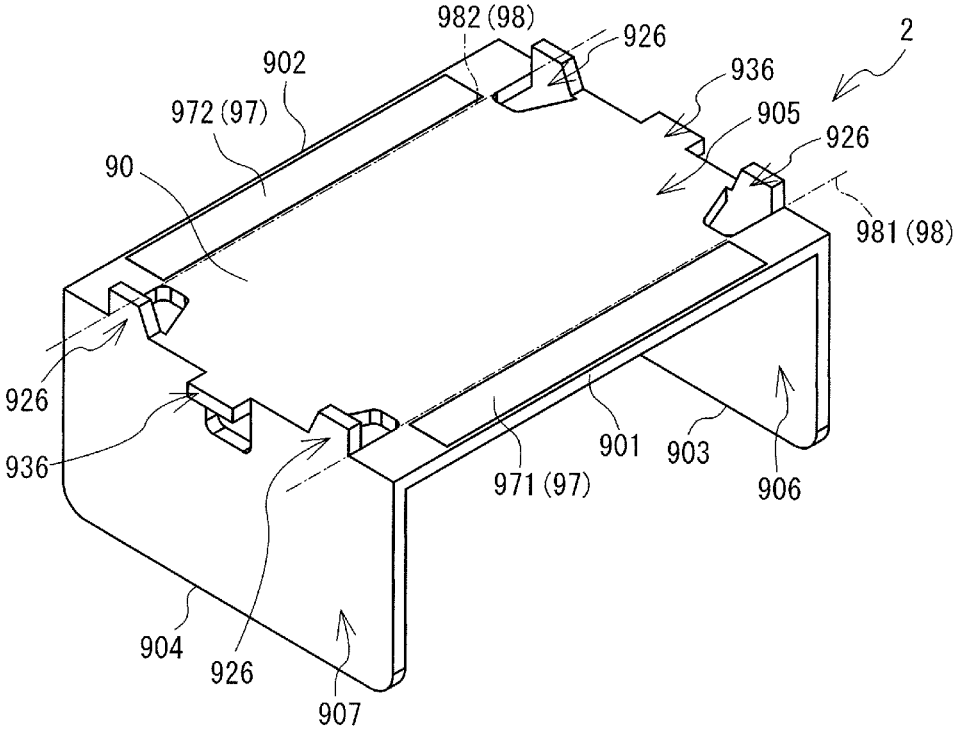
FIG. 27 is an oblique view of the base (in the bent state) as viewed from below.

As shown in FIGS. 26 and 27, a film 97 is adhered to a lower side surface of the first plate-shaped portion 905 of the plate-shaped portion 90. The film 97 includes a first film 971 and a second film 972. In a plan view, the first film 971 and the second film 972 each have a rectangular shape whose long sides extend in the left-right direction.

The first film 971 is adhered to the first plate-shaped portion 905 of the plate-shaped portion 90, more specifically, to a section that is located between the side 901 and a first line 981. The first line 981 is a line that connects the first bottom surface cut 921 that is arranged in the vicinity of the intersection point 913 among the pair of first bottom surface cuts 921 of the bottom surface portion 92 close to the intersection point 913, and the first bottom surface cut 921 that is arranged in the vicinity of the intersection point 915 among the pair of first bottom surface cuts 921 of the bottom surface portion 92 close to the intersection point 915. The first film 971 extends in the left-right direction from the vicinity of the downstream side end of the third bottom surface cut 923 of the bottom surface portion 92 that is close to the intersection point 913, to the vicinity of the downstream side end of the third bottom surface cut 923 of the bottom surface portion 92 that is close to the intersection point 915. The upstream side edge of the first film 971 is arranged on the downstream side of the first line 981. The first film 971 is separated from the cuts of the bottom surface portion 92 (the first bottom surface cuts 921, the second bottom surface cut 922, and the third bottom surface cut 923) and is not in contact with these cuts.

The second film 972 is adhered to the first plate-shaped portion 905 of the plate-shaped portion 90, more specifically, to a section that is located between the side 902 and a second line 982. The second line 982 is a ling that connects the first bottom surface cut 921 that is arranged in the vicinity of the intersection point 914 among the pair of first bottom surface cuts 921 of the bottom surface portion 92 close to the intersection point 914, and the first bottom surface cut 921 that is arranged in the vicinity of the intersection point 916 among the pair of first bottom surface cuts 921 of the bottom surface portion 92 close to the intersection point 916. The second film 972 extends in the left-right direction from the vicinity of the upstream side end of the third bottom surface cut 923 of the bottom surface portion 92 close to the intersection point 914, to the vicinity of the upstream side end of the third bottom surface cut 923 of the bottom surface portion 92 close to the intersection point 916. The downstream side edge of the second film 972 is arranged on the upstream side of the second line 982. The second film 972 is separated from the cuts of the bottom surface portion 92 (the first bottom surface cuts 921, the second bottom surface cut 922 and the third bottom surface cut 923) and is not in contact with these cuts.

The first film 971 and the second film 972 are each adhered to the inner side in the left-right direction with respect to the folding portions 911 and 912. The first film 971 and the second film 972 are separated from the folding portions 911 and 912 and are not in contact with the folding portions 911 and 912.

Hereinafter, the first film 971 and the second film 972 are also collectively referred to as "films 97". The films 97 are resin films. The films 97 are adhered to the plate-shaped portion 90 using adhesive. The films 97 melt when the films 97 are heated by the heaters 411 of the heating portion 40.

Figure 28:
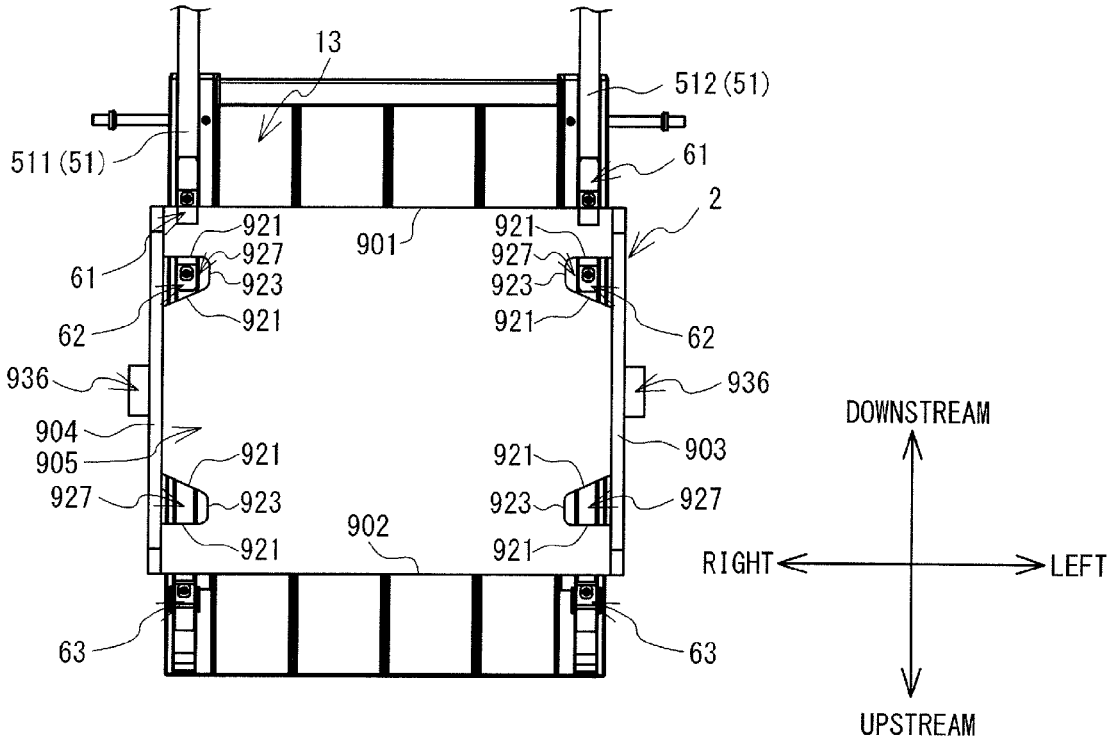
FIG. 28 is a plan view of the base when the base has been placed on the second receiving tray.
Figure 29:
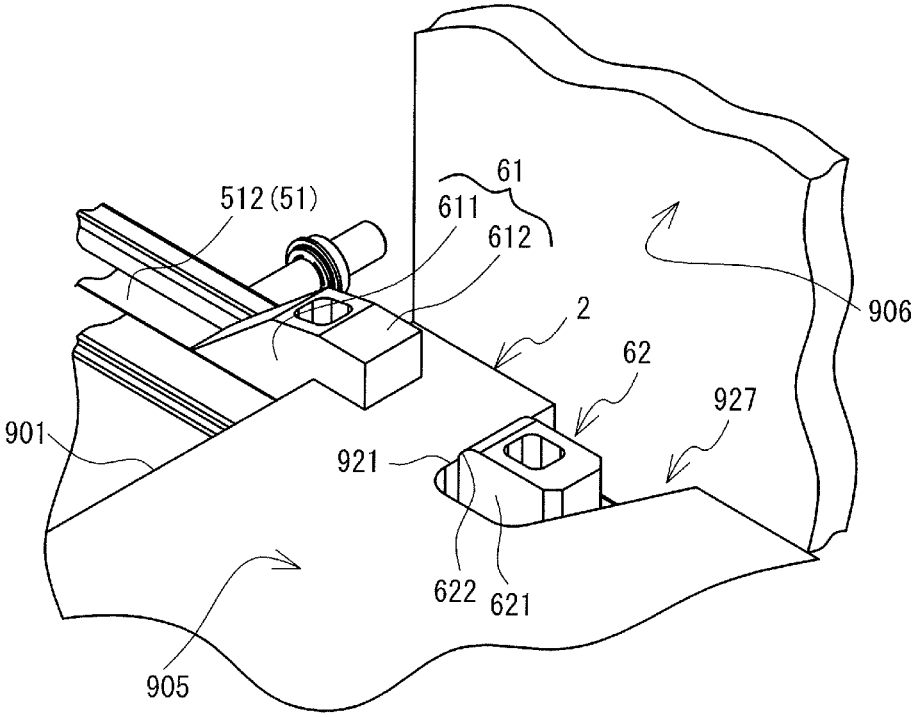
FIG. 29 is an enlarged oblique view of the first conveyance portion and the second conveyance portion (in a state in which the base has been placed on the second receiving tray)
Figure 30:
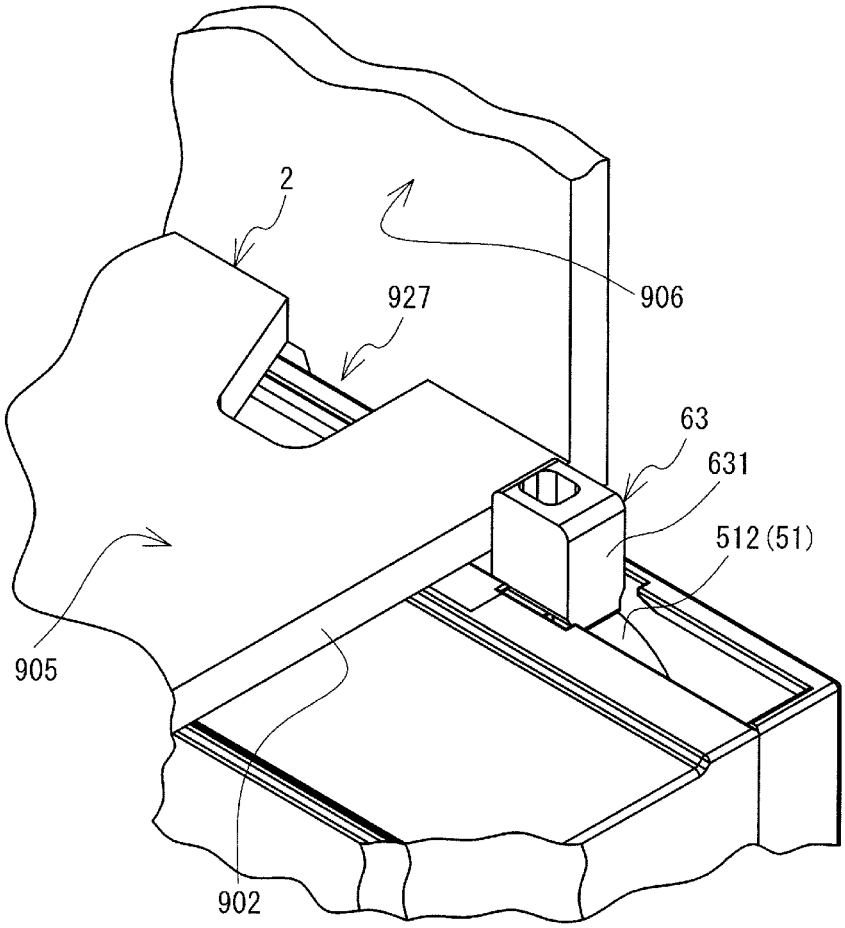
FIG. 30 is an enlarged oblique view of the third conveyance portion (in a state in which the base has been placed on the second receiving tray)

FIGS. 28 to 30 show the base 2 placed on the second receiving tray 13. The user may move the base 2 obliquely downward from the upstream side to the downstream side in order to fit the side 901 of the first plate-shaped portion 905 of the base 2 into a space formed between the extending portion 612 of the first conveyance portion 61 and the belt 51. The side 901 of the first plate-shaped portion 905 of the base 2 may be moved obliquely downward from the upstream side toward the downstream side, and may enter the space formed between the extending portion 612 and the belt 51. The corner portion 622 of the second protruding portion 621 of the second conveyance portion 62 is curved in an arc shape. Therefore, the first plate-shaped portion 905 of the base 2 may smoothly enter the space formed between the extending portion 612 and the belt 51, without any obstruction by the corner portion 622. As a result, as shown in FIG. 29, the side 901 of the base 2 may be fitted into the space formed between the extending portion 612 and the belt 51. In this state, the extending portion 612 may cover the side 901 of the first plate-shaped portion 905 of the base 2 from above. The first conveyance portion 61 is provided on the belt 51 that may be arranged on both the left and right side surfaces of the second receiving tray 13. Therefore, the side 901 of the first plate-shaped portion 905 of the base 2 may be sandwiched between the extending portion 612 and the belt 51, from both the left and right sides.

The distance (the first distance P, refer to FIG. 18) between the first protruding portion 611 of the first conveyance portion 61 and the second protruding portion 621 of the second conveyance portion 62 is substantially the same as the distance between the side 901 of the base 2 and the bottom surface portion 92 close to the side 901. Therefore, as shown in FIG. 29, the second protruding portion 621 of the second conveyance portion 62 may be fitted into the hole 927 that is surrounded by the cuts of the bottom surface portion 92 (the pair of first bottom surface cuts 921 and the third bottom surface cut 923). As a result, the base 2 is sandwiched, from both sides in the conveyance direction, by the first protruding portion 611 of the first conveyance portion 61 and the second protruding portion 621 of the second conveyance portion 62. The second conveyance portion 62 is provided on the belt 51 that may be arranged on both the left and right side surfaces of the second receiving tray 13. Therefore, the base 2 may be sandwiched between the first protruding portion 611 of the first conveyance portion 61 and the second protruding portion 621 of the second conveyance portion 62, from both the left and right sides.

The distance (the second distance Q, refer to FIG. 18) between the second protruding portion 621 of the second conveyance portion 62 and the third protruding portion 631 of the third conveyance portion 63 is substantially the same as the distance between the side 902 and the bottom surface portion 92 close to the side 901 of the base 2. Therefore, as shown in FIG. 30, the third protruding portion 631 of the third conveyance portion 63 may come into contact with the side 902 of the first plate-shaped portion 905 of the base 2, from the upstream side. As a result, the base 2 may be sandwiched, from both sides in the conveyance direction, by the second protruding portion 621 of the second conveyance portion 62 and the third protruding portion 631 of the third conveyance portion 63. The third conveyance portion 63 is provided on the belt 51 that may be arranged on both the left and right side surfaces of the second receiving tray 13. Therefore, the base 2 may be sandwiched between the second protruding portion 621 of the second conveyance portion 62 and the third protruding portion 631 of the third conveyance portion 63, from both the left and right sides.

Although not shown in the drawings, the first plate-shaped portion 905 of the base 2 may come into contact with the receiving surface of the second receiving tray 13. Therefore, the bottom surface protruding portions 926 that protrude downward from the first plate-shaped portion 905 may protrude downward from both the left and right sides of the receiving surface of the second receiving tray 13, and may be arranged on the outside of both the left and right side surfaces of the second receiving tray 13.

An electrical configuration of the packaging device 1 will be explained with reference to FIG. 31. The packaging device 1 includes a CPU 201, a ROM 202, a RAM 203, the sensor 204, an input portion 205, and the heaters 411. The CPU 201 performs overall control of the packaging device 1. The CPU 201 performs packaging processing by executing a program stored in the ROM 202. The packaging processing is processing that packages, with the film 24, the object 3 that has been placed on the base 2. The ROM 202 stores the program for the packaging processing that is executed by the CPU 201. The RAM 203 may store temporary data. The sensor 204 may detect the reflecting plate provided on the outer side surface of the belt 51. The input portion 205 includes a plurality of input buttons that may be used by the user to perform an input operation with respect to the packaging device 1. The packaging device 1 also includes drive portions 211 to 216, the first motor 221, the second motor 222, the third motor 223, the fourth motor 224, the fifth motor 225, and the sixth motor 226. The drive portions 211 to 216 may respectively drive the first motor 221 to the sixth motor 226. The CPU 201 is electrically connected to the ROM 202, the RAM 203, the sensor 204, the heaters 411, and the drive portions 211 to 216. The drive portions 211 to 216 are respectively electrically connected to the first motor 221 to the sixth motor 226.

The packaging processing that is performed by the CPU 201 of the packaging device 1 will be explained with reference to FIGS. 32 to 43. Before the user uses the packaging device 1 to perform an operation to package the base 2 and the object 3 with the film 24, the user may swing the first receiving tray 12 and the second receiving tray 13 so that the receiving surfaces of the first receiving tray 12 and the second receiving tray 13 (refer to FIG. 1) may become horizontal. The receiving surface of the first receiving tray 12 and the receiving surface of the second receiving tray 13 may form the conveyance path 103. The user may turn on the power supply of the packaging device 1. When the power supply of the packaging device 1 is turned on, the CPU 201 starts the packaging processing by reading and executing the program stored in the ROM 202.

Figure 32:
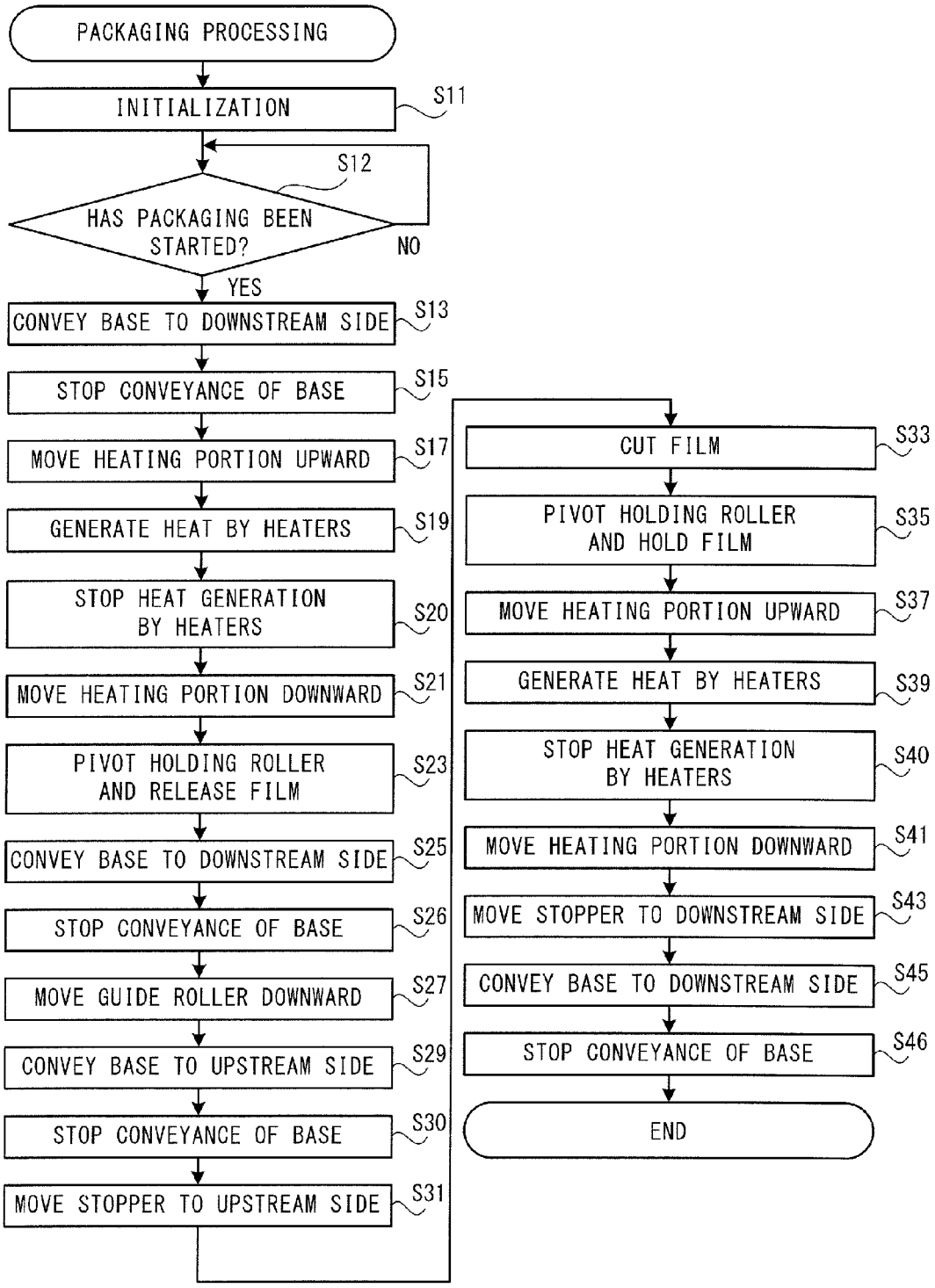
FIG. 32 is a flowchart of packaging processing.

As shown in FIG. 32, first, the CPU 201 initializes the state of the packaging device 1 (step S11). Specifically, the initialization is performed in the following manner. The CPU 201 drives the first motor 221 by controlling the drive portion 211, and causes the support portions 34 to move upward so that the support portions 34 are located at their highest position. By doing this, the movable rollers 30 (the guide roller 31, the first auxiliary roller 32, and the second auxiliary roller 33) that are supported by the support portions 34 are located at their highest positions (refer to FIG. 33). The CPU 201 drives the second motor 222 by controlling the drive portion 212, and causes the belts 51 (refer to FIG. 17) of the conveyance mechanism 50 to rotate. When the sensor 204 detects the reflecting plate, the CPU 201 stops the driving of the second motor 222 by controlling the drive portion 212. This causes the conveyance portions 60 (each including the first conveyance portion 61, the second conveyance portion 62, and the third conveyance portion 63) to protrude upward higher than the receiving surface of the second receiving tray 13 (refer to FIG. 17). The packaging device 1 is brought into a state in which the user may set the base 2 on the receiving surface of the second receiving tray 13.

The CPU 201 drives the third motor 223 by controlling the drive portion 213, and moves the heating portion 40 to downward so that the heating portion 40 is located at its lowest position. As a result, the heaters 411 (refer to FIG. 8) located on the top surfaces of the heating units 41 are separated from the conveyance path 103 (refer to FIG. 33). The lid portion 46 pivots due to the springs 462 and comes into contact with the support portions 414 on the top surfaces of the heating units 41. The lid portion 46 is brought into a substantially horizontal state and covers the heaters 411 from above. Therefore, for example, when the user attempts to touch the inside of the packaging device 1 for the purpose of maintenance, the user is not able to directly touch the heaters 411.

The CPU 201 drives the fourth motor 224 by controlling the drive portion 214, and moves the stopper 81 to the downstream side (refer to FIG. 12). The CPU 201 drives the fifth motor 225 by controlling the drive portion 215, and moves the cutting portion 77 to the left (refer to FIG. 4). In this state, the position in the left-right direction of the blade portion 771 of the cutting portion 77 is arranged to the left of the left end of the film 24 contained in the film cassette 21. The CPU 201 drives the sixth motor 226 by controlling the drive portion 216, and causes the holding portions 78 to pivot. The holding roller 72 is downwardly separated from the base guide roller 71 (refer to FIG. 7).

The CPU 201 determines whether or not an instruction to start the packaging of the base 2 and the object 3 by the film 24 has been input via the input portion 205 (refer to FIG. 31) (step S12). When the instruction to start the packaging has not been input (no at step S12), the processing returns to step S12. The CPU 201 continues to wait to receive the instruction to start the packaging.

After the packaging device 1 has been initialized at step S11, the user may manually pull down the film 24 discharged from the discharge opening of the film cassette 21, through the upstream side of the second auxiliary roller 33. Since the film 24 comes into contact with the upstream side of the second auxiliary roller 33, the film 24 is guided slightly to the upstream side. The user may further pull the pulled-down leading end of the film 24 until the film 24 reaches below the conveyance path 103, such that the leading end of the film 24 is arranged on the downstream side of the base guide roller 71 (refer to FIG. 33).

Figure 33:
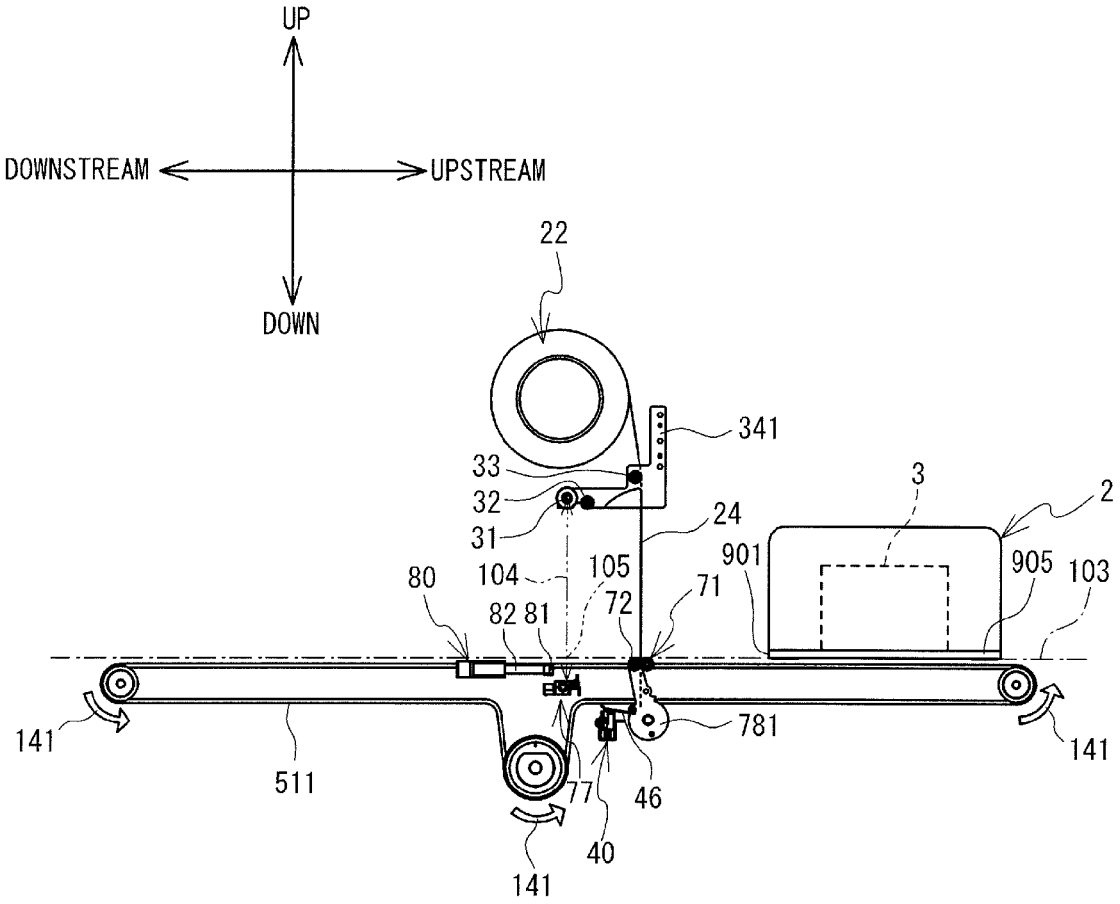
FIG. 33 is a figure showing a packaging step in the packaging processing.

The user performs an input operation via the input portion 205 in order to notify the packaging device 1 that the film 24 is prepared. In this case, the CPU 201 drives the sixth motor 226 by controlling the drive portion 216, and causes the holding portions 78 to pivot. Due to the pivoting of the holding portions 78, the holding roller 72 is arranged in the vicinity of the downstream side of the base guide roller 71, as shown in FIG. 33. The leading end of the film 24 that has been pulled out from the film cassette 21 is clamped by the base guide roller 71 and the holding roller 72, from both sides in the conveyance direction. The film 24 and the conveyance path 103 intersect with each other in the vicinity of the leading end of the film 24. The torque is applied to the film roll 22 by the clutch spring, and the tension acts on the film 24. Thus, the film 24 extends straight up-down between the upstream side of the second auxiliary roller 33 and a section that is clamped by the base guide roller 71 and the holding roller 72.

The user may place the base 2 on the second receiving tray 13 (refer to FIGS. 28 to 30). The base 2 may be positioned by the conveyance portion 60, and the position of the base 2 may be fixed with respect to the conveyance portion 60. The side 901 of the first plate-shaped portion 905 of the base 2 may be arranged on the downstream side and the side 902 may be arranged on the upstream side. In this state, the base 2 may be conveyed in the conveyance direction by the conveyance portion 60. The user may place the object 3 on the first plate-shaped portion 905 of the base 2 that has been placed on the second receiving tray 13. The user may perform an input operation, via the input portion 205, to instruct the start of the packaging of the base 2 and the object 3 by the film 24.

As shown in FIG. 32, when the instruction to start the packaging has been input (yes at step S12), the CPU 201 drives the second motor 222 by controlling the drive portion 212. The CPU 201 adjusts the rotation direction of the second motor 222 by controlling the drive portion 212 so that the belts 51 are rotated in the direction in which the base 2 is conveyed from the upstream side to the downstream side. The second motor 222 rotates the belts 51 via the drive portion 55 (refer to FIG. 17). The belts 51 are rotated in the direction (the direction of an arrow 141 in FIG. 33) in which the conveyance portions 60 (each including the first conveyance portion 61, the second conveyance portion 62, and the third conveyance portion 63) that protrude upward higher than the receiving surface of the third receiving tray 13 are moved from the upstream side to the downstream side. The conveyance portions 60 convey the base 2 from the upstream side to the downstream side along the conveyance path 103 (step S13).

The first protruding portion 611 of the first conveyance portion 61 and the second protruding portion 621 of the second conveyance portion 62 may sandwich a section of the first plate-shaped portion 905 of the base 2 that is located between the side 901 and the hole 927 that is in the vicinity of the side 901, from both sides in the conveyance direction. The second protruding portion 621 of the second conveyance portion 62 and the third protruding portion 631 of the third conveyance portion 63 may sandwich a section of the first plate-shaped portion 905 that is located between the side 902 and the hole 927 that is in the vicinity of the side 901, from both sides in the conveyance direction. Therefore, the conveyance portions 60 can appropriately convey the base 2 to the downstream side.

Hereinafter, the rotation direction of the second motor 222 and the belts 51 when the base 2 is conveyed from the upstream side to the downstream side is referred to as the "positive direction". The rotation direction of the second motor 222 and the belts 51 that is opposite to the positive direction is referred to as the "reverse direction".

As shown in FIG. 33, the downstream side end of the base 2 gradually approaches the film 24 extending in the up-down direction. The downstream side end (the side 901) of the first plate-shaped portion 905 of the base 2 comes into contact with the film 24, and thereafter passes over the holding roller 72. The CPU 201 continues to drive the second motor 222 by controlling the drive portion 212, and causes the belts 51 to continue to rotate in the positive direction. The base 2 continues to be conveyed to the downstream side.

Figure 34:
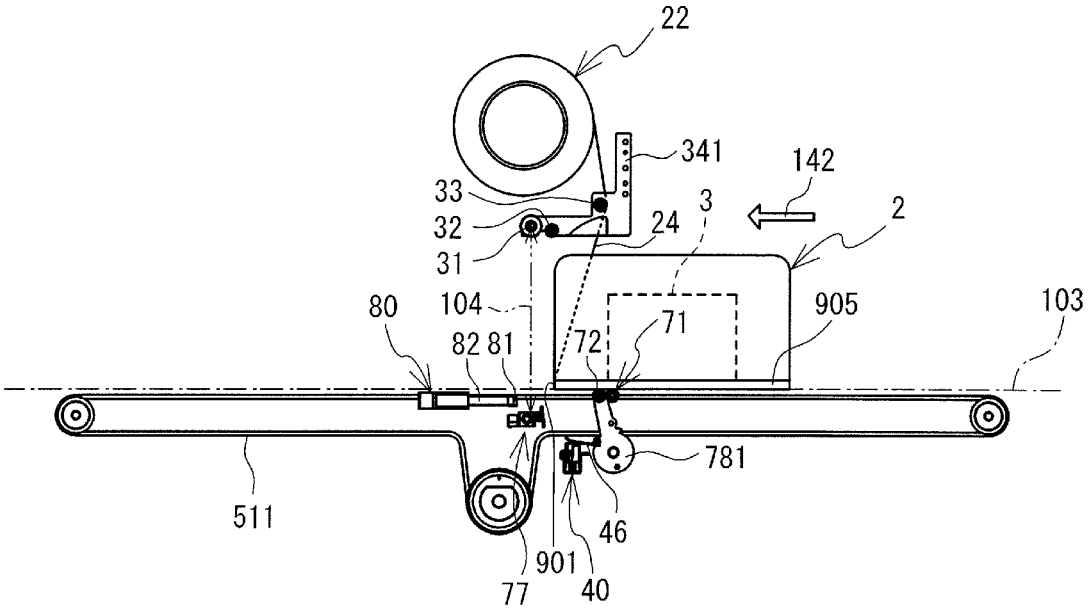
FIG. 34 is a figure showing a packaging step in the packaging processing.

As shown in FIG. 34, the base 2 is moved to the downstream side (an arrow 142). As a result, the side 901 of the first plate-shaped portion 905 of the base 2 pushes the film 24 to the downstream side. The base 2 is moved further to the downstream side. The side 901 approaches the movement path 104 from the upstream side. The base 2 is moved further to the downstream side, and the side 901 passes above the heating portion 40. The leading end of the film 24 is clamped by the base guide roller 71 and the holding roller 72. When the film 24 is pushed by the side 901 to the downstream side, the leading end of the film 24 reaches around to the lower surface of the first plate-shaped portion 905 of the base 2.

The CPU 201 detects whether the side 901 of the first plate-shaped portion 905 of the base 2 has been moved to the downstream side, by a predetermined distance, of a position above the heating portion 40, based on the rotation number of the second motor 222 after the conveyance of the base 2 to the downstream side is started at step S13 (refer to FIG. 32). The predetermined distance is set to be substantially the same as the distance from the side 901 of the first plate-shaped portion 905 to the first line 981 (refer to FIG. 27). When the side 901 has been moved to the downstream side, by the predetermined distance, of the position above the heating portion 40, the CPU 201 stops the driving of the second motor 222 by controlling the drive portion 212, and stops the conveyance of the base 2 to the downstream side, as shown in FIG. 32 (step S15).

Figure 35:
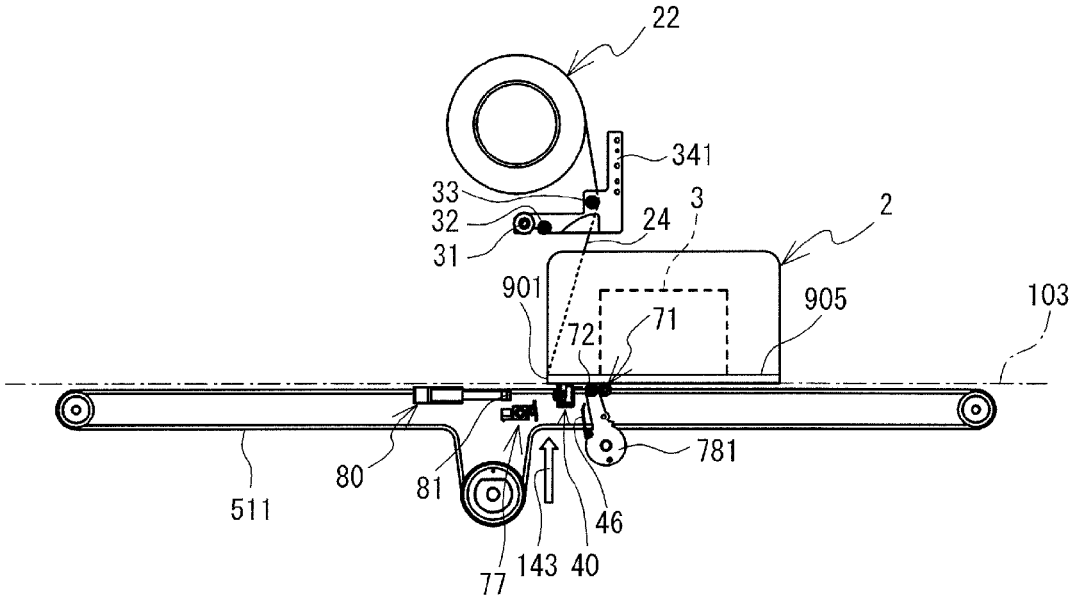
FIG. 35 is a figure showing a packaging step in the packaging processing.

The CPU 201 drives the third motor 223 by controlling the drive portion 213 and causes the heating portion 40 to move upward (step S17). When the heating portion 40 is located at its highest position, the CPU 201 stops the driving of the third motor 223 by controlling the drive portion 213, and stops the upward movement of the heating portion 40. As shown in FIG. 35, when the heating portion 40 has been moved upward (an arrow 143) to its highest position, the top surfaces of the heating units 41 (refer to FIG. 8) of the heating portion 40 come close to the conveyance path 103 from below. The film 24 is sandwiched between the support portions 414 and the base 2, and the support portions 414 fix the position of the heaters 411 with respect to the film 24. As the heating portion 40 is moved upward, the lid portion 46 pivots around the pivot shafts 461 in resistance to the urging force of the springs 462. The lid portion 46 becomes substantially vertical. The opposite side edge of the lid portion 46 comes into contact with the plate-shaped portion on the upstream side of the holding portion 42 of the heating portion 40. The lid portion 46 separates from the top surfaces of the heating units 41.

The side 901 of the first plate-shaped portion 905 of the base 2 has been moved to the downstream side, by the predetermined distance, of the position above the heating portion 40. The film 24 has reached around to the lower surface of the first plate-shaped portion 905. Therefore, when the heating portion 40 is located at its highest position, the film 24 is sandwiched between the top surfaces of the heating units 41 and the lower surface of the first plate-shaped portion 905 of the base 2. Here, as shown in FIG. 27, the first film 971 is adhered to the lower surface of the first plate-shaped portion 905, more specifically, to the section between the side 901 and the first line 981. Therefore, the film 24 is sandwiched between the top surfaces of the heating units 41 of the heating portion 40 that has been moved to its highest position and the first film 971 adhered to the base 2.

As shown in FIG. 32, the CPU 201 causes the heaters 411 of the heating portion 40 to generate heat (step S19). The heaters 411 heat the film 24 and melt the film 24. At the same time, the heaters 411 heat the first film 971 adhered to the base 2, via the film 24, and melt the first film 971. The melted film 24 and the melted first film 971 bond together well. As a result, the leading end of the film 24 is bonded, via the first film 971, to the vicinity of the side 901 of the lower surface of the first plate-shaped portion 905 of the base 2 (step S19).

Figure 36:
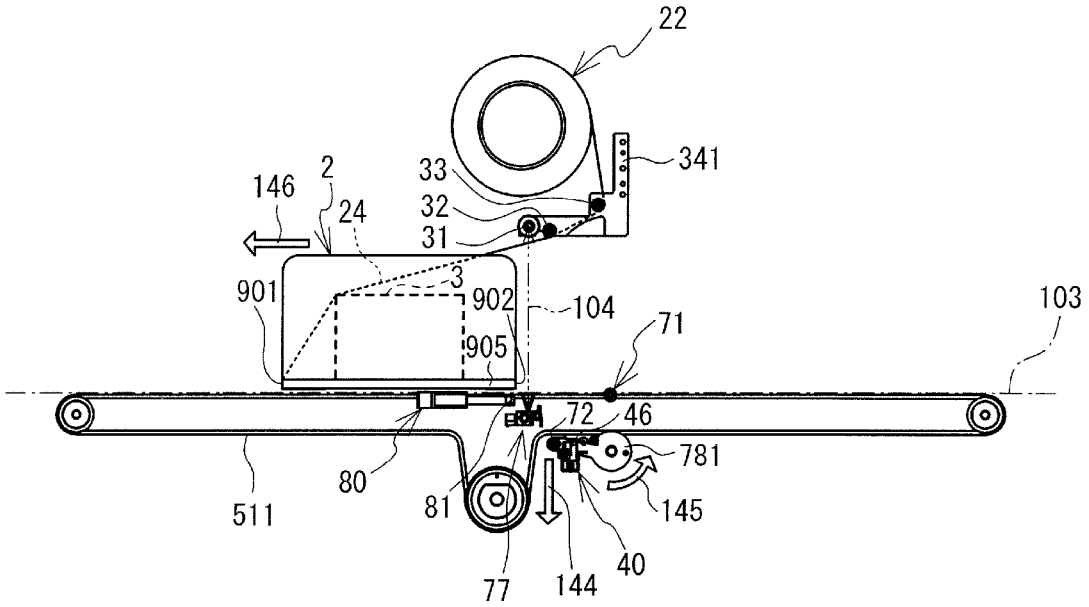
FIG. 36 is a figure showing a packaging step in the packaging processing.

The CPU 201 stops the heat generation of the heaters 411, after a predetermined time period has elapsed from when the heat generation of the heaters 411 is started at step S19 (step S20). The predetermined time period is a time period that is necessary for the heaters 411 to heat the film 24 and the first film 971 to their melting point. The CPU 201 drives the third motor 223 by controlling the drive portion 213 and causes the heating portion 40 to move downward (step S21). The top surfaces of the heating units 41 of the heating portion 40 are separated from the conveyance path 103. When the heating portion 40 is located at its lowest position, the CPU 201 stops the driving of the third motor 223 by controlling the drive portion 213, and stops the downward movement of the heating portion 40. As shown in FIG. 36, when the heating portion 40 has been moved downward (an arrow 144) to its lowest position, the lid portion 46 pivots around the pivot shafts 461 due to the urging force of the springs 462, and the lid portion 46 becomes substantially horizontal. The top surfaces of the heating units 41 are covered by the lid portion 46.

As shown in FIG. 32, the CPU 201 drives the sixth motor 226 by controlling the drive portion 216, and causes the holding portions 78 to pivot (step S23). As shown in FIG. 36, due to the pivoting of the holding portions 78 in the direction of an arrow 145, the holding roller 72 is downwardly separated from the base guide roller 71. The base guide roller 71 and the holding roller 72 release the leading end of the film 24 that has been clamped by the base guide roller 71 and the holding roller 72. A section in the vicinity of the leading end of the film 24 is melted by the heat generated by the heaters 411 at step S19, and is bonded to the lower surface of the base 2. As shown in FIG. 32, the CPU 201 drives the second motor 222 by controlling the drive portion 212, and causes the belts 51 to rotate in the positive direction so that the base 2 is conveyed to the downstream side (step S25).

As shown in FIG. 36, the conveyance portions 60 move from the upstream side to the downstream side (an arrow 146) along the conveyance path 103, and convey the base 2 to the downstream side. The leading end of the film 24 is released from the base guide roller 71 and the holding roller 72. Therefore, in a state in which the section in the vicinity of the leading end of the film 24 is bonded to the lower surface of the base 2, the film 24 is moved to the downstream side along with the movement of the base 2. The side 901 of the first plate-shaped portion 905 of the base 2 passes over the position (the intersection position 105), at which the conveyance path 103 and the movement path 104 intersect with each other, from the upstream side to the downstream side. The base 2 is moved further to the downstream side (the arrow 146). As the base 2 is moved to the downstream side, the side 901 and the downstream side end of the object 3 are pressed against the film 24. The film 24 is bent at the contact portion with the side 901 and the contact portion with the object 3. The film 24 is fed out from the film roll 22 little by little. Due to the torque applied to the film roll 22, the film 24 is strongly pressed against the base 2 and the object 3. The film 24 is firmly attached to the base 2 and the object 3 in a position where the film 24 covers the downstream side of the first plate-shaped portion 905 of the base 2 and the object 3.

The CPU 201 continuously drives the second motor 222 by controlling the drive portion 212, and causes the belts 51 to continuously rotate in the positive direction. The base 2 is continuously conveyed to the first receiving tray 12 on the downstream side. The torque is applied to the film roll 22 by the clutch spring and the tension acts on the film 24. Therefore, in accordance with the conveyance of the base 2 to the downstream side, an upward force acts on the downstream side of the first plate-shaped portion 905 of the base 2 to which the section in the vicinity of the leading end of the film 24 is bonded. In a similar manner, an upward force also acts on the first receiving tray 12 that supports, via the pulleys 52 and 53, the belts 51 on which the conveyance portions 60 that convey the base 2 are provided. In contrast to this, the upstream side ends of the guide portions 16 come into contact with the downstream side edges of the side plate portions 111 and 112, thus inhibiting the base 2 and the first receiving tray 12 from lifting upward.

The base 2 is continuously conveyed to the downstream side, and the film 24 is arranged in a position where the film 24 covers the first plate-shaped portion 905 of the base 2 and the upper side of the object 3. The film 24 is firmly attached to the top surface of the object 3 due to the torque applied to the film roll 22. The upstream side end (the side 902) of the first plate-shaped portion 905 passes through over the base guide roller 71. The base 2 is further conveyed to the downstream side (the arrow 146). The side 902 of the first plate-shaped portion 905 passes over the intersection position 105 from the upstream side to the downstream side. The film 24 extending from the film roll 22 comes into contact with the upstream side of the second auxiliary roller 33 and is guided slightly to the upstream side. Then, the film 24 comes into contact with the lower side of the second auxiliary roller 33 and extends to the downstream side. The film 24 comes into contact with the lower side of the first auxiliary roller 32 and extends further to the downstream side, thus reaching the downstream side of the side 901 and the object 3. The guide roller 31 is arranged above the film 24 that extends between the first auxiliary roller 32 and the base 2 by way of the object 3.

As shown in FIG. 32, the CPU 201 detects whether the side 902 of the first plate-shaped portion 905 of the base 2 has been moved to the downstream side of the intersection position 105, based on the rotation number of the second motor 222 after the conveyance of the base 2 to the downstream side is started at step S25. When the side 902 has been moved to the downstream side of the intersection position 105, the CPU 201 stops the driving of the second motor 222 by controlling the drive portion 212, and stops the conveyance of the base 2 (step S26).

The packaging device 1 may include a position sensor in the vicinity of the intersection position 105. When the position sensor detects the side 902 of the first plate-shaped portion 905 of the base 2, the CPU 201 may determine that the side 902 of the first plate-shaped portion 905 of the base 2 has been moved to the downstream side of the intersection position 105.

The CPU 201 drives the first motor 221 by controlling the drive portion 211 and causes the support portions 34 to move downward. The movable rollers 30 supported by the support portions 34 are moved from their highest position to their lowest position. The guide roller 31 moves downward from its highest position to its lowest position along the movement path 104 (step S27). The guide roller 31 comes into contact, from above, with the film 24 arranged below the guide roller 31, and guides the film 24 downward along the movement path 104.

Figure 37:
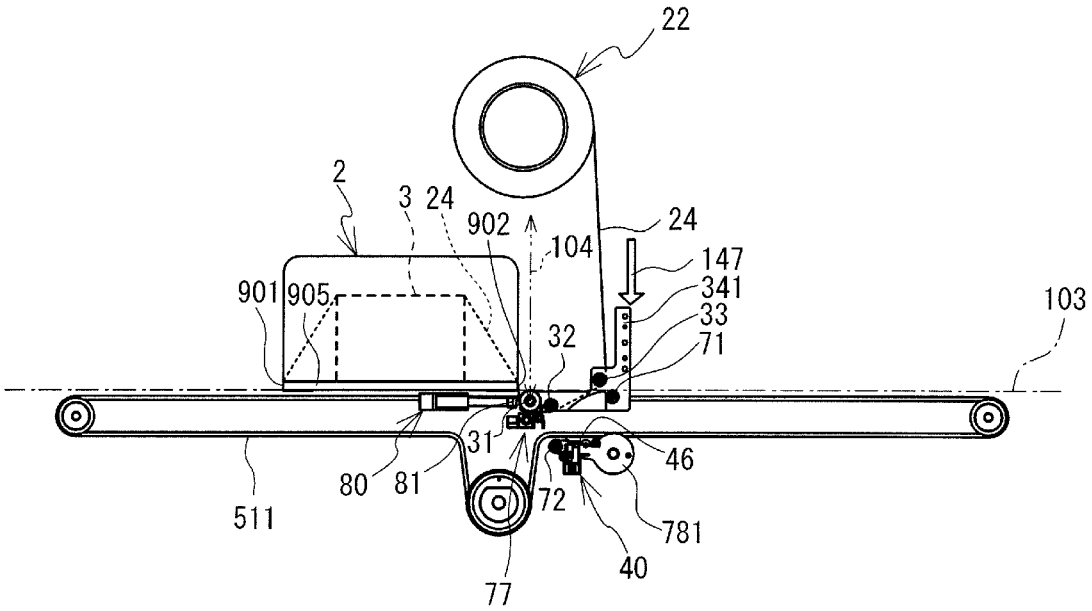
FIG. 37 is a figure showing a packaging step in the packaging processing.

As shown in FIG. 37, the guide roller 31 is moved downward (an arrow 147) along the movement path 104, and is located at its lowest position. In this state, the guide roller 31 is in contact with the conveyance path 103 from below. The film 24 is arranged in a position where the film 24 covers the upstream side of the first plate-shaped portion 905 of the base 2 and the object 3. The film 24 extends toward the guide roller 31 from a portion where the film 24 is in contact with the side 902 of the first plate-shaped portion 905 of the base 2. The film 24 comes into contact with the downstream side and the lower side of the guide roller 31, and extends to the upstream side. The film 24 comes into contact with the lower side of the first auxiliary roller 32 and extends further to the upstream side. The film 24 comes into contact with the lower side and the upstream side of the second auxiliary roller 33, and reaches the film roll 22. A section of the film 24 that is located between the contact portion with the lower side of the guide roller 31 and the contact portion with the lower end of the first auxiliary roller 32 extends substantially in the horizontal direction, and is arranged below the upper end of the blade portion 771 that extends upward from the cutting portion 77. In the state in which the packaging device 1 is initialized (refer to step S11), the cutting portion 77 has been moved to the left side. At this point in time, the film 24 is not in contact with the blade portion 771.

As shown in FIG. 32, the CPU 201 drives the second motor 222 by controlling the drive portion 212, and causes the belts 51 to rotate in the reverse direction. The conveyance portions 60 are moved from the downstream side to the upstream side, and convey the base 2 to the upstream side along the conveyance path 103 (step S29). The base 2 is conveyed in the reverse direction (the direction from the downstream side toward the upstream side).

Figure 38:
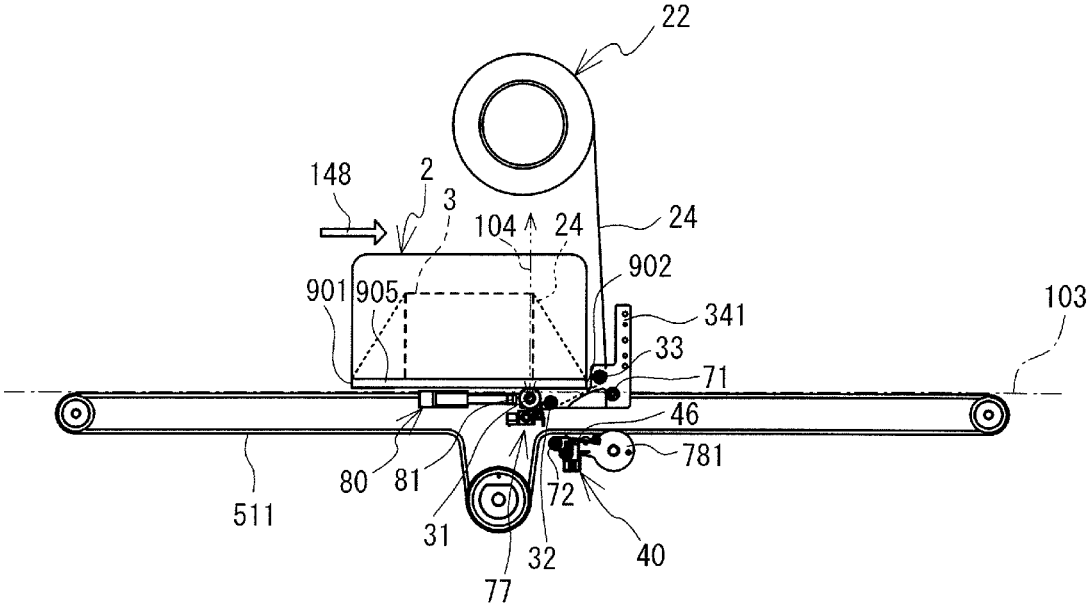
FIG. 38 is a figure showing a packaging step in the packaging processing.

As shown in FIG. 38, the base 2 is moved from the downstream side to the upstream side (an arrow 148). As a result, the side 902 of the first plate-shaped portion 905 of the base 2 approaches the intersection position 105 from the downstream side. The side 902 passes over the intersection position 105 from the downstream side toward the upstream side. The side 902 passes through the position above the heating portion 40 and is moved to the upstream side. In a state in which the guide roller 31 is in contact with the lower surface of the first plate-shaped portion 905 from below, the guide roller 31 is relatively moved from the side 902 toward the downstream side. The film 24 is sandwiched between the lower surface of the first plate-shaped portion 905 and the guide roller 31.

Figure 39:
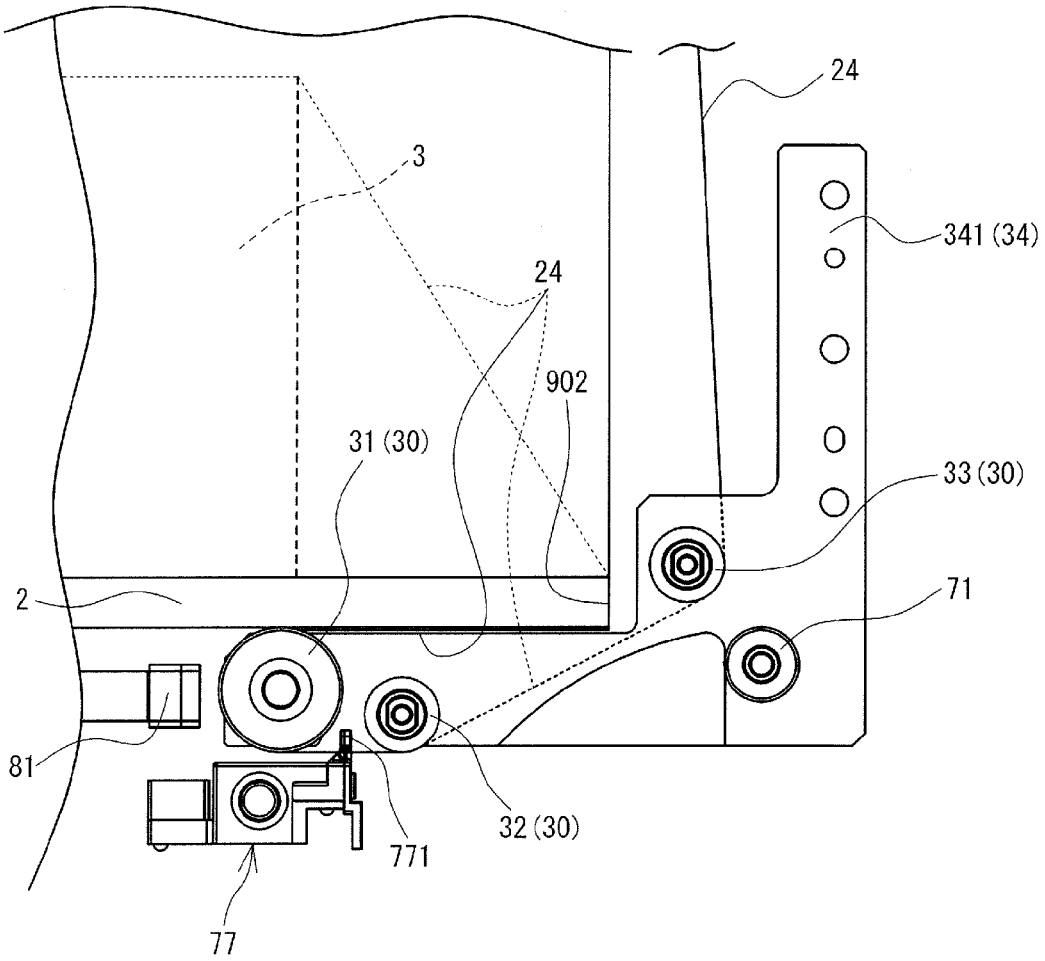
FIG. 39 is a figure showing a packaging step in the packaging processing.

As shown in FIG. 39, the film 24 extends from the portion where the film 24 is in contact with the side 902 of the first plate-shaped portion 905 of the base 2 to the downstream side along the lower surface of the first plate-shaped portion 905. The film 24 is wound on the guide roller 31 from above and changes direction. Then, the film 24 extends from the lower side of the guide roller 31 to the upstream side. The film 24 comes into contact with the lower side of the first auxiliary roller 32 and extends further to the upstream side. The film 24 comes into contact with the lower side and the upstream side of the second auxiliary roller 33, and reaches the film roll 22.

As shown in FIG. 32, the CPU 201 detects whether the side 902 of the first plate-shaped portion 905 of the base 2 has been moved to the upstream side by a predetermined distance with respect to the position above the heating portion 40, based on the rotation number of the second motor 222 after the conveyance of the base 2 to the upstream side is started at step S29. The predetermined distance is set to be substantially the same as the distance from the side 902 of the first plate-shaped portion 905 to the second line 982 (refer to FIG. 27). When the side 902 has been moved to the upstream side of the position above the heating portion 40 by the predetermined distance, the CPU 201 stops the driving of the second motor 222 by controlling the drive portion 212, and stops the conveyance of the base 2 (step S30).

The film 24 that extends from the guide roller 31 to the film roll 22 via the first auxiliary roller 32 and the second auxiliary roller 33 is arranged in the vicinity of and below the side 902 of the first plate-shaped portion 905 of the base 2, by the first auxiliary roller 32 and the second auxiliary roller 33 supporting the film 24 on the lower side of the first auxiliary roller 32 and the second auxiliary roller 33. Therefore, even when the base 2 has been moved to the upstream side at steps S29 and S30, the section of the film 24 located on the lower side of the first auxiliary roller 32 and the second auxiliary roller 33 does not come into contact with the base 2. In this manner, when the base 2 is conveyed from the downstream side to the upstream side, the first auxiliary roller 32 and the second auxiliary roller 33 can inhibit the film 24 that extends from the guide roller 31 to the film roll 22 from coming into contact with the base 2.

In this state, the film 24 extends from the side 902 of the first plate-shaped portion 905 of the base 2 to the downstream side along the lower surface of the first plate-shaped portion 905 (refer to FIG. 39). Here, as shown in FIG. 27, the second film 972 is adhered to the lower surface of the first plate-shaped portion 905, more specifically, to the section between the side 902 and the second line 982. Therefore, of the film 24, the section that extends from the side 902 of the first plate-shaped portion 905 to the downstream side along the lower surface overlaps with the lower side of the second film 972 adhered to the lower surface of the first plate-shaped portion 905.

Figure 40:
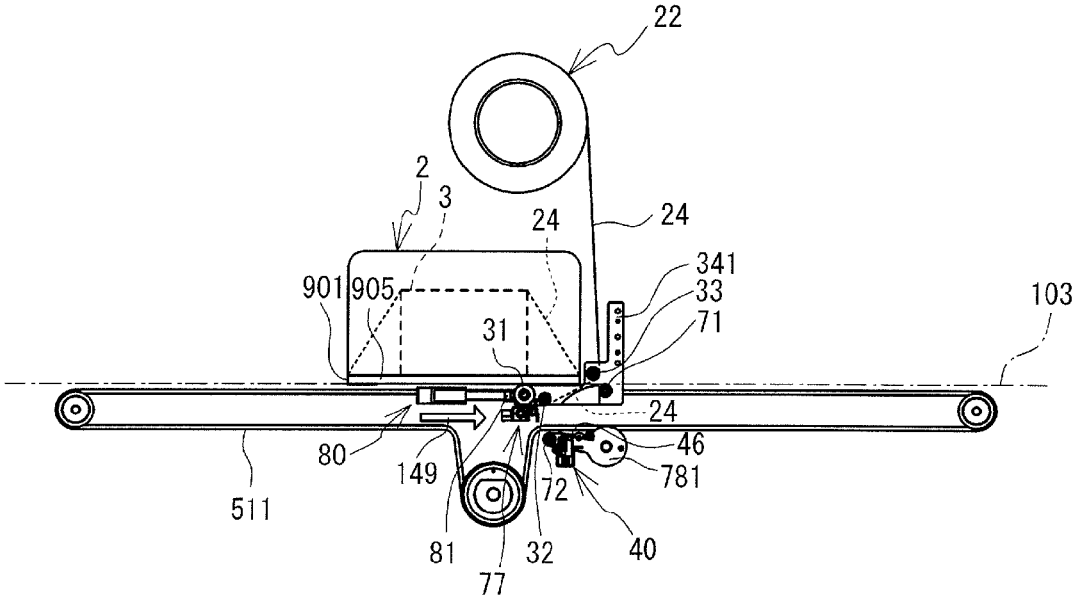
FIG. 40 is a figure showing a packaging step in the packaging processing.

As shown in FIG. 32, the CPU 201 drives the fourth motor 224 by controlling the drive portion 214, and causes the stopper 81 of the rotation inhibiting portion 80 to move to the upstream side (step S31). As shown in FIG. 40, the guide roller 31 located at its lowest position is arranged on the upstream side of the stopper 81. The stopper 81 is moved to the upstream side (an arrow 149). As a result, the rubber strip 811 (refer to FIG. 11) provided on the stopper 81 comes close to the guide roller 31 (refer to FIG. 39), and the film 24 that has been wound on the guide roller 31 is clamped between the rubber strip 811 and the guide roller 31. The springs 83 (refer to FIG. 11) of the rotation inhibiting portion 80 urge the stopper 81 to the upstream side, and thus, the rubber strip 811 pushes the guide roller 31 to the upstream side via the film 24. As a result, the guide roller 31 is inhibited from rotating, and the film 24 is clamped between the guide roller 31 and the rubber strip 811.

The CPU 201 drives the fifth motor 225 by controlling the drive portion 215, and moves the cutting portion 77 from the left to the right along the guide rail 74 (refer to FIG. 5) (step S33). As shown in FIG. 39, the upper end of the blade portion 771 of the cutting portion 77 is arranged higher than the film 24 that extends substantially horizontally between the lower side of the guide roller 31 and the lower side of the first auxiliary roller 32. Therefore, due to the movement of the cutting portion 77 to the right, the film 24 is cut by the blade portion 771, in the section that extends between the guide roller 31 and the first auxiliary roller 32. The cutting portion 77 cuts off the section of the film 24 that covers the first plate-shaped portion 905 of the base 2 and the object 3, from the section of the film 24 that is wound around the film roll 22.

Since the torque is applied to the film roll 22, the tension acts on the section of the film 24 that extends substantially horizontally between the guide roller 31 and the first auxiliary roller 32. The first auxiliary roller 32 presses down the film 24 extending between the guide roller 31 and the second auxiliary roller 33. Therefore, a stronger tension acts on the film 24. Therefore, when the cutting portion 77 is moved to the right, the film 24 does not cling to the blade portion 771 and the film 24 can be appropriately cut.

When the blade portion 771 cuts the film 24 by moving to the right in a state in which the blade portion 771 is in contact with the film 24, a force that guides the film 24 to the right is applied. However, the rotation of the guide roller 31 is inhibited by the stopper 81. The film 24 is clamped between the stopper 81 and the guide roller 31. Therefore, the position of the film 24 with respect to the guide roller 31 is fixed, and the film 24 is not moved to the right due to the movement of the cutting portion 771. It is thus possible to appropriately cut the film 24 by the blade portion 771. After the film 24 has been cut, the guide roller 31 and the stopper 81 maintain the state in which the film 24 is clamped between the guide roller 31 and the stopper 81. It is thus possible to inhibit the film 24 from being displaced from the object 3 after the film 24 has been cut by the cutting portion 771.

Figure 41:
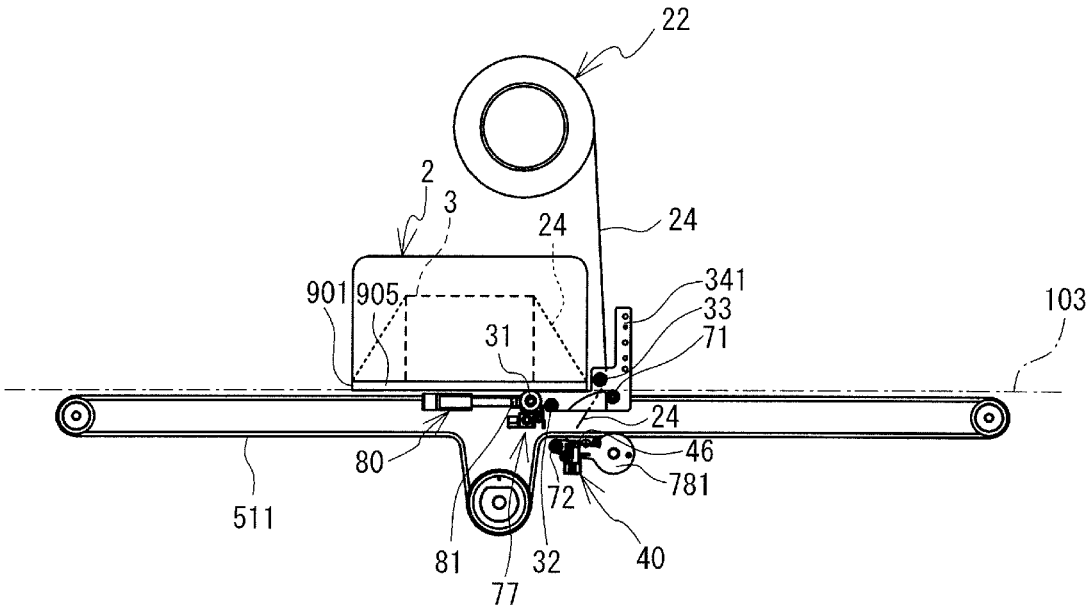
FIG. 41 is a figure showing a packaging step in the packaging processing.

As shown in FIG. 41, after the film 24 has been cut, the cut end of the film 24 extending from the film roll 22 hangs down below the base guide roller 71.

Figure 42:
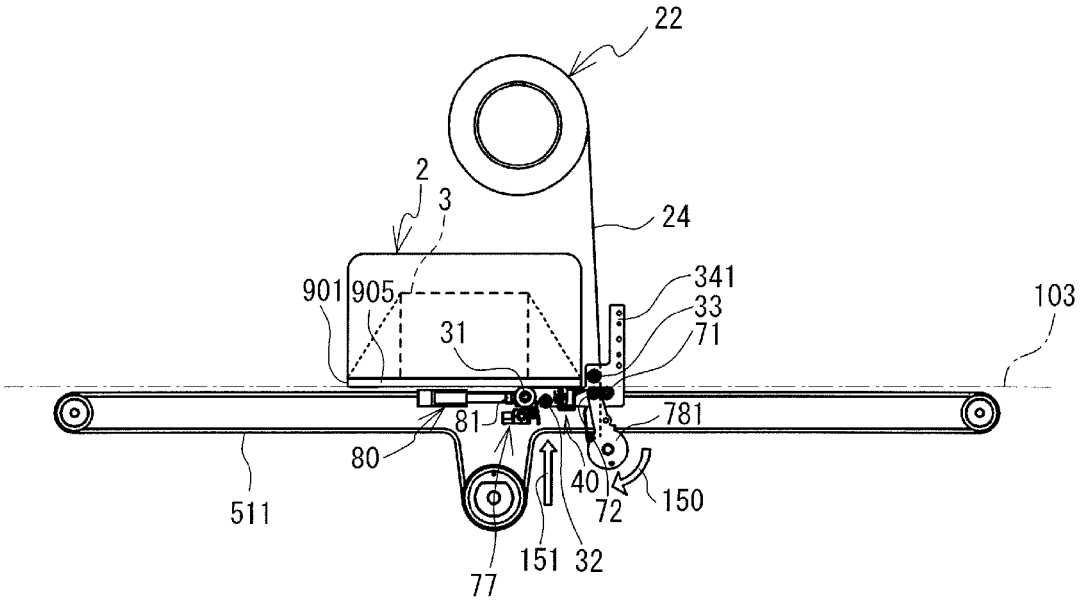
FIG. 42 is a figure showing a packaging step in the packaging processing.
Figure 43:
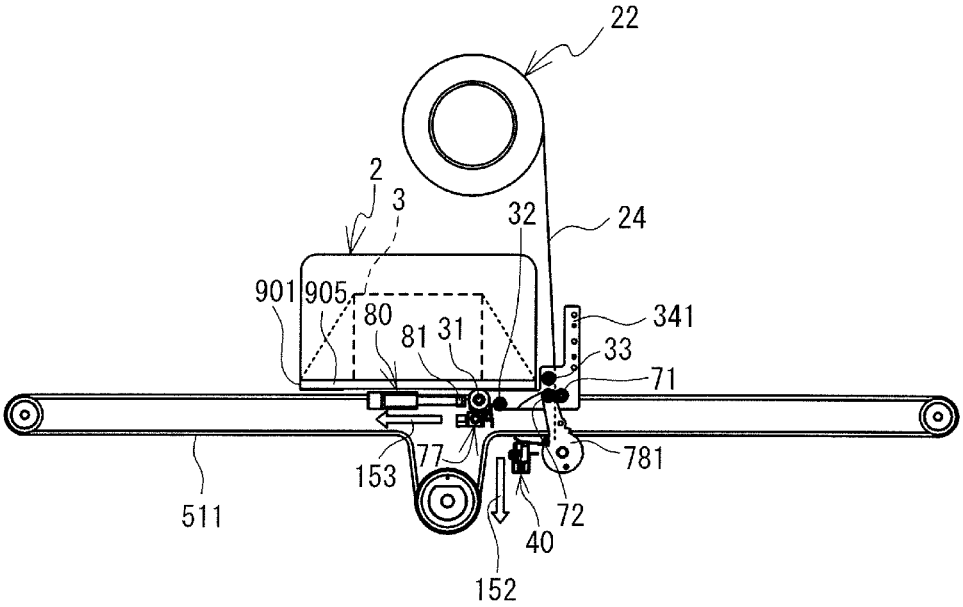
FIG. 43 is a figure showing a packaging step in the packaging processing.

As shown in FIG. 32, the CPU 201 drives the sixth motor 226 by controlling the drive portion 216, and causes the holding portions 78 to pivot (step S35). As shown in FIG. 42, the holding portions 78 are pivoted in the direction of an arrow 150. The holding roller 72 is arranged close to the downstream side of the base guide roller 71. The end of the film 24 that is cut by the cutting portion 77 is clamped by the base guide roller 71 and the holding roller 72.

The CPU 201 drives the third motor 223 by controlling the drive portion 213 and causes the heating portion 40 to move upward (step S37). When the heating portion 40 is located at its highest position, the CPU 201 stops the driving of the third motor 223 by controlling the drive portion 213, and stops the upward movement of the heating portion 40. As shown in FIG. 42, when the heating portion 40 has been moved upward (an arrow 151) to its highest position, the top surfaces of the heating units 41 (refer to FIG. 8) of the heating portion 40 come close to the conveyance path 103 from below. The film 24 is sandwiched between the support portions 414 and the base 2, and the support portions 414 fix the position of the heaters 411 with respect to the film 24.

The side 902 of the first plate-shaped portion 905 of the base 2 has been moved to the upstream side, by the predetermined distance, of the position above the heating portion 40. The film 24 guided by the guide roller 31 is arranged along the lower surface of the first plate-shaped portion 905, in the vicinity of the side 902. As shown in FIG. 27, the second film 972 is adhered to the lower surface of the first plate-shaped portion 905, more specifically, to the section between the side 902 and the second line 982. Therefore, the film 24 that is arranged along the lower surface of the first plate-shaped portion 905 overlaps with the second film 972. Therefore, when the heating portion 40 has been moved upward and is located at its highest position, the film 24 and the second film 972 are sandwiched between the top surfaces of the heating units 41 and the base 2.

As shown in FIG. 32, the CPU 201 causes the heaters 411 of the heating portion 40 to generate heat (step S39). The heaters 411 heat the film 24 and melt the film 24. At the same time, the heaters 411 heat the second film 972 adhered to the base 2, via the film 24, and melt the second film 972. The melted film 24 and the melted second film 972 are bonded together. As a result, the end of the film 24 cut off by the cutting portion 77 is bonded, via the second film 972, to the vicinity of the side 902 of the first plate-shaped portion 905 of the base 2 (step S39). The film 24 cut off from the film roll 22 covers the base 2 and the object 3.

The CPU 201 stops the heat generation of the heaters 411 after a predetermined time period has elapsed from when the heat generation of the heaters 411 is started at step S39 (step S40). The CPU 201 drives the third motor 223 by controlling the drive portion 213 and causes the heating portion 40 to move downward (step S41, an arrow 152 (refer to FIG. 43)). The top surfaces of the heating units 41 are separated from the conveyance path 103 (refer to FIG. 43). When the heating portion 40 is located at its lowest position, the CPU 201 stops the rotation of the third motor 223 by controlling the drive portion 213.

The CPU 201 drives the fourth motor 224 by controlling the drive portion 214, and causes the stopper 81 of the rotation inhibiting portion 80 to move to the downstream side (step S43, an arrow 153 (refer to FIG. 43)). The stopper 81 moves to the downstream side, and the rubber strip 811 provided on the stopper 81 separates from the guide roller 31 (refer to FIG. 43). The guide roller 31 is able to rotate.

The CPU 201 drives the second motor 222 by controlling the drive portion 212, and causes the belts 51 to rotate in the positive direction so that the base 2 is conveyed to the downstream side (step S45). The base 2 and the object 3 for which the packaging is complete are conveyed to the downstream side and are placed on the first receiving tray 12. Due to the rotation of the belts 51 in the positive direction, the conveyance portions 60 are moved to the downstream side. As shown in FIG. 21, when the first conveyance portion 61 that is fixed to the belt 51 reaches the downstream side end of the first receiving tray 12, the belt 51 is wound on the pulley 521 and bent. As a result, the first direction side of the bottom surface of the first protruding portion 611 separates from the belt 51. The first protruding portion 611 extends obliquely upward from the downstream side.

The CPU 201 detects whether the first conveyance portion 61 has been moved to the downstream side and has reached the downstream side end of the first receiving tray 12, based on the rotation number of the second motor 222 after the conveyance of the base 2 to the downstream side is started at step S45 (refer to FIG. 32). When the first conveyance portion 61 has been moved to the downstream side and has reached the downstream side end of the first receiving tray 12, the CPU 201 stops the driving of the second motor 222 by controlling the drive portion 212, and stops the conveyance of the base 2, as shown in FIG. 32 (step S46). The first protruding portion 611 extends obliquely upward from the downstream side. Therefore, the first protruding portion 611 separates from the side 902 of the first plate-shaped portion 905 of the base 2. The distance of separation between the upstream side end of the extending portion 612 and the second protruding portion 621 of the second conveyance portion 62 increases. Therefore, the user may easily remove the base 2 from the conveyance portion 60. The packaging processing ends.

At step S35, the holding portions 78 are pivoted, and thus the end of the film 24 cut off by the cutting portion 77 is clamped by the base guide roller 71 and the holding roller 72. Therefore, the user may continuously package the next base 2 and the next object 3 by the film 24, without performing the operation of pulling out the film 24 from the film cassette 21 and clamping the leading end of the film 24 between the base guide roller 71 and the holding roller 72. When the user continuously performs the packaging operation, after the end of the packaging processing, the CPU 201 drives the second motor 222 by controlling the drive portion 212 so that the belts 51 rotate in the reverse direction. The CPU 201 causes the conveyance portions 60 to move from the downstream side to the upstream side and causes the conveyance portions 60 to be arranged on the second receiving tray 13. At the same time, the CPU 201 resets the support portions 34 and the cutting portion 77 to the state immediately after the initialization (step S11).

Figure 44:
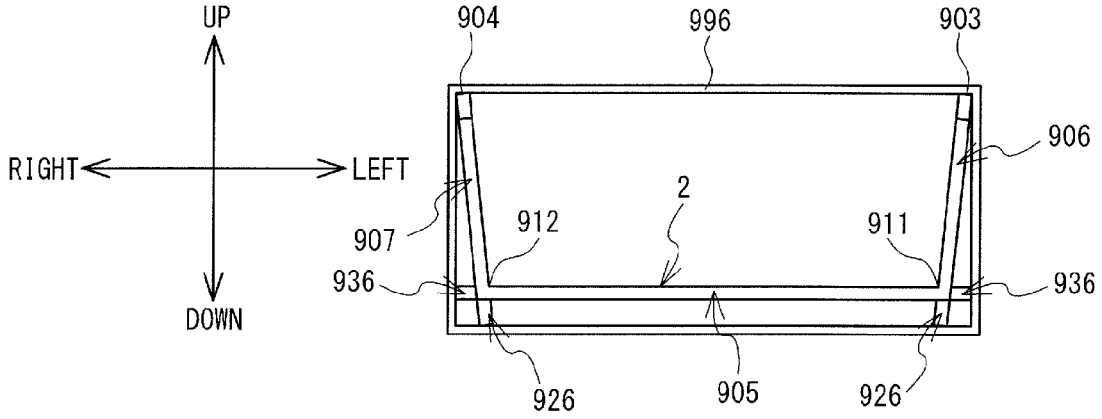
FIG. 44 is a front view of the base when the base is contained in a packaging box.

FIG. 44 shows a state in which the base 2 packaged by the packaging device 1 is contained in a packaging box 996. The object 3 is omitted in FIG. 44. The upper side, the lower side, the left side, and the right side of FIG. 44 are respectively the upper side, the lower side, the right side, and the left side of the packaging box 996 and the base 2. The sides 903 and 904 of the base 2 each are in contact with an intersection position of a side wall and an upper wall of the packaging box 996. The second plate-shaped portions 906 and 907 are slightly inclined such that their lower ends are directed to the inner side in the left-right direction. The left end and the right end of the side surface protruding portions 936 are respectively in contact with the left side wall and the right side wall of the packaging box 996. The lower ends of the bottom surface protruding portions 926 are in contact with the bottom wall of the packaging box 996.

The first plate-shaped portion 905 is supported by the bottom surface protruding portions 926 that protrude downward from the left and right ends of the first plate-shaped portion 905. The first plate-shaped portion 905 is upwardly separated from the bottom wall of the packaging box 996. The side surface protruding portion 936 that protrudes to the right is disposed between the right side wall of the packaging box 996 and the second plate-shaped portion 907. The side surface protruding portion 936 that protrudes to the left is disposed between the left side wall of the packaging box 996 and the second plate-shaped portion 906. A space is provided between the packaging box 996 and the second plate-shaped portions 906 and 907. The object 3 is packaged by the film 24 in a state in which the object 3 is placed on the first plate-shaped portion 905 of the base 2. The first plate-shaped portion 905 is stably fixed inside the packaging box 996 such that the first plate-shaped portion 905 is separated from the packaging box 996. Therefore, an impact applied to the packaging box 996 from the outside is unlikely to be transmitted to the object 3 fixed on the first plate-shaped portion 905. The object 3 can be protected in this manner.

As explained above, in the packaging device 1, the heaters 411 provided on the main bodies 413 of the heating portion 40 can heat the films 24 and 97. The films 24 and 97 can be melted by the heat of the heaters 411. The packaging device 1 can bond the film 24 to the base 2 by bonding the melted films 24 and 97 together.

The heating portion 40 includes the three heating units 41. A position in the up-down direction of each of the heating units 41 with respect to the base 2 can be individually changed. Therefore, even when there is unevenness on the base 2, each of the three heating units 41 can track the unevenness of the base 2 in a favorable manner. Thus, the heater 411 that is provided on each of the heating units 41 can be in contact with the film 24, and the film 24 can be sandwiched between the heater 411 and the base 2. Therefore, the heater 411 of each of the heating units 41 can appropriately heat the film 24. As a result, it is possible to reliably bond the film 24 to the base 2.

In the packaging device 1, each of the heating units 41 includes the plurality of springs 412. Each of the plurality of springs 412 urges the heater 411 upward. When different forces are applied to each of the plurality of springs 412, the position of the top surface of the main body 413 can be freely changed in a direction intersecting the horizontal direction. Therefore, it is possible to further improve a tracking performance of each of the heating units 41 with respect to the unevenness of the base 2.

In the packaging device 1, in the state in which the heating portion 40 is located at its highest position, the support portions 414 can support the film 24 such that the film 24 is sandwiched between the support portions 414 and the base 2. By doing this, the positional relationship between each of the heating units 41 and the film 24 can be fixed. Therefore, the heaters 411 can heat a particular portion of the film 24 intensively. Thus, the heating portion 40 can reliably melt the film 24.

The heating portion 40 can be separated from the conveyance path 103 when the film 24 is not heated. The heating portion 40 can come close to the conveyance path 103 when the film 24 is heated. Therefore, when the base 2 is moved along the conveyance path 103, it is possible to inhibit the heating portion 40 from obstructing the movement of the base 2.

The present disclosure is not limited to the above-described embodiment and various modifications are possible. The heating method of the heater 411 can be changed to a method other than the resistance heating method. For example, the heater 411 may heat the film 24 using a known method, such as a dielectric heating method, a microwave heating method, an induction heating method, a heat pump method, or the like. The member that urges each of the main bodies 413 of the heating unit 41 upward may be changed to a member other than the springs 412. For example, the heating unit 41 may include an elastically deformable member (rubber, for example) in place of the springs 412. The support portion 414 may be provided on the top surface of the main body 413, on the downstream side of the heater 411. The support portion 414 may be provided on the top surface of the main body 413, on each of the upstream side and the downstream side. The support portion 414 need not necessarily be provided on the main body 413.

For example, the number of the heating units 41 may be two. The number of the heating units 41 may be four or more. For example, the single spring 412 may be provided on each of the heating units 41. Three or more of the springs 412 may be provided on each of the heating units 41.

The mechanism that is configured to move the heating portion 40 up and down can be changed. For example, the base portion 43 may include a screw gear in place of the rack gear 431. A helical gear that meshes with the screw gear may be provided on the rotation shaft of the third motor 223. For example, a carriage belt may be provided on the base portion 43. The third motor 223 may rotate the carriage belt.

For example, the heating portion 40 may be fixedly arranged on the lower side of the conveyance path 103. The heaters 411 may be disposed slightly above the conveyance path 103. The heaters 411 may be disposed slightly below the conveyance path. Even when the heaters 411 are disposed slightly below the conveyance path, it is possible to heat the film 24 by adjusting the heating method and the heating temperature of the heaters 411.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A packaging device comprising:

a conveyance mechanism configured to convey, in a conveyance direction along a conveyance path, a base on which an object is placed;

a guide portion configured to guide a film for packaging, the guide portion being configured to move along a movement path, the movement path intersecting the conveyance path and extending in an up-down direction;

a heating portion that is provided below the conveyance path and that is configured to heat the film, the heating portion including a plurality of heating units that are arranged parallel to the conveyance path and that are arranged side by side in a direction intersecting the conveyance direction, each of the plurality of heating units including a heater and an urging portion, the urging portion being configured to urge the heater upward toward the conveyance path; and a processor configured to cause the heating portion to heat the film that has been guided to a lower side of the base by the guide portion.

2. The packaging device according to claim 1, wherein the urging portion includes a plurality of springs that are arranged parallel to the conveyance path and that are arranged side by side in the direction intersecting the conveyance direction.

3. The packaging device according to claim 1, wherein each of the plurality of heating units further includes a support portion configured to sandwich the film between the support portion and the base.

4. The packaging device according to claim 1, wherein the heating portion is configured to be switched between in a first state and in a second state, the first state being a state in which the heater is close to the conveyance path from below, and the second state being a state in which the heater is separated from the conveyance path.

* * * * *